US012006637B2

(12) United States Patent
Hamilton et al.

(10) Patent No.: US 12,006,637 B2
(45) **Date of Patent: *Jun. 11, 2024**

(54) SINGLE-PLANE MULTI-FUNCTIONAL RAILWAY COMPONENT HANDLING SYSTEM

(71) Applicant: MOW Equipment Solutions, Inc., Linwood, KS (US)

(72) Inventors: William Michael Hamilton, Linwood, KS (US); Ryan Jay Koci, Stilwell, KS (US); Justin Wynne Tomac, Bonner Springs, KS (US)

(73) Assignee: MOW Equipment Solutions, Inc., Linwood, KS (US)

( * ) Notice: Subject to any disclaimer, the term of this patent is extended or adjusted under 35 U.S.C. 154(b) by 854 days.

This patent is subject to a terminal disclaimer.

(21) Appl. No.: 17/025,841

(22) Filed: Sep. 18, 2020

(65) Prior Publication Data

US 2021/0071370 A1 Mar. 11, 2021

Related U.S. Application Data

(63) Continuation of application No. 15/889,562, filed on Feb. 6, 2018, now Pat. No. 10,781,559.
(Continued)

(51) Int. Cl.

| | |
|---|---|
| ***E01B 29/24*** | (2006.01) |
| ***E01B 29/32*** | (2006.01) |
| ***E01B 31/20*** | (2006.01) |

(52) U.S. Cl.
CPC ..... *E01B 29/24* (2013.01); *E01B 29/32* (2013.01); *E01B 31/20* (2013.01)

(58) Field of Classification Search
CPC ..... E01B 29/24; E01B 29/32; E01B 31/20
See application file for complete search history.

(56) References Cited

U.S. PATENT DOCUMENTS

| | | | |
|---|---|---|---|
| 308,421 | A | 11/1884 | Meyenberg |
| 4,457,060 | A | 7/1984 | Parks et al. |

(Continued)

OTHER PUBLICATIONS

U.S. Appl. No. 15/090,428, "Restriction Requirement", dated Apr. 26, 2018, 6 pages.

(Continued)

*Primary Examiner* — Robert J McCarry, Jr.
(74) *Attorney, Agent, or Firm* — Kilpatrick Townsend & Stockton LLP

(57) ABSTRACT

Systems, methods, and non-transitory, machine-readable media for extracting railway fasteners and adjusting railway anchors are disclosed. A tie plate manipulator may be slidably coupled with a frame assembly and may include tie plate tools in an opposing arrangement and slidably coupled with a support framework. A fastener extractor may include fastener-extracting arms and pivot joints pivotably coupling the fastener-extracting arms with a subassembly. The fastener extractor may be slidably coupled with the frame assembly so that at least part of the fastener extractor is disposed over the tie plate manipulator. The fastener extractor may be coupled with the tie plate manipulator at least in part with a cylinder system. Each fastener-extracting arm may be adjustable to selectively engage and extract a railway fastener. The tie plate manipulator may be operable to engage and adjust a tie plate on the railway tie with the pair of tie plate tools.

20 Claims, 31 Drawing Sheets

Related U.S. Application Data

(60) Provisional application No. 62/455,931, filed on Feb. 7, 2017.

(56) References Cited

U.S. PATENT DOCUMENTS

| | | | |
|---|---|---|---|
| 4,890,558 | A | 1/1990 | Quella et al. |
| 4,903,611 | A | 2/1990 | Holley |
| 5,074,219 | A | 12/1991 | Theurer et al. |
| 5,117,760 | A | 6/1992 | Almaraz et al. |
| 5,277,122 | A | 1/1994 | Almaraz et al. |
| 5,331,899 | A | 7/1994 | Holley |
| 5,438,931 | A | 8/1995 | Becker et al. |
| 5,577,447 | A | 11/1996 | Weber et al. |
| 5,586,502 | A | 12/1996 | Weber |
| 5,694,856 | A | 12/1997 | Theurer et al. |
| 5,730,060 | A | 3/1998 | Straub et al. |
| 5,915,744 | A | 6/1999 | Cotsford |
| 6,138,573 | A | 10/2000 | Brenny et al. |
| 6,324,659 | B1 | 11/2001 | Pierro |
| 6,662,729 | B1 | 12/2003 | Madison |
| 7,104,200 | B2 | 9/2006 | Hosking et al. |
| 7,574,961 | B2 | 8/2009 | Barezzani et al. |
| 7,677,177 | B2 | 3/2010 | Ganz |
| 8,485,103 | B2 | 4/2013 | Miller et al. |
| 8,522,688 | B2 | 9/2013 | Pritzl |
| 8,739,704 | B2 | 6/2014 | Wickman et al. |
| 9,841,287 | B1 | 12/2017 | Hayward |
| 10,190,264 | B2 | 1/2019 | Hamilton et al. |
| 10,526,753 | B2 | 1/2020 | Hamilton et al. |
| 10,781,559 | B2 * | 9/2020 | Hamilton ..... E01B 29/24 |
| 10,781,560 | B2 | 9/2020 | Hamilton et al. |
| 11,268,247 | B2 | 3/2022 | Hamilton et al. |
| 2004/0006413 | A1 | 1/2004 | Kane et al. |
| 2005/0067381 | A1 | 3/2005 | Coomer |
| 2011/0072998 | A1 | 3/2011 | Noll et al. |
| 2011/0308421 | A1 | 12/2011 | Prtizl |
| 2012/0199037 | A1 | 8/2012 | Miller et al. |
| 2012/0296562 | A1 | 11/2012 | Carlson et al. |
| 2013/0276278 | A1 | 10/2013 | Barezzani et al. |
| 2013/0300551 | A1 | 11/2013 | Weber et al. |
| 2015/0053449 | A1 | 2/2015 | Henke |
| 2016/0153151 | A1 | 6/2016 | Irion |
| 2016/0159380 | A1 | 6/2016 | Le-Corre et al. |
| 2016/0289899 | A1 | 10/2016 | Hamilton et al. |
| 2016/0298299 | A1 | 10/2016 | Hamilton et al. |
| 2018/0223482 | A1 | 8/2018 | Hamilton et al. |
| 2018/0223483 | A1 | 8/2018 | Hamilton et al. |
| 2019/0130669 | A1 | 5/2019 | Boggio |
| 2019/0194878 | A1 | 6/2019 | Hamilton et al. |
| 2022/0122004 | A1 | 4/2022 | Takahara et al. |

OTHER PUBLICATIONS

U.S. Appl. No. 15/886,987, Non-Final Office Action, dated Mar. 10, 2020, 7 pages.

U.S. Appl. No. 15/889,562, "Corrected Notice of Allowability", dated Jun. 15, 2020, 2 pages.

U.S. Appl. No. 17/115,886, Non-Final Office Action, dated Mar. 3, 2023, 28 pages.

Application No. CA2,994, 132, Notice of Allowance, dated Mar. 20, 2023, 4 pages.

U.S. Appl. No. 16/230,476 received a Non-Final Office Action dated Jul. 7, 2021, 13 pages.

U.S. Appl. No. 16/119,150 received a Notice of Allow ance dated Sep. 5, 2019, 5 pages.

Non Final Office Action dated Jul. 2, 2018 in U.S. Appl. No. 15/090,428, 10 pages.

Notice of Publication dated Oct. 6, 2016 in U.S. Appl. No. 15/090,428, 1 page.

Notice of Allowance dated Sep. 14, 2018 in U.S. Appl. No. 15/090,428, 5 pages.

Non-Final Rejection dated Mar. 10, 2020 in U.S. Appl. No. 15/886,957, 11 pages.

Notice of Allowance dated May 19, 2020 in U.S. Appl. No. 15/886,957, 7 pages.

Notice of Allowance dated May 20, 2020 in U.S. Appl. No. 15/889,562, 15 pages.

U.S. Appl. No. 17/115,886, Final Office Action, dated Sep. 8, 2023, 32 pages.

Application No. CA2,994,083 , Office Action, dated Jul. 14, 2023, 4 pages.

Application No. CA3,028,637 , Office Action, dated Oct. 20, 2023, 4 pages.

* cited by examiner

SINGLE-PLANE MULTI-FUNCTIONAL RAILWAY COMPONENT HANDLING SYSTEM

CROSS-REFERENCES TO RELATED APPLICATIONS

The present application is a Continuation Application of U.S. patent application Ser. No. 15/889,562, filed on Feb. 6, 2018, which claims the benefit of, and priority to, U.S. Provisional Application No. 62/455,931, filed on Feb. 7, 2017, the entire disclosures of each of which are incorporated herein by reference for all purposes.

BACKGROUND

Disclosed embodiments of the present disclosure relate generally to railways, and in particular to maintenance of way with systems, apparatuses, and methods for railway component adjustment.

With the hundreds of thousands of miles of railroad track traversing the United States alone, in addition to the great lengths throughout other countries of the world, maintenance of way is a tremendous and important effort. One aspect of maintenance of way is railway tie maintenance. Railway ties are typically made of wood or other materials that age and deteriorate over time due to railway use and environmental conditions. As a result, railway ties eventually require replacement with new railway ties.

There are multiple steps in a process of railway tie replacement. Rails of railroad tracks are typically fastened to railway ties with a combination of railway spikes, tie plates fastened to the railway ties with the railway spikes, and railway anchors attached to undersides of the rails to anchor the rails to sides of the railway ties. Under current work practices, a typical tie replacement gang comprises several unique machines, in some cases 20 and more, forming a long line and arranged in the necessary order to perform sequential tasks for removing an old, worn railway tie and replacing it with a new railway tie. The work window is often 8-12 hours long and typically includes 2,000-5,000 ties that are replaced per day. Several issues are presented by the process, including issues redounding in inefficiencies, costs, and risks for personal injury. The trend is toward shorter and shorter work windows, with a desire for more productivity. So, more productive equipment is needed. Also, at the end of an allotted time of a work window, due to the sheer number of machines in a work gang that must get off the main track onto the side track in order to allow normal rail traffic to pass, the process of moving all machines onto the side track can take several minutes.

Thus, there is a need to solve these problems and provide for systems, apparatuses, and methods for railway component adjustment. These and other needs are addressed by the present disclosure.

BRIEF SUMMARY

Disclosed embodiments of the present disclosure relate generally to railway, and in particular to maintenance of way with apparatuses and methods for railway tie plate retention.

In one aspect, a railway component handling system to extract railway fasteners and adjust railway anchors is disclosed. The railway component handling system may include one or a combination of the following. A frame assembly of a railway workhead may include a first leg and a second leg. A tie plate manipulator may be slidably coupled with the first leg and the second leg of the frame assembly. The tie plate manipulator may include a slide assembly that includes a pair of tie plate tools in an opposing arrangement and slidably coupled with a support framework at least partially with a pair of beams of the support framework. The tie plate manipulator may include at least one tool actuator coupled with the pair of tie plate tools and the support framework, the at least one tool actuator adapted to cause sliding movement of the pair of tie plate tools with respect to the pair of beams. A fastener extractor may include a pair of fastener-extracting arms and pivot joints, each pivot joint pivotably coupling one fastener-extracting arm of the pair of fastener-extracting arms with a subassembly of the fastener extractor. The fastener extractor may be slidably coupled with the frame assembly so that at least part of the fastener extractor is disposed over the tie plate manipulator, with at least part of the tie plate manipulator between the pair of fastener-extracting arms. The fastener extractor may be coupled with the tie plate manipulator at least in part with a cylinder system. Each fastener-extracting arm of the pair of fastener-extracting arms may include an extracting head disposed at a distal end of the fastener-extracting arm. Each fastener-extracting arm of the pair of fastener-extracting arms may be adjustable to selectively engage, with the extracting head, a railway fastener from one or more addressing positions, when the railway fastener is at least partially installed in a railway tie. Each fastener-extracting arm of the pair of fastener-extracting arms may be operable to selectively extract, with the extracting head, the railway fastener from the railway tie. The tie plate manipulator may be operable to engage a tie plate on the railway tie with the pair of tie plate tools, and to adjust one or more railway anchors when the one or more railway anchors are attached to a rail.

In another aspect, a method of extracting railway fasteners and adjusting railway anchors is disclosed. The method may include one or a combination of the following. Aligning a tie plate manipulator and a fastener extractor with respect to a set of railway components may be caused so that the tie plate manipulator and the fastener extractor are simultaneously disposed in an aligned position above the set of railway components. The fastener extractor may include a pair of fastener-extracting arms. The aligned position may at least partially correspond to the fastener extractor being disposed over the tie plate manipulator, with at least part of the tie plate manipulator between the pair of fastener-extracting arms. Lowering of the fastener extractor toward at least one railway fastener at least partially installed in a railway tie may be caused, the lowering performed while the tie plate manipulator and the fastener extractor are in the aligned position above the set of railway components. Each fastener-extracting arm of the pair of fastener-extracting arms may include an extracting head disposed at a distal end of the fastener-extracting arm. Adjustment of at least one fastener-extracting arm of the pair of fastener-extracting arms to selectively engage, with at least one of the extracting heads, at least one railway fastener from one or more addressing positions may be caused, when the railway fastener is at least partially installed in a railway tie. The adjustment may be performed while the tie plate manipulator and the fastener extractor are in the aligned position above the set of railway components. Subsequent adjustment of the at least one fastener-extracting arm of the pair of fastener-extracting arms to selectively extract, with the respective extracting head, the railway fastener from the railway tie may be caused. The subsequent adjustment may be performed while the tie plate manipulator and the fastener extractor are in the aligned position above the set of railway components. Lowering of the tie plate manipulator toward a tie plate that is on the railway tie may be caused. The lowering may be performed while the tie plate manipulator and the fastener extractor are in the aligned position above the set of railway components. The tie plate manipulator may be caused to engage the tie plate with a pair of tie plate tools. The engaging may be performed while the tie plate manipulator and the fastener extractor are in the aligned position above the set of railway components. The tie plate manipulator may be caused to adjust one or more railway anchors when the one or more railway anchors are attached to a rail. The adjusting may be performed while the tie plate manipulator and the fastener extractor are in the aligned position above the set of railway components.

In yet another aspect, one or more non-transitory, machine-readable media are disclosed. The one or more non-transitory, machine-readable media may have machine-readable instructions thereon which, when executed by one or more processing devices, causes the one or more processing devices to instruct a railway workhead to perform one or a combination of the following. Aligning a tie plate manipulator and a fastener extractor with respect to a set of railway components may be caused so that the tie plate manipulator and the fastener extractor are simultaneously disposed in an aligned position above the set of railway components. The fastener extractor may include a pair of fastener-extracting arms. The aligned position may at least partially correspond to the fastener extractor being disposed over the tie plate manipulator, with at least part of the tie plate manipulator between the pair of fastener-extracting arms. Lowering of the fastener extractor toward at least one railway fastener at least partially installed in a railway tie may be caused, the lowering performed while the tie plate manipulator and the fastener extractor are in the aligned position above the set of railway components. Each fastener-extracting arm of the pair of fastener-extracting arms may include an extracting head disposed at a distal end of the fastener-extracting arm. Adjustment of at least one fastener-extracting arm of the pair of fastener-extracting arms to selectively engage, with at least one of the extracting heads, at least one railway fastener from one or more addressing positions may be caused, when the railway fastener is at least partially installed in a railway tie. The adjustment may be performed while the tie plate manipulator and the fastener extractor are in the aligned position above the set of railway components. Subsequent adjustment of the at least one fastener-extracting arm of the pair of fastener-extracting arms to selectively extract, with the respective extracting head, the railway fastener from the railway tie may be caused. The subsequent adjustment may be performed while the tie plate manipulator and the fastener extractor are in the aligned position above the set of railway components. Lowering of the tie plate manipulator toward a tie plate that is on the railway tie may be caused. The lowering may be performed while the tie plate manipulator and the fastener extractor are in the aligned position above the set of railway components. The tie plate manipulator may be caused to engage the tie plate with a pair of tie plate tools. The engaging may be performed while the tie plate manipulator and the fastener extractor are in the aligned position above the set of railway components. The tie plate manipulator may be caused to adjust one or more railway anchors when the one or more railway anchors are attached to a rail. The adjusting may be performed while the tie plate manipulator and the fastener extractor are in the aligned position above the set of railway components.

In various embodiments of the aspects, the tie plate manipulator may be operable to indirectly adjust the one or more railway anchors by moving the tie plate. In various embodiments of the aspects, the fastener extractor further may be coupled with the tie plate manipulator in an over-under arrangement so that a centerline of the fastener extractor coincides with a centerline of the tie plate manipulator. In various embodiments of the aspects, the pair of fastener-extracting arms may be adjustable to selectively engage the railway fasteners from the one or more addressing positions of the pair of fastener-extracting arms at least in part by sliding the pair of fastener-extracting arms with a rod and cylinder subassembly while maintaining a balanced state with respect to the centerline of the fastener extractor.

In various embodiments of the aspects, the cylinder system may be operable to selectively raise or lower, with respect to the frame assembly, the tie plate manipulator together with the fastener extractor. The cylinder system may be further operable to selectively raise or lower, with respect to the frame assembly, the fastener extractor without moving the tie plate manipulator. The cylinder system may be further operable to selectively raise or lower, with respect to the frame assembly, the tie plate manipulator without moving the fastener extractor.

In various embodiments of the aspects, a system controller may be configured to facilitate alignment of the tie plate manipulator and the fastener extractor with respect to a set of one or more fastening components so that the tie plate manipulator and the fastener extractor are disposed in an aligned position with respect to the set of one or more fastening components. In various embodiments of the aspects, when the fastener extractor is in the aligned position, the fastener extractor may be operable to extract, with one or both of the fastener-extracting arms of the pair of fastener-extracting arms, one or more railway fasteners from the railway tie. In various embodiments of the aspects, when the tie plate manipulator is in the aligned position and without adjusting the alignment, the tie plate manipulator may be operable to engage the tie plate with the pair of tie plate tools, and to adjust the one or more railway anchors. In various embodiments of the aspects, each fastener-extracting arm of the pair of fastener-extracting arms may be independently operable with respect to the other fastener-extracting arm of the pair of fastener-extracting arms to selectively engage and extract the one or more railway fasteners.

In various embodiments of the aspects, the adjusting the one or more railway anchors may include indirectly adjusting the one or more railway anchors by moving the tie plate. In various embodiments of the aspects, the selectively engaging the at least one railway fastener from the one or more addressing positions of the pair of fastener-extracting arms may include sliding the pair of fastener-extracting arms with a rod and cylinder subassembly while maintaining a balanced state with respect to the centerline of the fastener extractor. In various embodiments of the aspects, the lowering of the fastener extractor toward the at least one railway fastener may include lowering the fastener extractor without moving the tie plate manipulator.

In various embodiments of the aspects, the lowering of the fastener extractor toward the at least one railway fastener further may include lowering the tie plate manipulator together with the fastener extractor prior to the lowering the fastener extractor without moving the tie plate manipulator.

In various embodiments of the aspects, the lowering of the tie plate manipulator toward the tie plate comprises lowering the tie plate manipulator without moving the fastener extractor. In various embodiments of the aspects, the fastener extractor may be raised without moving the tie plate manipulator prior to the lowering the tie plate manipulator without moving the fastener extractor. In various embodiments of the aspects, the adjustment and the subsequent adjustment of the at least one fastener-extracting arm of the pair of fastener-extracting arms may include each fastener-extracting arm of the pair of fastener-extracting arms being independently operated with respect to the other fastener-extracting arm of the pair of fastener-extracting arms to selectively engage and extract railway fasteners.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the following appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability, or configuration of the disclosure. Rather, the ensuing description of the preferred exemplary embodiment(s) will provide those skilled in the art with an enabling description for implementing a preferred exemplary embodiment of the disclosure. It should be understood that various changes may be made in the function and arrangement of elements without departing from the spirit and scope of the disclosure as set forth in the appended claims.

Figure 1A:
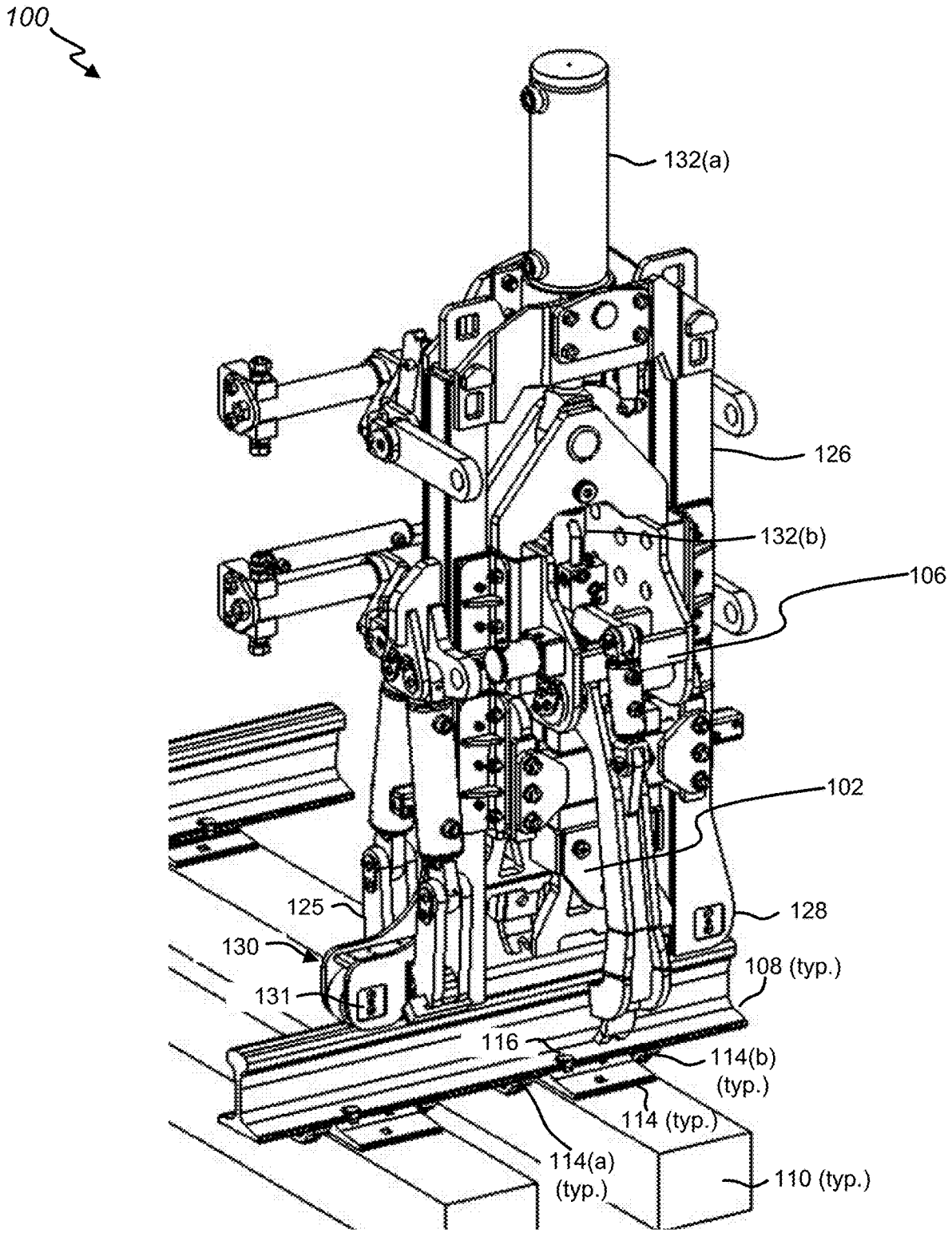
FIG. 1A depicts a partial perspective view of a single-plane multi-functional railway component handling system from a field side of a rail, in accordance with disclosed embodiments of the present disclosure.
Figure 1B:
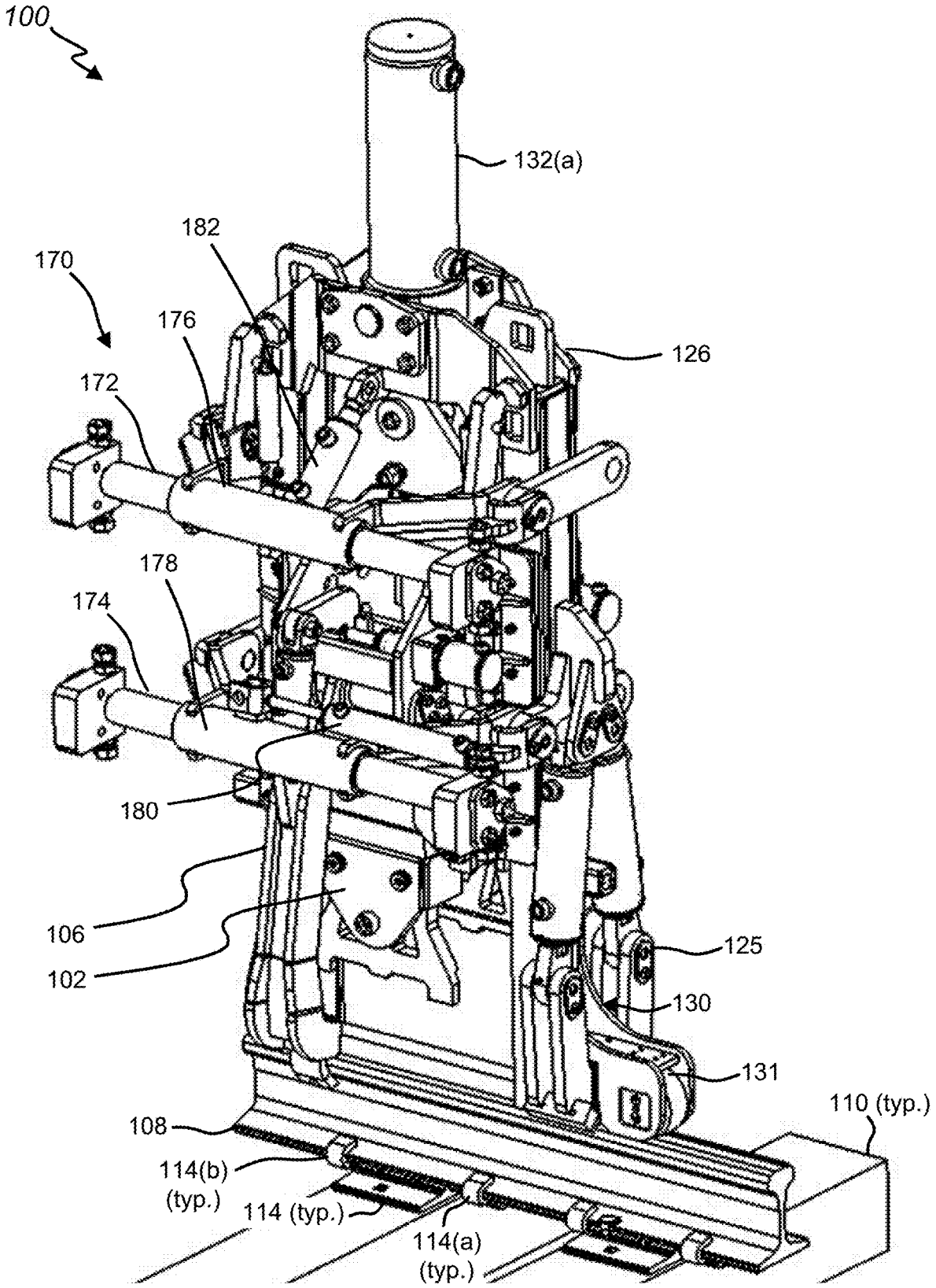
FIG. 1B depicts a partial perspective view of the single-plane multi-functional railway component handling system from a gage side of the rail, in accordance with disclosed embodiments of the present disclosure.

Various embodiments will now be discussed in greater detail with reference to the accompanying figures, beginning with FIG. 1A. FIG. 1A depicts a partial perspective view of a single-plane multi-functional railway component handling system 100 from a field side of a rail 108, in accordance with disclosed embodiments of the present disclosure. FIG. 1B depicts a partial perspective view of the single-plane multi-functional railway component handling system 100 from a gage side of the rail 108, in accordance with disclosed embodiments of the present disclosure.

The railway, as is typical, comprises a pair of rails 108 (though only one rail 108 is depicted in various views herein) supported by a plurality of railway ties 110 and fastened to the railway ties 110 with a combination of railway fasteners 116, tie plates 114 fastened to the railway ties 110 with the railway fasteners 116 driven through fastener holes of the tie plates 114, and railway anchors 114(*a*), 114(*b*) attached to undersides of the rails 108 to anchor the rails to sides the railway ties 110. As used herein, the term "gage side" or "gauge side" is used to indicate an association with a space between the pair of rails 108 and/or a side of a rail 108 or other component exposed to, facing, and/or oriented toward the space between the pair of rails 108. The term "field side" is used to indicate an association with a space external to the pair of rails 108 and/or a side of a rail 108 or other component exposed to, facing, and/or oriented toward the space external to the pair of rails 108. In some instances, a railway fastener 116 may be a railway spike. In other instances, a railway fastener 116 may be a lag screw or another type of fastener. The depicted examples herein show the railway fastener 116 as a railway spike.

In some embodiments, the component handling system 100 may include over-under railway component handling system that includes a tie plate manipulation subsystem 102 (sometimes referenced herein as tie plate manipulator 102) and a fastener-extracting subsystem 106 (sometimes referenced herein as fastener extractor 106). The tie plate manipulation subsystem 102 and the fastener-extracting subsystem 106 may be configured in an over-under arrangement such that the tie plate manipulation subsystem 102 is disposed generally under the fastener-extracting subsystem 106. This configuration may allow tandem operation of the tie plate manipulation subsystem 102 and the fastener extractor 106. As such, the tie plate manipulation subsystem 102 and the fastener extractor 106 may operate in a single plane such that the tie plate manipulation subsystem 102 and the fastener-extracting subsystem 106 may have the same or substantially the same centerline. In operation, the component handling system 100, once positioned over a given railway tie 110, may utilize the fastener extractor 106 to extract one or more railway fasteners 116 from the railway tie 110. Then, without any repositioning or without significant repositioning along the rail 108—and with minimal transition time—the component handling system 100 may utilize the tie plate manipulator 102 to manipulate the tie plate 114. Specifically, the tie plate manipulator 102 may be lowered to engage the tie plate 114. Further, the tie plate manipulator 102 may then adjust the railway anchors 114(*a*), 114(*b*)—again, without any or without significant repositioning along the rail 108 and with minimal transition time to perform the adjustment operations.

Materials for various structural components of the component handling system 100 may be selected such that the structural components can generate necessary forces to move railway components in accordance with various embodiments disclosed herein, while safely withstands stresses imparted to the structural elements of the system from those aforementioned forces. Said materials may include structural quality alloy steels with medium to high carbon content and may involve certain heat treatment and tempering to produce components with the necessary strength.

While disclosed embodiments of the component handling system 100 are illustrated as an example, the component handling system 100 may include other types of railway machinery and workheads not shown. Other embodiments, for example, may include spike-driving workheads, railway anchor installation workheads, and/or any other suitable type of railway installation and/or maintenance machinery. In various embodiments, the component handling system 100 may be adapted for conjunction with a variety of railway workheads.

The component handling system 100 may be coupled to a motorized railway maintenance vehicle (not shown). The railway maintenance vehicle may include an engine, a chassis, wheels for traversing along one or more of the rails 108, and other suitable components known to a person of ordinary skill in the art. Accordingly, the railway maintenance vehicle may include an operator cab, station, or other area with control elements of a control system that allow for control of the railway maintenance vehicle. The railway maintenance vehicle may be any suitable vehicle adapted for coupling to the component handling system 100.

The component handling system 100 may be configured to mechanically connect to other equipment not shown, such as a railway maintenance vehicle or other intermediary components such as a frame coupling the workhead of the component handling system 100 to the railway maintenance vehicle, via a dual-shaft support assembly 170. As depicted, for example, in FIG. 1B, the dual-shaft support assembly 170 may include two, parallel support shafts 172, 174. Each support shaft 172, 174 may be configured for attachment at each end of the shaft to the other equipment not shown. The rest of the workhead may be pivotably coupled with the support shaft 172, 174 by way of dual slidable frame couplings 176, 178. For example, in some embodiments, bracket arms of the dual slidable frame couplings 176, 178 may be pivotably coupled with the frame assembly 126 by way of suitable pin-and-bore couplings. The dual slidable frame couplings 176, 178 may be adapted to allow the rest of the workhead to be slidably coupled with the support shafts 172, 174.

Figure 1C:
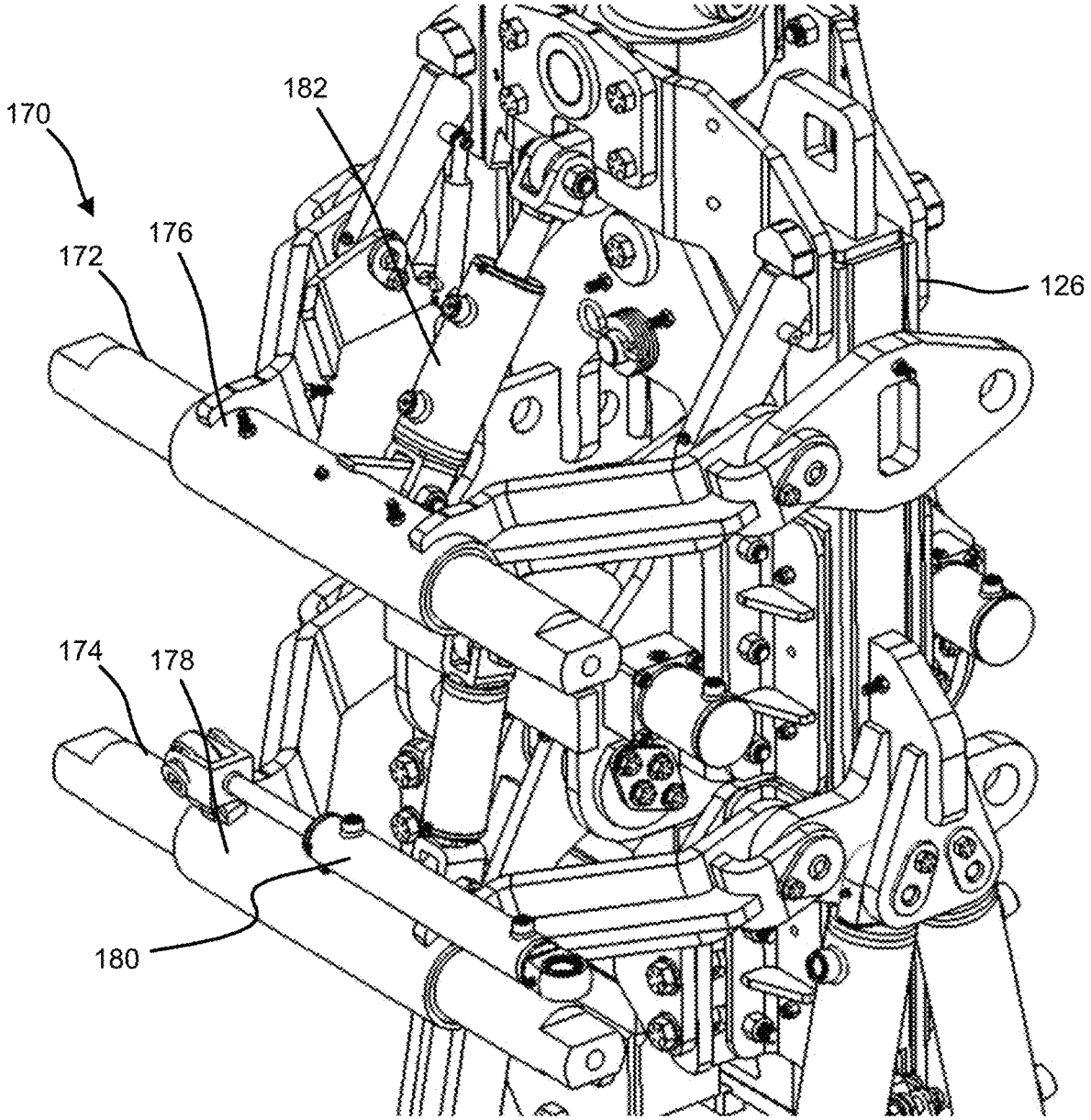
FIG. 1C depicts a close-up partial perspective view of the single-plane multi-functional railway component handling system, showing the dual-shaft support assembly, in accordance with disclosed embodiments of the present disclosure.

FIG. 1C depicts a close-up partial perspective view of the single-plane multi-functional railway component handling system 100, showing the dual-shaft support assembly 170, in accordance with disclosed embodiments of the present disclosure. One or more support shaft cylinders 180 may be coupled with one or both of the support shafts 172, 174 and the other equipment not shown. The depicted example illustrates a single lateral adjustment cylinder 180 coupled with the support shaft 174 at one end of the lateral adjustment cylinder 180, with the other end of the lateral adjustment cylinder 180 configured for attachment to the other equipment not shown. The lateral adjustment cylinder 180 may be adapted to selectively extend and retract in order to selectively push or pull to move the slidable frame couplings 176, 178 along the support shafts 172, 174. With such action, all the workhead components coupled to the slidable frame couplings 176, 178, including the tie plate manipulator 102 and the fastener extractor 106, may be positioned along a plane that is parallel or substantially parallel to the rail 108. In operation, once the workhead is positioned generally over a given railway tie 110 with other equipment not shown, the lateral adjustment cylinder 180 may be actuated to further refine the positioning of the workhead that is supported by the slidable frame couplings 176, 178. Such positioning may be directed by an operator or may be directed by control system 201 based at least in part on the sensor feedback described herein.

Such lateral positioning may also be relegated to one or more initial positioning refinement stages. Further lateral positioning of the tie plate manipulator 102 and the fastener extractor 106 may be effected by way of other actuators disclosed further herein, such as a double-rod cylinder 152 and actuators of an adjuster cylinder subassembly 124. However, some embodiments may utilize the lateral adjustment cylinder 180 in conjunction with the double-rod cylinder 152 and actuators of an adjuster cylinder subassembly 124 during adjustment operations even after the initial positioning of structure supported by the slidable frame couplings 176, 178. The various positioning operations may provide an extended range of movement for the adjustment operations and may be directed by control system 201 based at least in part on the sensor feedback.

The component handling system 100 may include a rigid, metal frame assembly 126. As depicted, the frame assembly 126 may be an assembly of components. Other frame configurations may be included in other embodiments. The component handling system 100, including the frame assembly 126, its forward leg 128, rear leg 130, and linkages, may be fabricated to possess material strength and overall structural strength to generate and accommodate the forces involved to adjust tie plates 114, railway anchors 114(*a*), 114(*b*), and to extract railway fasteners 116 from railway ties 110.

In addition to facilitating lateral movement of the workhead, the dual-shaft support assembly 170 may facilitate vertical movement of the workhead. One or more workhead lift cylinders 182 may be pivotably coupled with one or both of the support shafts 172, 174 and the frame assembly 126. The depicted example illustrates a single workhead lift cylinder 182 coupled with the slidable frame coupling 176 at one end of the workhead lift cylinder 182, with the other end of the workhead lift cylinder 182 coupled to the frame assembly 126.

The workhead lift cylinder 182 may be adapted to selectively extend and retract in order to selectively push or pull to move the frame assembly 126 and the rest of the workhead via the slidable frame couplings 176, 178, which may correspond to dual pivotable linkages. The workhead lift cylinder 182 may be oriented to have a line of action such that actuation of the workhead lift cylinder 182 forces the slidable frame couplings 176, 178 to pivot with respect to the support shafts 172, 174. In some embodiments, the bracket arms of the slidable frame couplings 176, 178 may be maintained in parallel orientation or substantially parallel orientation with respect to one another throughout the movements. Additionally, the vertical orientation of the workhead may be maintained throughout the movements. Examples of different positions resulting from such movement are illustrated with the examples of FIGS. 1D and 1E.

Figure 1E:
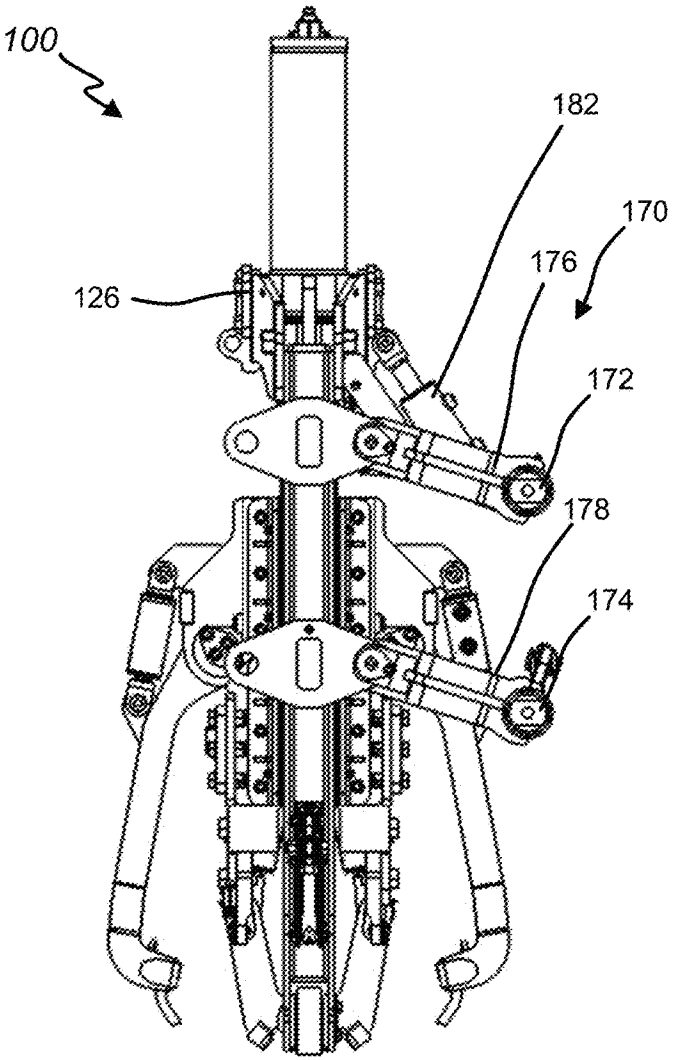
FIG. 1E depicts a partial end view of the workhead with the dual pivotable linkages and the workhead in a raised position with respect to the support shafts, in accordance with disclosed embodiments of the present disclosure.
Figure 1D:
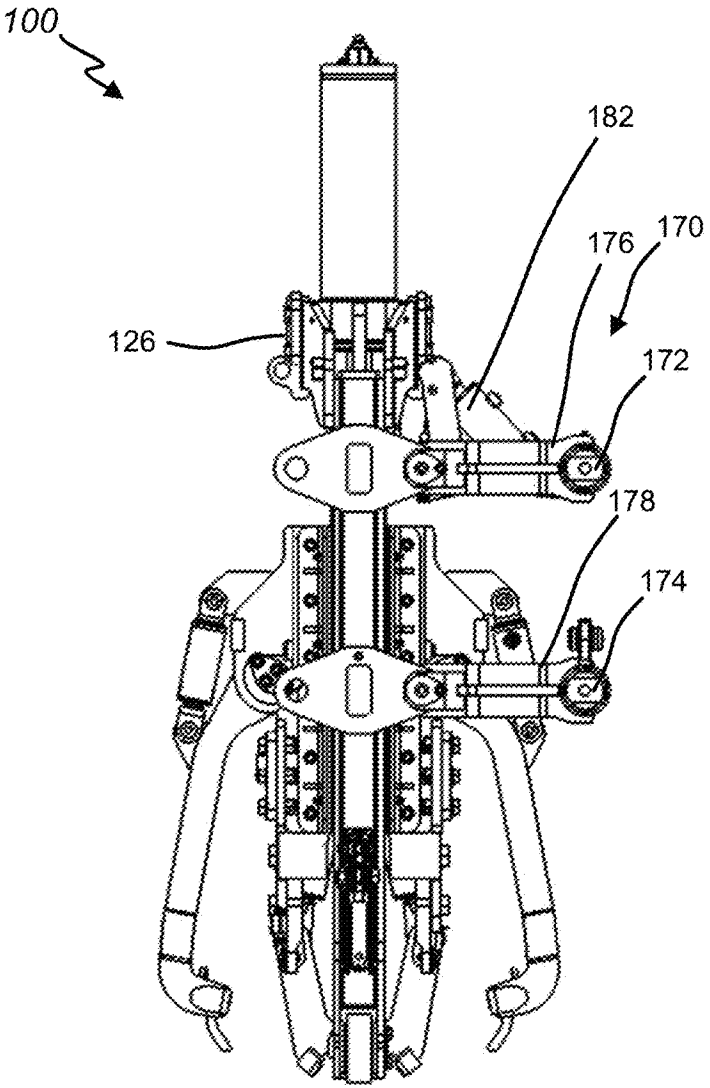
FIG. 1D depicts a partial end view of the workhead with the dual pivotable linkages and the workhead in one position with respect to the support shafts, in accordance with disclosed embodiments of the present disclosure.

FIG. 1D depicts a partial end view of the workhead with the dual pivotable linkages and the workhead in one position with respect to the support shafts 172, 174, in accordance with disclosed embodiments of the present disclosure. In that example, the workhead lift cylinder 182 is illustrated in a state holding the workhead such that the bracket arms of the slidable frame couplings 176, 178 are horizontal or substantially horizontal. The state of the workhead lift cylinder 182 may correspond to a partially retracted state or a fully retracted state, in various embodiments. The position the workhead could, for example, correspond to a ready position of the workhead where the workhead is held above the rail 108, or a deployed position of the workhead where the workhead is position on the rail 108. In the deployed position, the frame assembly 126 and other workhead components coupled to the frame assembly 126 may be aligned with the rail 108. In operation, once the workhead is positioned on the rail 108, the lateral adjustment operations disclosed herein may be executed to further refine the positioning of the workhead.

FIG. 1E depicts a partial end view of the workhead with the dual pivotable linkages and the workhead in a raised position with respect to the support shafts 172, 174, in accordance with disclosed embodiments of the present disclosure. In that example, the workhead lift cylinder 182 is illustrated in an extended state having raised the workhead with respect to the support shafts 172, 174 the such that the bracket arms of the slidable frame couplings 176, 178 are disposed at a non-horizontal angle, having pivoted with respect to the support shafts 172, 174 and with respect to the pivot points of the pivotable attachments to the frame assembly 126. The state of the workhead lift cylinder 182 may correspond to a partially extended state or a fully extended state, in various embodiments. The position the workhead could, for example, correspond to a raised or ready position of the workhead where the workhead is held above the rail 108.

The tie plate manipulator 102 and the fastener extractor 106 may be slidably coupled to the frame assembly 126. As in the depicted example, the frame assembly 126 may include a forward leg 128 that is connected to a roller assembly that is disposed in a forward position. The references to forward are with respect to one direction of travel of the component handling system 100 along the rail 108, however the component handling system 100 is moveable in the reverse direction. The frame assembly 126 may further include a rear leg 130 that is connected to a roller assembly 131 that follows the forward leg 128 along the direction of travel.

Figure 3:
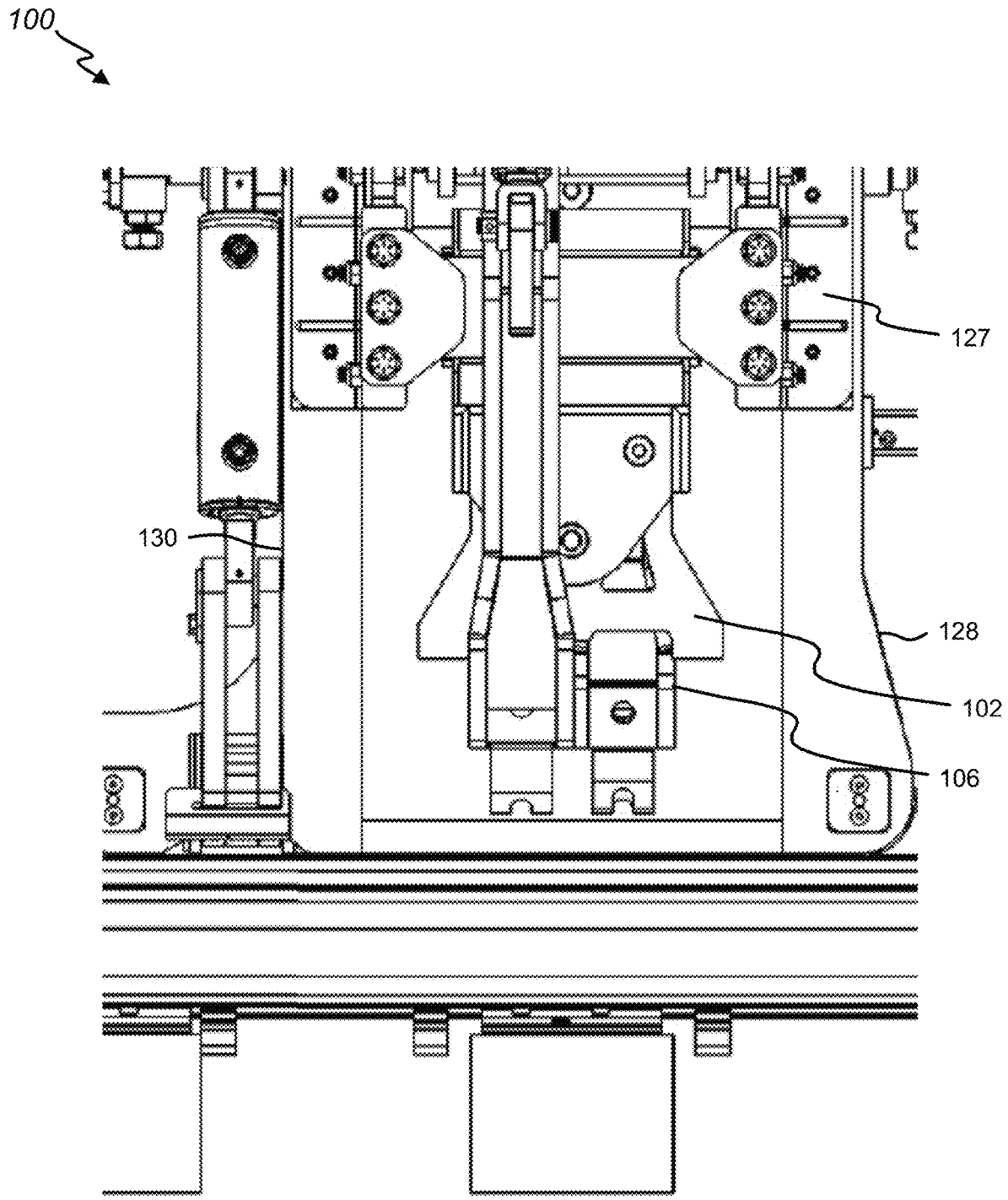
FIG. 3 depicts a partial side view of the single-plane multi-functional railway component handling system with the tie plate manipulation subsystem and the fastener extractor in stowed positions, in accordance with disclosed embodiments of the present disclosure.

FIG. 3 depicts a partial side view of the single-plane multi-functional railway component handling system 100 with the tie plate manipulation subsystem 102 and the fastener extractor 106 in stowed positions, in accordance with disclosed embodiments of the present disclosure. As in the depicted example, the tie plate manipulator 102 may be slidably connected to the frame assembly 126 via a dual-slide frame coupling 127. The dual-slide frame coupling 127 may allow the tie plate manipulator 102 to slide along the rear leg 130 and the forward leg 128 when raised and lowered by actuation of one or more lift cylinders coupled to the tie plate manipulator 102.

Referring again more particularly to FIG. 1, the rearward position of the rear leg 130 may accommodate a rail clamp assembly 125 of the workhead that is integrated into the rear leg 130. The roller assembly 131 include a roller to contact the rail 108 and facilitate movement of the component handling system 100 along the rail 108. Thus, the frame assembly 126, including the forward leg 128 and the rear leg 130 may provide a rigid guide structure for the tie plate manipulator 102 and the fastener extractor 106 to slide vertically for various operations and for housing the roller which allow the frame assembly 126 to roll along the top of the rail head of the rail 108 during use.

Figure 2:
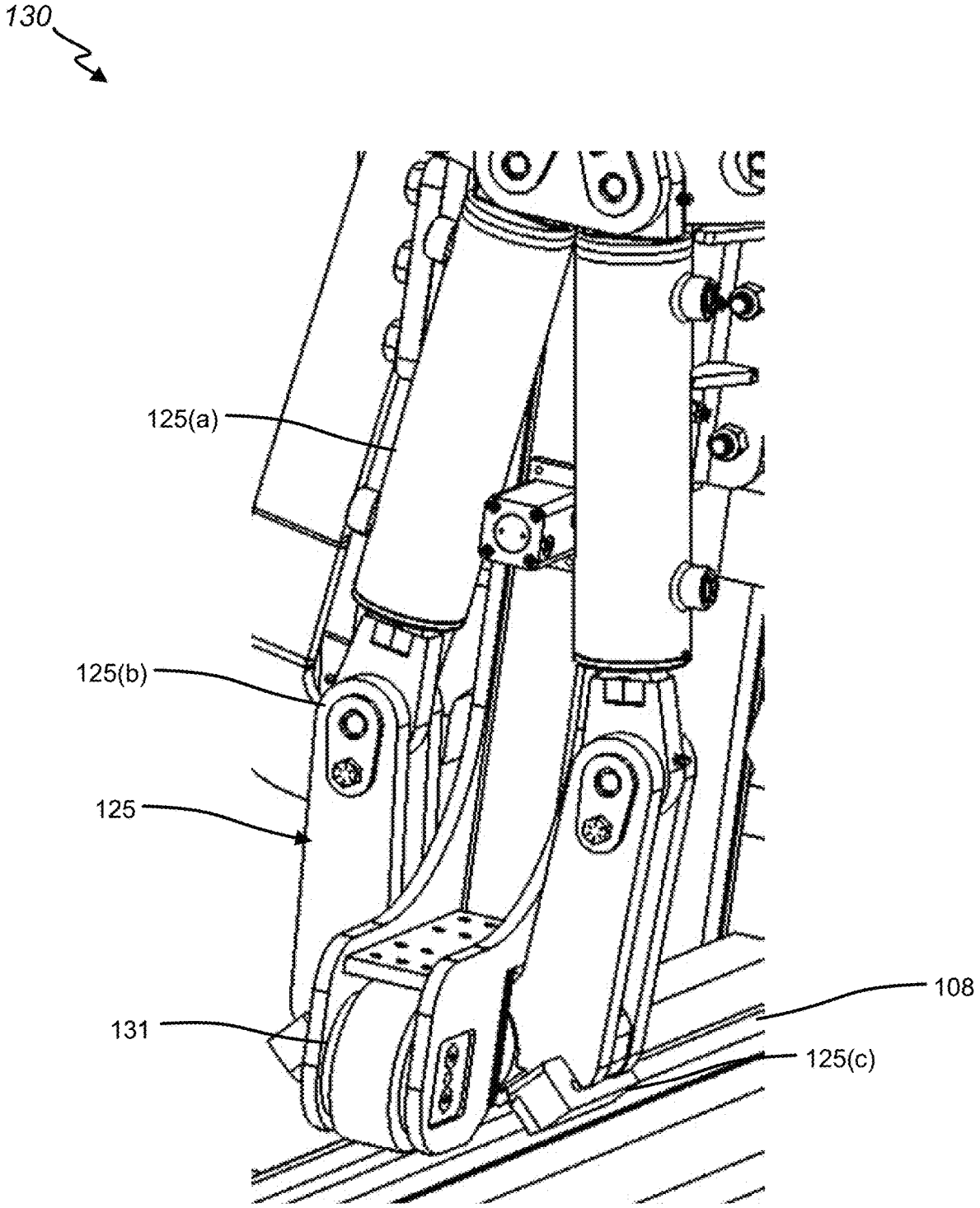
FIG. 2 depicts a partial perspective view of a portion of the rear leg and the rail clamp assembly, in accordance with disclosed embodiments of the present disclosure.

FIG. 2 depicts a partial perspective view of a portion of the rear leg 130 and the rail clamp assembly 125, in accordance with disclosed embodiments of the present disclosure. In various embodiments, the tie plate manipulator 102, working in conjunction with the rail clamp assembly 125, may be adapted to apply approximately 6,000 to 8,500, 10,000, 12,000, or more pounds of force to the railway anchors 114(*a*), 114(*b*). Accordingly, the component handling system 100, including the frame assembly 126, its forward leg 128, rear leg 130, and linkages, may be fabricated to possess material strength and overall structural strength to generate and accommodate the forces involved to adjust the railway anchors 114(*a*), 114(*b*) while the rail clamp assembly 125 is engaged to clamp the rail 108. The system 100 may utilize the rail clamp assembly 125 to stabilize the assembly during railway component adjustments.

The rail clamp assembly 125 may include opposing clamp cylinders 125(*a*) adapted with a linkage system 125(*b*) to extend and retract rail clamp tools 125(*c*) to respectively grasp and release the rail head of the rail 108, which may be performed under control of the control system 201. The clamp cylinders 125(*a*) may each include control ports for connection to control lines (hydraulic, pneumatic, electrical, etc., in various embodiments) and connection to the control system 201.

The rail clamp assembly 125 may be specially formed to work in conjunction with guide blocks of the rail clamp tools 125(*c*) which serve to contact the rail 108 and maintain a restrained condition for the rail clamp tools 125(*c*), while allowing clamping and releasing movements with respect to each other under tightly controlled guidance. Each tool of the rail clamp tools 125(*c*) may be formed with a particular shape and contour in order to allow for even contact with faces of the rail head. In some embodiments, the different shape and angles of the rail clamp tools 125(*c*) address the cant of the rail 108. The rails of a railway are typically designed and installed to have a slight tilt (e.g., approximately 1.4°) toward the gage side.

Figure 4A:
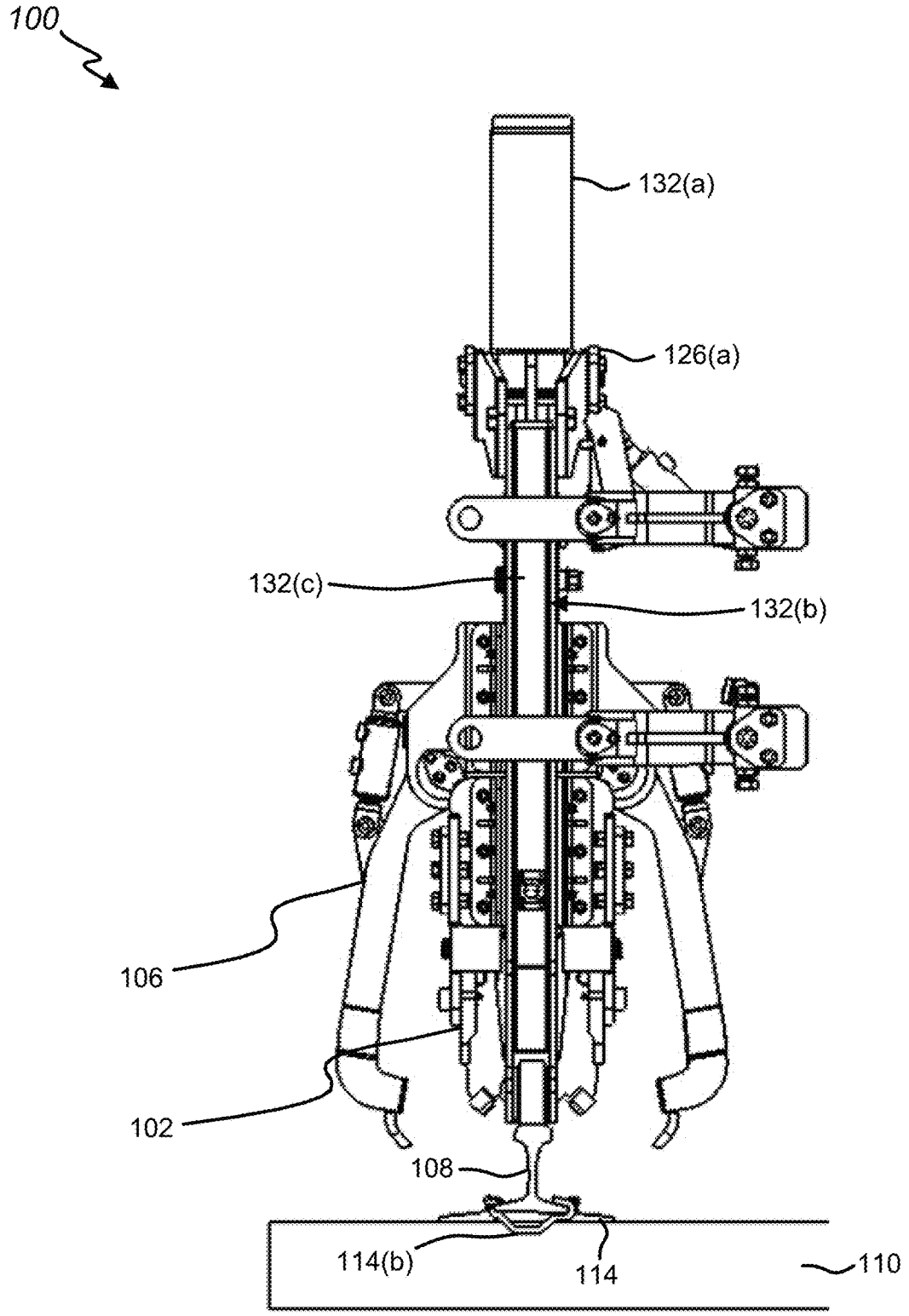
FIG. 4A depicts a partial end view of the single-plane multi-functional railway component handling system with the tie plate manipulation subsystem in a stowed position and the fastener extractor in a ready position, in accordance with disclosed embodiments of the present disclosure.
Figure 4B:
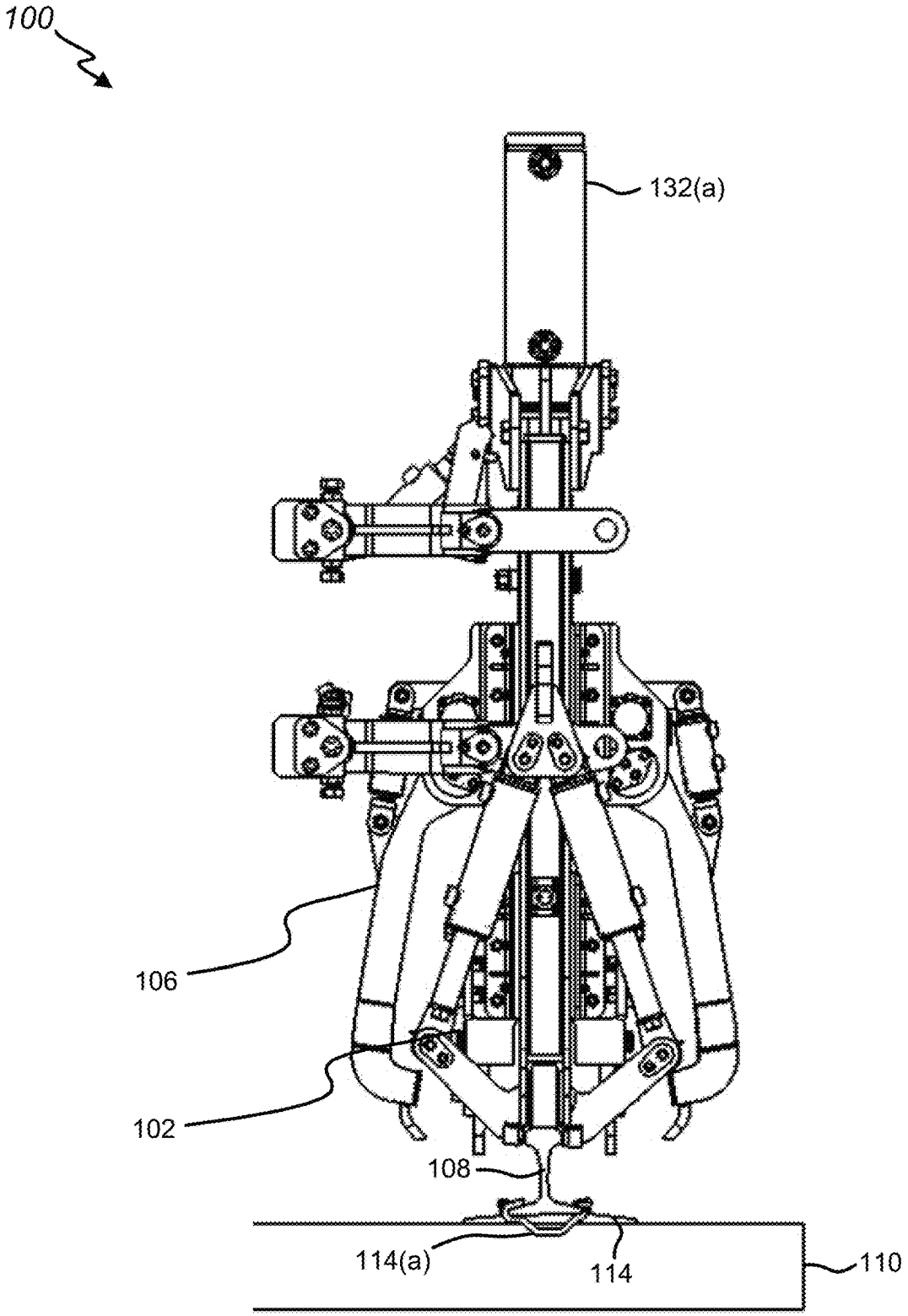
FIG. 4B depicts a partial opposite end view of the single-plane multi-functional railway component handling system with the tie plate manipulation subsystem and the fastener extractor in ready positions, in accordance with disclosed embodiments of the present disclosure.
Figure 5A:
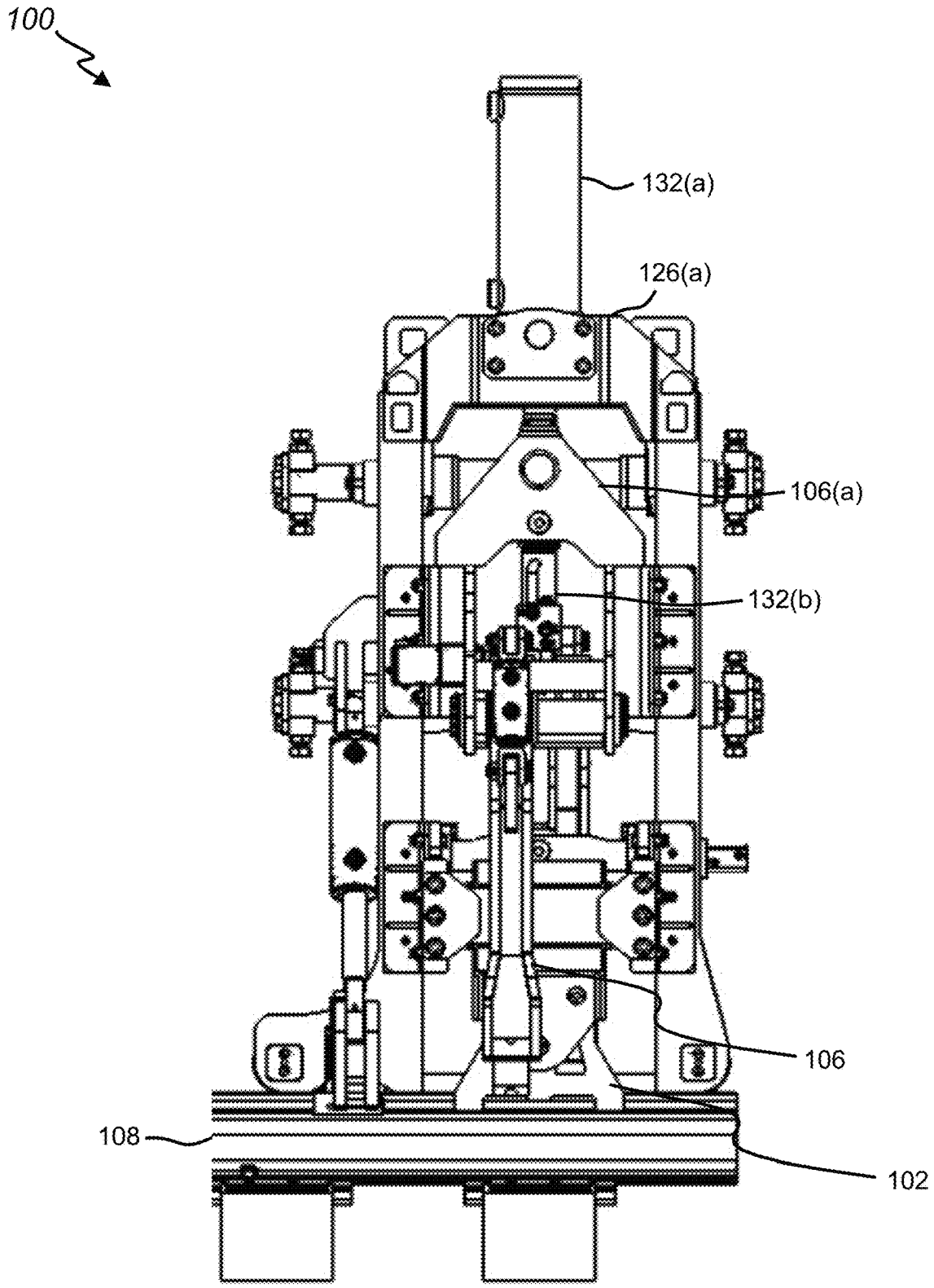
FIG. 5A depicts a partial side view of the single-plane multi-functional railway component handling system with the tie plate manipulation subsystem and the fastener extractor in ready positions, in accordance with disclosed embodiments of the present disclosure.
Figure 5B:
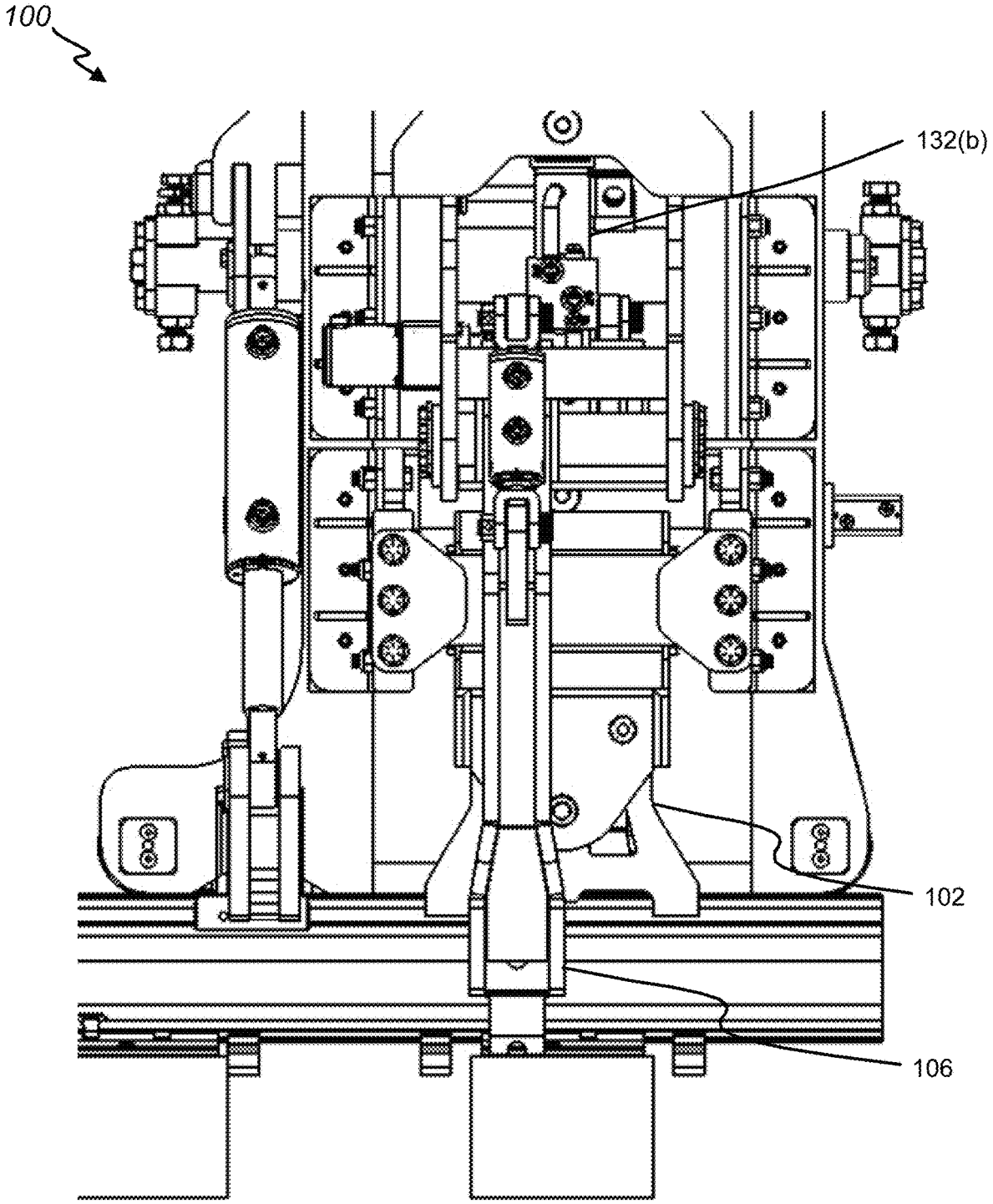
FIG. 5B depicts a partial side view of the single-plane multi-functional railway component handling system with the fastener extractor in a deployed position while the tie plate manipulation subsystem remains in a ready position, in accordance with disclosed embodiments of the present disclosure.

FIG. 4A depicts a partial end view of the single-plane multi-functional railway component handling system 100 with the tie plate manipulation subsystem 102 in a stowed position and the fastener extractor 106 in a ready position, in accordance with disclosed embodiments of the present disclosure. FIG. 4B depicts an opposite partial end view of the single-plane multi-functional railway component handling system 100 with the tie plate manipulation subsystem 102 and the fastener extractor 106 in ready positions, in accordance with disclosed embodiments of the present disclosure. FIG. 5A depicts a partial side view of the single-plane multi-functional railway component handling system 100 with the tie plate manipulation subsystem 102 and the fastener extractor 106 in ready positions, in accordance with disclosed embodiments of the present disclosure. FIG. 5B depicts a partial side view of the single-plane multi-functional railway component handling system 100 with the fastener extractor 106 in a deployed position while the tie plate manipulation subsystem 102 remains in a ready position, in accordance with disclosed embodiments of the present disclosure. Other embodiments may be configured to utilize other stowed positions and/or other ready positions.

According to various embodiments, the tie plate manipulation subsystem 102 and/or the fastener extractor 106 may be lowered to a working position with each set of one or more components associated with each railway tie 110 and may be raised to a stowed position or another position suitable for transition between railway ties 110 to create or increase clearance with respect to railway components. Such embodiments may allow for increased adaptability to a variety of working conditions. However, disclosed embodiments may allow for the tie plate manipulator 102 to remain in a lowered working position or to be partially raised as the component adjustment system 100 transitions between railway ties 110 to make component adjustments associated with a plurality of railway ties 110. Such embodiments may allow for increased speed and efficiency in making component adjustments with respect to a large number of railway ties 110. Some of such embodiments may include adjusting fastener-extracting arms 120 to an outward state away from the rail 108 to create or increase clearance with respect to railway components to accommodate transitions between railway ties 110 while the fastener extractor 106 remains in a lowered working position.

The system 100 may include a multiple actuator system, which may correspond to a multiple cylinder system. The multiple cylinder system may include one or more lift cylinders coupled in tandem. For example, one or more lift cylinders 132(*a*) may be arranged to raise and lower the tie plate manipulator 102 and the fastener extractor 106 together, such that the tie plate manipulator 102 and the fastener extractor 106 selectively slide with respect to the frame assembly 126 toward and away from the rail 108. Accordingly, the tie plate manipulator 102 and the fastener extractor 106 may be raised and lowered through a range of retracted and extended positions to allow vertical positioning of the tie plate manipulator 102 and the fastener extractor 106 with respect to the frame assembly 126 toward and the rail 108.

As more clearly illustrated with FIG. 5A, in some embodiments, the housing of the lift cylinder 132(*a*) may be fixedly attached to an upper portion 126(*a*) of the workhead frame assembly 126. The rod of the lift cylinder 132(*a*) may be fixedly attached to an extractor frame assembly 106(*a*) of the fastener extractor 106. For example, the rod may be anchored to a pin of the extractor frame assembly 106(*a*).

Additionally, the multiple cylinder system may include one or more additional lift cylinders 132(*b*) adapted to extend and retract to raise and lower the tie plate manipulator 102 independently of the fastener extractor 106 through a range of retracted and extended positions. The depicted example includes one lift cylinder 132(*a*) coupled with an additional lift cylinder 132(*b*) in tandem such that each share a longitudinal axis. Hence, the multiple cylinder system 142 may include a tandem cylinder system.

One end of the lift cylinder 132(*b*) may be coupled to the extractor frame assembly 106(*a*). In some embodiments, the lift cylinder 132(*b*) may be coupled to the extractor frame assembly 106(*a*) by way of suitable pin-and-bore couplings. The other end of the lift cylinder 132(*b*) may be coupled to the tie plate manipulator 102. For example, the lift cylinder 132(*b*) may be coupled to brackets of the frame assembly of the tie plate manipulator 102, as depicted more clearly, for example, in FIG. 19. In some embodiments, the lift cylinder 132(*b*) may be coupled to the frame assembly of the extractor frame assembly 106(*a*) by way of suitable pin-and-bore couplings.

In some embodiments, the system 100 may include, for example, slide components with one or more attachments. In various embodiments, the tie plate manipulator 102 may be attachable to a variety of equipment, frames, workheads, and/or the like, for example, at least in part via an attachment of the lift cylinder 132(*a*) and one or more attachments of the slide components. The lift cylinders 132(*a*), 132(*b*) and/or other cylinders/actuators in various embodiments described herein may correspond to any one or combination of hydraulic actuators, pneumatic actuators, electric actuators, and/or the like to extend and retract in accordance with disclosed embodiments and may be referenced herein as power cylinders or actuators. The actuators/cylinders of the system 100 may each include control ports for connection to control lines (hydraulic, pneumatic, electrical, etc., in various embodiments) and connection to the control system 201. In some embodiments, control valves with solenoids and electrical connections to one or more main processors of the control system 201 that may be located at the operator's station or at any suitable place.

In some embodiments, when transitioning from and to the stowed or undeployed state, the tie plate manipulator 102 and the fastener extractor 106 may be coupled such that the tie plate manipulator 102 and the fastener extractor 106 move together, being lowered or raised together. For example, when the fastener extractor 106 moves from a stowed position to a deployed position, the tie plate manipulator 102 may likewise move from a stowed position to an undeployed position. As disclosed above, the one or more additional cylinders 132(*b*) may be further adapted to raise and lower the tie plate manipulator 102 independently from the fastener extractor 106. For example, from the undeployed position, the tie plate manipulator 102 may transition to a deployed position to engage a tie plate 114.

Figure 6:
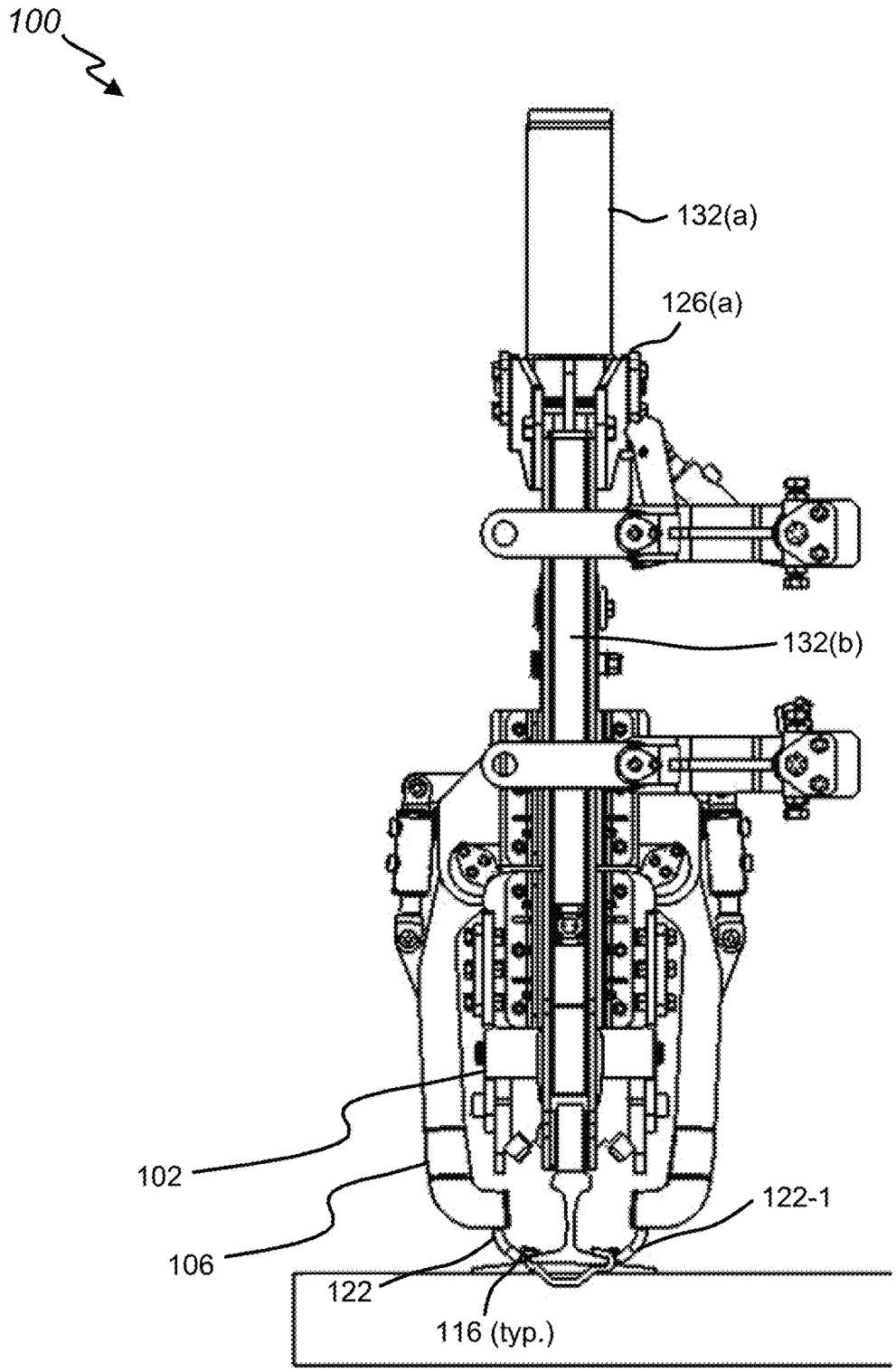
FIG. 6 depicts a partial end view of the single-plane multi-functional railway component handling system with the fastener extractor initially engaging railway fasteners, in accordance with disclosed embodiments of the present disclosure.
Figure 7:
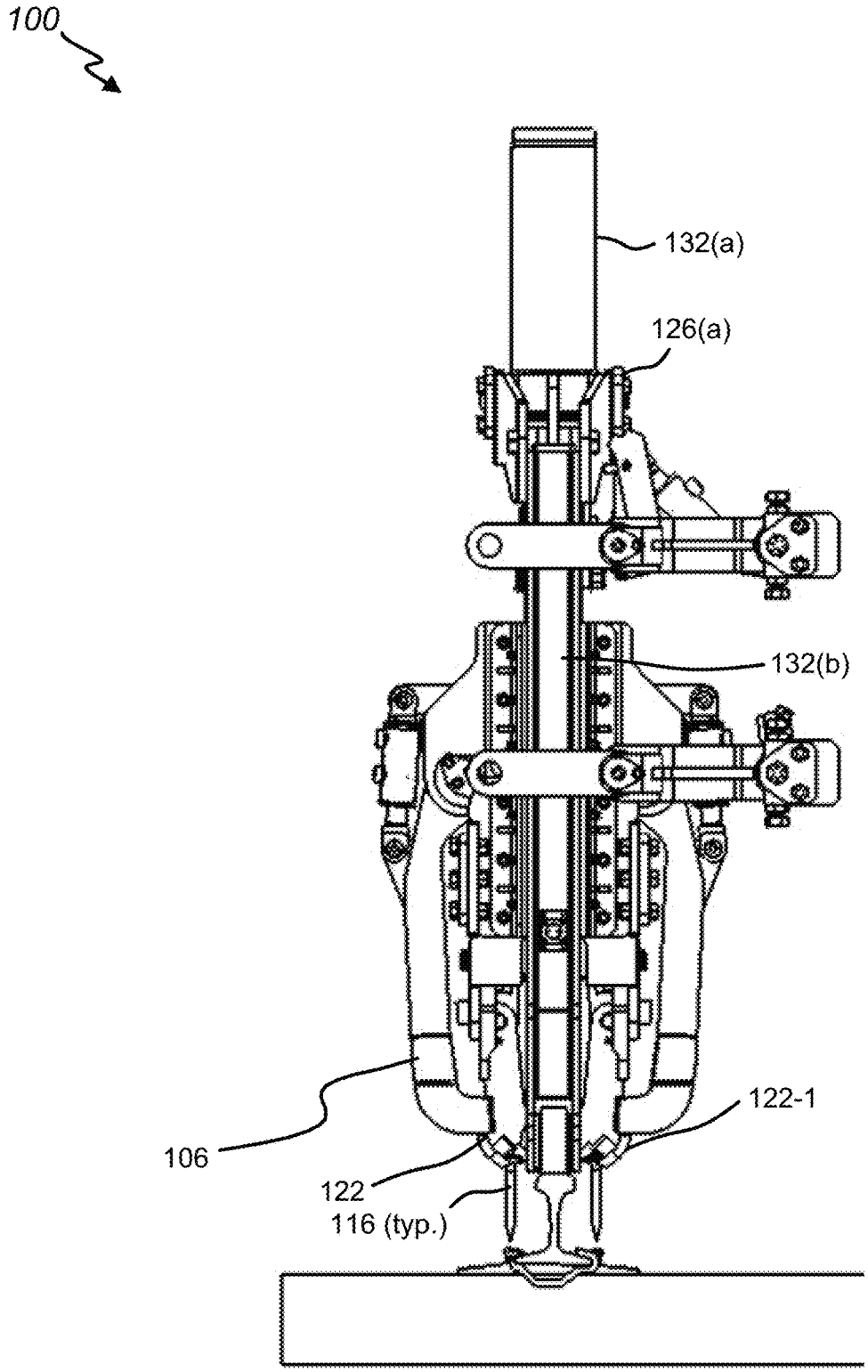
FIG. 7 depicts a partial end view of the single-plane multi-functional railway component handling system with the fastener extractor having extracted the railway fasteners from the railway tie, in accordance with disclosed embodiments of the present disclosure.

FIG. 6 depicts an end view of the single-plane multi-functional railway component handling system 100 with the fastener extractor 106 initially engaging railway fasteners 116, in accordance with disclosed embodiments of the present disclosure. The fastener-extracting operations may include steps of lowering fastener extracting heads 122 via operation of one or more of the lift cylinders 132(*a*), 132(*b*) to a level of the fastener 116, closing in toward the rail 108 to engage a head of the fastener 116 with a given fastener extracting head 122, raising the fastener 116 out of its fastener hole, releasing the fastener 116, and readjusting the fastener-extracting arm 120 to allow for a subsequent fastener extracting operation directed to another fastener 116. FIG. 7 depicts an end view of the single-plane multi-functional railway component handling system 100 with the fastener extractor 106 having extracted the railway fasteners 116 from the railway tie 110, in accordance with disclosed embodiments of the present disclosure.

In some embodiments, the fastener extraction operations may include the lift cylinder 132(*b*) maintaining the tie plate manipulator 102 in a retracted position. At the same time, the lift cylinder 132(*a*) may extend the tie plate manipulator 102 and the fastener extractor 106 together toward the rail 108 to poise the fastener extractor 106 for closing its arms 120 toward the rail 108. After one or more fasteners 116 are engaged with one or more fastener extracting heads 122, the lift cylinder 132(*a*) may retract the tie plate manipulator 102 and the fastener extractor 106 together away from the rail 108 to facilitate the extraction of the one or more fasteners 116 from the railway tie 110.

Figure 8:
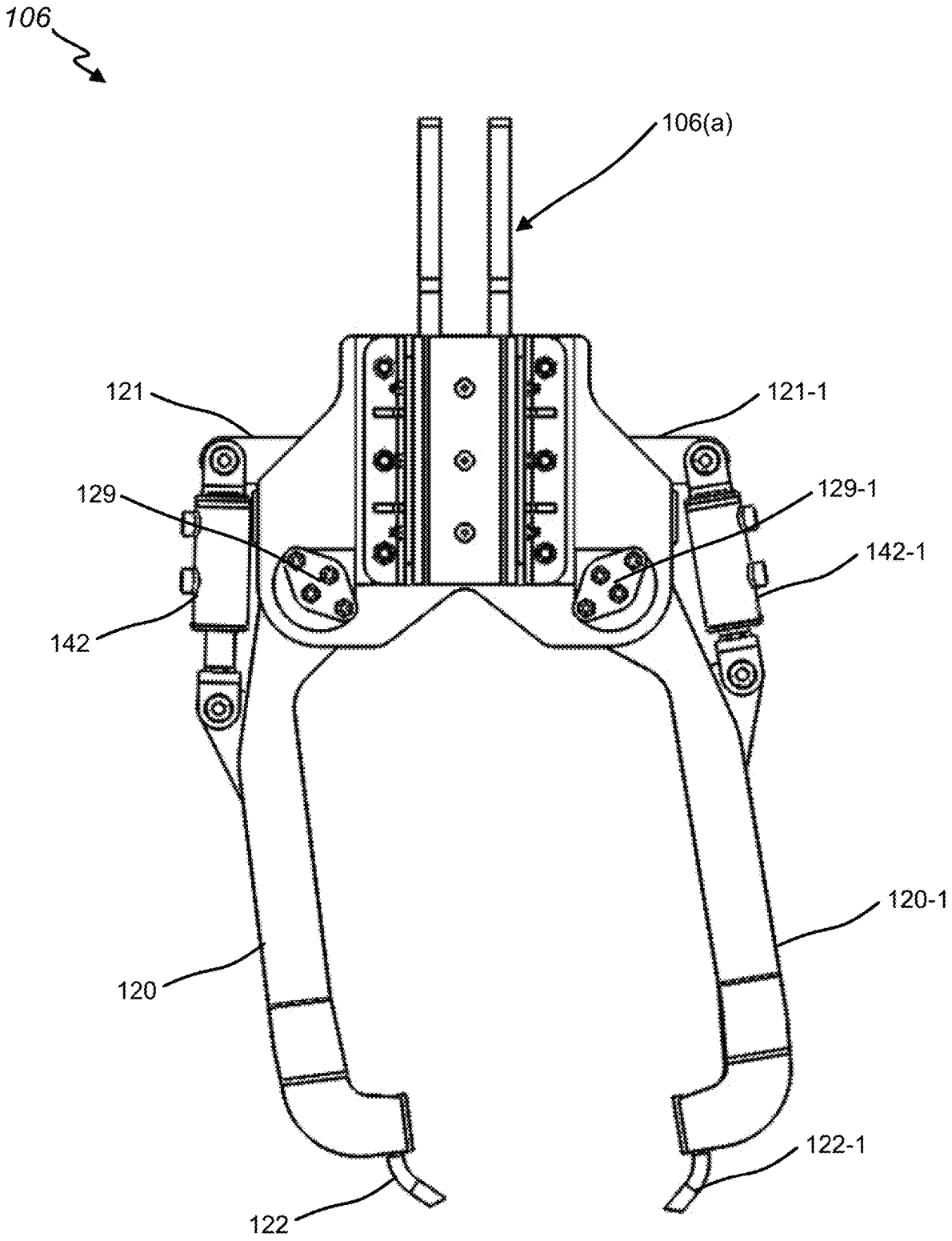
FIG. 8 depicts a partial end view of at least part of the fastener extractor separated from the single-plane multi-functional railway component handling system, in accordance with disclosed embodiments of the present disclosure.
Figure 9:
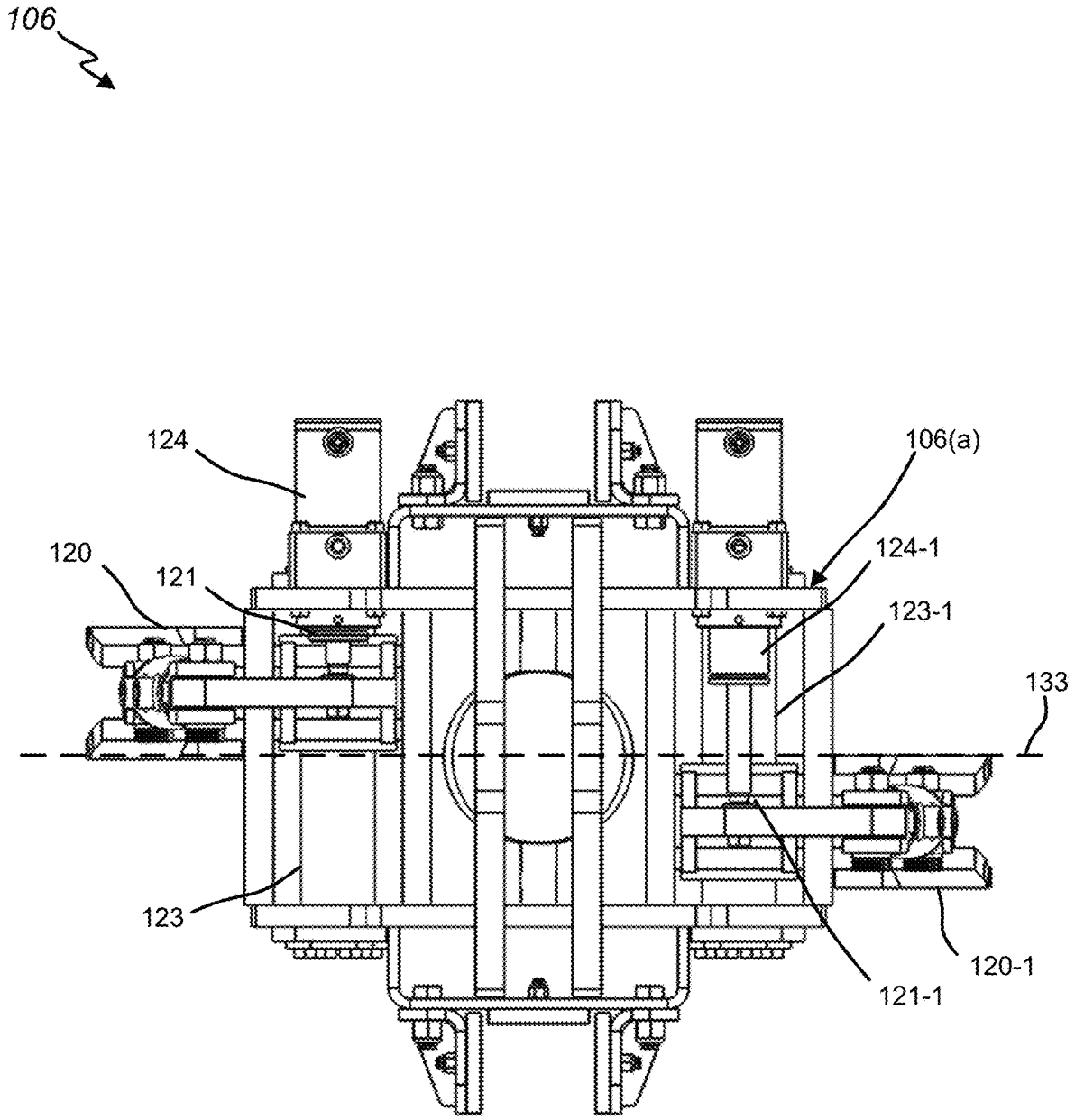
FIG. 9 depicts a partial top view of at least part of the fastener extractor separated from the single-plane multi-functional railway component handling system, in accordance with disclosed embodiments of the present disclosure.

FIG. 8 depicts an end view of at least part of the fastener extractor 106 separated from the single-plane multi-functional railway component handling system 100, in accordance with disclosed embodiments of the present disclosure. FIG. 9 depicts a top view of at least part of the fastener extractor 106 separated from the single-plane multi-functional railway component handling system 100, in accordance with disclosed embodiments of the present disclosure. As illustrated in those figures and various other figures, the fastener extractor 106 may include a pair of pivotally mounted fastener-extracting arms 120 configured in an opposing arrangement. In a deployed state, the fastener-extracting arms 120 may be disposed on opposite sides of the rail 108. Each fastener-extracting arm 120 may include a fastener extracting head 122 at a lower end, each head 122 adapted to engage railway fastener 116.

The fastener extractor 106 may include one or more arm pivot cylinders 142 arranged to move each fastener-extracting arm 120 about a respective pivot 129 into a number of different positions. Each pivot 129 may correspond to a pivot joint connected to a sliding arm bracket 121. Each arm pivot cylinder 142 (which may be a short-stroke cylinder in some embodiments) may adapted to selectively extend and retract in order to selectively push or pull the fastener-extracting arm 120 and pivot the fastener-extracting arm 120 about the corresponding pivot point 129. With that pivoting action, the fastener-extracting arm 120 may move along a plane that is perpendicular or substantially perpendicular to the rail 108.

Each fastener-extracting arm 120 may be articulated via a tri-pivot configuration. As illustrated in the depicted example, each arm pivot cylinder 142 may be pivotably coupled with one of the fastener-extracting arms 120 at one end of the arm pivot cylinder 142. Additionally, each arm pivot cylinder 142 may be pivotably coupled with one slidable arm bracket 121 of a pair of slidable arm brackets 121. For example, in some embodiments, the arm pivot cylinders 142 may be pivotably coupled with the fastener-extracting arms 120 and the slidable arm brackets 121 by way of suitable pin-and-bore couplings.

Each arm pivot cylinder 142 may be configured a separate circuit so that the arm pivot cylinder 142 may move independently of the other arm pivot cylinder 142 of the pair. Thus, each fastener-extracting arm 120 may selectively move independently from the other fastener-extracting arm 120, which may include moving at a different rate than the other fastener-extracting arm 120, as well as simultaneously as the other, which may include each moving at different rates or equivalent rates. With some embodiments, each fastener-extracting arm 120 may be independently directed by the control system 201 to perform fastener extraction according to different patterns of fastener installation in the tie plates 114, which may be different for field-side fasteners 116 and gage-side fasteners 116, from tie plate 114 to tie plate 114, and from track to track.

Further, as illustrated by FIG. 9, each fastener-extracting arm 120 may be coupled with a rod subassembly 123 and an adjuster cylinder subassembly 124. Each adjuster cylinder subassembly 124 may include an adjuster cylinder configured to operate to selectively push or pull to slide the corresponding fastener-extracting arm 120 via the slidable arm bracket 121 along a rod of the subassembly 123. In this manner, the fastener-extracting arm 120, the slidable arm bracket 121, and the arm pivot cylinder 142 may be selectively adjusted such that each arm 120 is aligned with each other or offset with respect to each other. This movement may be along planes that are parallel or substantially parallel to the rail 108. In various embodiments, the slidable arm brackets 121 and/or other slidable couplings disclosed herein may include bearings to facilitate movement along respective rods/shafts, in which instances, the movement may correspond to rolling movement rather than sliding movement.

Accordingly, such sliding actions of the fastener-extracting arms 120 in conjunction with the pivoting actions of the fastener-extracting arms 120 may allow for the fastener-extracting arms 120 to perform efficient and substantially simultaneous fastener extraction with respect to multiple fasteners 116 installed in a variety of hole in tie plates 114, which extraction operation, as disclosed herein, may be performed under control of the control system 201. Compound, multi-axial movement of the fastener-extracting arms 120 may be effected with simultaneous actuation of adjuster cylinder subassembly 124, as well as of the arm pivot cylinders 142. Actuation of the adjuster cylinder subassembly 124 and the arm pivot cylinders 142 may move each fastener-extracting arm 120 into a number of different positions to perform fastener extraction under control of the control system 201 in various positions, which may range, for example, from up against the foot of the rail 108 to several inches away from the rail 108. Such compound, multi-axial movement to adjust to various positions during fastener extraction operations may advantageously increase the speed and efficiency of the process.

Such selective operations may advantageously adapt to a variety of different fastener patterns that may be encountered in the field. Such selective operations, as with all adjustments/operations of the component handling system 100, may be autonomously performed by the system 100, or initiated remotely by an operator in an operator's cab. With the autonomous mode, the system 100 may automatically detect a given fastener pattern with one or more sensors and operate the arms 120 to match the fastener patterns and perform fastener extraction. The control system 201 may independently direct each fastener-extracting arm 120 to adjust and perform fastener extraction according to the most efficient pattern for the particular fastener layout detected.

Various embodiments may include a plurality of sensors (e.g., one or a combination of position sensors, measurement sensors, distance sensors, proximity sensors, cameras for optical recognition, image analysis, metrics, and recognition, motion sensors, light sensors, ambient light photo sensors, photodiode photo sensors, optical detectors, photo detectors, color sensors, and/or the like) in order to facilitate operations, such as automatic alignment of the fastener-extracting arms 120 and the tie plate manipulator 102 with railway components (e.g., fasteners, anchors, tie plates, and/or railway ties), automatic fastener extraction, automatic tie plate and anchor adjustment, and other adjustment operations disclosed herein, any one or combination of which operations may be performed under control of the control system 201. One or more of the sensors may be attached to any suitable element of the component handling system 100 and disposed to capture data indicative of the positioning and/or other characteristics of aspects of the fastener-extracting arms 120, the tie plate manipulator 102, the fasteners 116 and fastener patterns, the tie plates 114, holes in the tie plates 114, the anchors 114(*a*), 114(*b*), the ties 110, and/or the rail 108. By way of example, one or more sensors (e.g., a linear variable differential transformer (LVDT) sensor) may be coupled to the cylinders of the adjuster cylinder subassembly 124 and arm pivot cylinders 142 to detect positioning of the respective cylinders. Likewise, one or more sensors (e.g., LVDT sensors) may be coupled to each of the other cylinders of the component handling system 100, such as cylinders 132(*a*), 132(*b*), to detect positioning of the respective cylinders. Disclosed embodiments may learn and infer positions of fasteners 116 in tie plates 114 based at least in part on the detected positions of the cylinders, with sensors having sensor sensitivity within a few thousandths of an inch. Additional disclosed embodiments may utilize such position sensors in conjunction with other types of sensors, such as one or a combination of the sensor types above, to learn and detect positions of fasteners 116, as well as other aspects described further herein.

In alternative embodiments not depicted, one or more of the cylinders of the system 100 may correspond to trunnion-mounted cylinders. One or more of the sensors may be coupled to base ends of the trunnion-mounted cylinders to facilitate serviceability. This may allow for ease of maintenance, such that one or more of the sensors may be replaced without having to replace entire cylinders.

One or more sensors may be disposed on the workhead to have various fields of view to detect various features such as positions, surfaces, edges, contours, relative distances, and/or any other suitable indicia of the elements of the system 100 (e.g., the fastener-extracting arms 120 and the tie plate manipulator 102) and/or railway components (e.g., fasteners, anchors, tie plates, and/or railway ties). For example, the one or more sensors may include one or more cameras attached to the frame assembly 126 to have fields of view and capture images and/or other indicia of various aspects of the railway ties 110, the tie plates 114, the holes of the tie plates 114, and/or the rail 108. The one or more sensors may be attached to the forward leg 128, the rear leg 130, and/or a component of the upper structure of another part of the workhead.

Each of the sensors of disclosed embodiments may be communicatively coupled to a receiver of the control system 201 via wired or wireless communication channels. The sensors, receiver, and/or control system 201 may include any suitable sensors, controller(s), processor(s), memory, communication interface(s), and other components to facilitate various embodiments disclosed herein. The sensors, receiver, and/or control system 201 may include any sensor circuitry necessary to facilitate the various embodiments, including without limitation any one or combination of analog-to-digital converter circuitry, multiplexer circuitry, amplification circuitry, signal conditioning/translation circuitry, and/or the like. The data captured by the one or more sensors may be used by the control system 201 to detect positioning and facilitate system-directed positioning, extraction, and adjustment operations of the fastener extractor 106 and the tie plate manipulator 102.

Further, some embodiments may provide for automatic balancing or rebalancing of load with respect to the fastener-extracting arms 120. In such embodiments, the system 100 may detect, with one or more sensors such position, torque, load sensors, or other sensors disclosed herein, an off-balance loading situation caused by positions of the fastener-extracting arms 120. For example, an off-balance loading situation may occur when both fastener-extracting arms 120 are positioned too much toward the same side. If such an off-balance load is detected, the system 201 may override previous positioning directions and rebalance the fastener-extracting arms 120 by repositioning one or both arms 120 until a satisfactory balance threshold is satisfied. In some embodiments, off-balance loads may be preemptively avoided by the system 100. For example, when one arm 120 is positioned beyond a certain distance (absolute distance from a reference point of the fastener extractor 106 or a relative distance with respect to the other arm 120), the system 100 may automatically move one or both arms to avoid an off-balance load.

Such independent operation may be advantageous in a number of ways. For example, some railway fasteners 116 may not be symmetrically installed on each side of a rail 108 such that symmetrical operation of the arms is not necessary. Moreover, the asymmetrical operation of the fastener-extracting arms 120 may adapt to asymmetrical installations of railway fasteners 116, while efficiently avoiding unnecessary operations and adjustments. Further, in some instances, the obstructions such as railway components, electrical boxes, or other obstructions may create tight working spaces. Advantageously, the fastener-extracting arms 120 may asymmetrically adapt to avoid such obstructions and/or maneuver within such tight spaces.

In some embodiments, the fastener extractor 106 may operate in a mode where the fastener-extracting arms 120 always move simultaneously in a manner that maintains a balanced state. With that mode of operation, when one arm 120 moves one direction at a particular rate, the other arm 120 may move in the same or opposite direction at the same rate. The simultaneously movement of the arms 120 may maintain positional symmetry with respect to a distance between centerlines of the arms 120 and a centerline 133 of the fastener extractor 106. Stated otherwise, the centerlines of the arms 120 may be maintained at the same distance from the centerline 133 of the fastener extractor 106, even though the arms 120 may be on opposite sides of the centerline 133. To facilitate such an operational mode, some embodiments may employ a shared fluid configuration, where the two adjuster cylinder subassemblies 124 share the same volume of hydraulic fluid. Advantageously, when the system 100 is positioned over a particular railway tie plate 114, the fastener extractor 106 and the tie plate manipulator 102 may be adapted to share the same centerline 133 so that each are efficiently aligned with the tie plate 114, thereby eliminating or at least minimizing any need for modifying alignment between operations of the fastener extractor 106 and the tie plate manipulator 102. Thus, when the fastener extractor 106 has completed extraction operations over the particular tie plate 114, the tie plate manipulator 102 may be already aligned with the tie plate 114 so that the tie plate manipulator 102 may be lowered straight down to engage the tie plate 114 without any additional adjustment to the alignment. Such a mode of operation may be selectable in disclosed embodiments.

Figure 10:
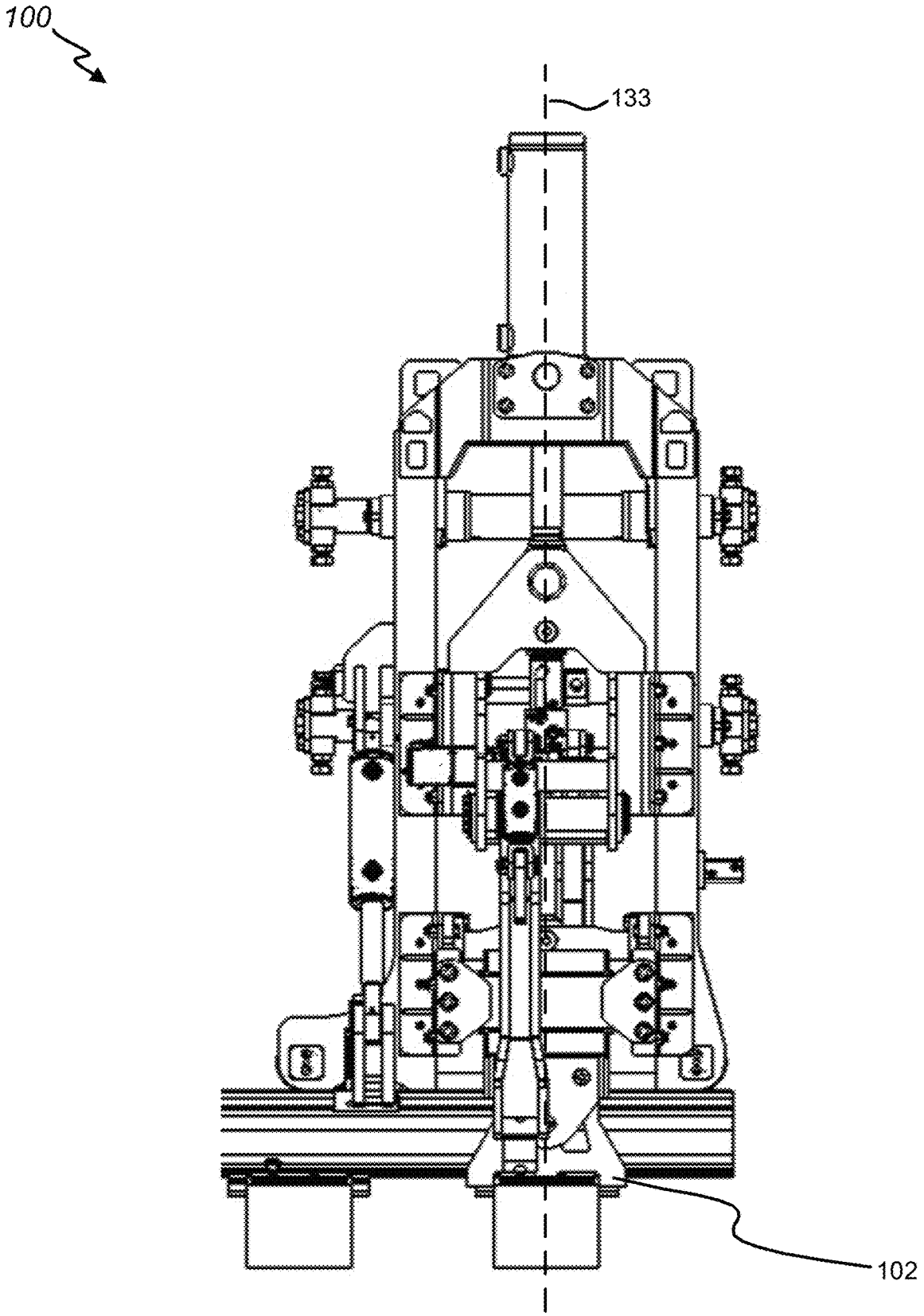
FIG. 10 depicts a partial side view of the single-plane multi-functional railway component handling system with the tie plate manipulation subsystem in a deployed position, in accordance with disclosed embodiments of the present disclosure.

FIG. 10 depicts a partial side view of the single-plane multi-functional railway component handling system 100 with the tie plate manipulation subsystem 102 in a deployed position, in accordance with disclosed embodiments of the present disclosure. To further illustrate that advantageous auto-alignment, the centerline 133 is depicted in FIG. 10. Accordingly, in some embodiments, the centerline 133 may be shared by the fastener extractor 106 and the tie plate manipulator 102.

Figure 11:
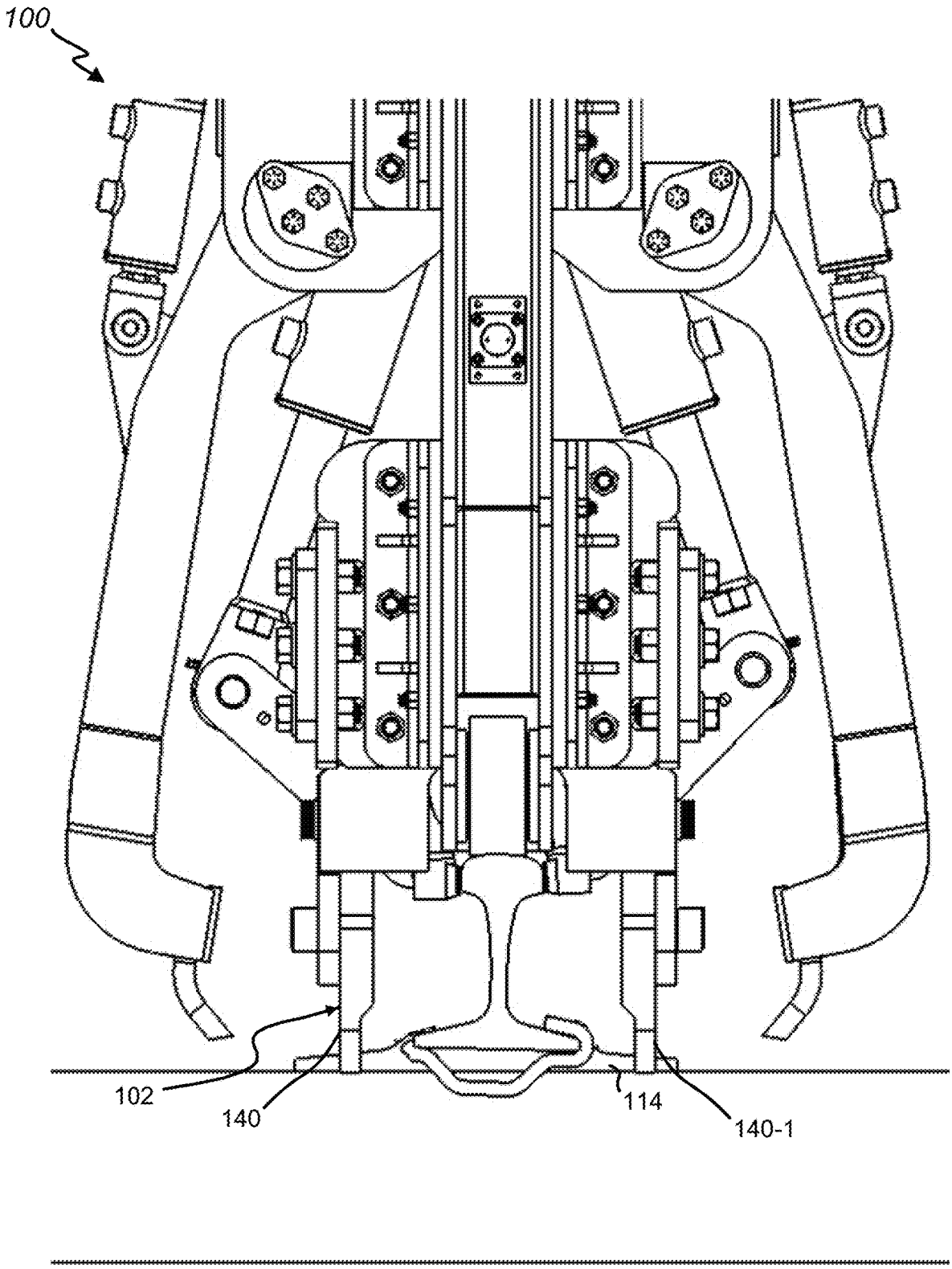
FIG. 11 depicts a partial end view of the single-plane multi-functional railway component handling system with the tie plate manipulator in a deployed position, in accordance with disclosed embodiments of the present disclosure.

FIG. 11 depicts a partial end view of the single-plane multi-functional railway component handling system 100 with the tie plate manipulator 102 in a deployed position, in accordance with disclosed embodiments of the present disclosure. In the deployed position, the tie plate manipulator 102 may be engaging, or may be positioned to engage, the tie plate 114. As illustrated, one or more tie plate tools 140 of the tie plate manipulator 102 may be formed to straddle the tie plate 114.

The tie plate tools 140 may be designed to directly contact/engage surfaces of the railway anchors 114(*a*), 114(*b*) and the tie plate 112 in order to transmit force to and move the railway anchors 114(*a*), 114(*b*) and/or the tie plate 112 along the underside of the rail 108 away from a vertical face of the railway tie 110. A set of the tie plate tools 140 may correspond to a pair of the tie plate tools 140 connected to act as one: one tie plate tool 140 of the pair may be positioned on the gage side of the rail 108 and the other tie plate tool 140 of the pair may be positioned on the field side of the rail 108. The tie plate manipulator 102 may perform a sequence of operations to move the tie plate 114 and thereby move the railway anchors 114(*a*), 114(*b*) attached to the rail 108.

Such embodiments may solve the problem of how to move the railway anchors 114(*a*), 114(*b*) when there is little or no gap between the railway anchors 114(*a*), 114(*b*) and the railway tie 110. With the tie plate manipulator 102, precise placement of tool portions need not be placed in that small or absent gap in order to make adjustments. One advantage of disclosed embodiments according to the present disclosure is that the embodiments facilitate railway component adjustments regardless of the size of the gap.

More specifically, movement of the rail anchors in this method may be accomplished using the tie plate 112 by pushing the tie plate 112 till the tie plate 112 makes contact with one of the railway anchors 114(*a*), 114(*b*), then pushing the tie plate 112 a small distance further in order to displace the railway anchors 114(*a*), 114(*b*) away from the tie faces a prescribed distance (e.g., approximately up to one to two inches, or more). Forward and rear railway anchors 114(*a*), 114(*b*) may be moved in succession using the tie plate 112, in that order and/or in reverse order in various embodiments. One example sequence of operations is illustrated with FIGS. 12-14.

Figure 12:
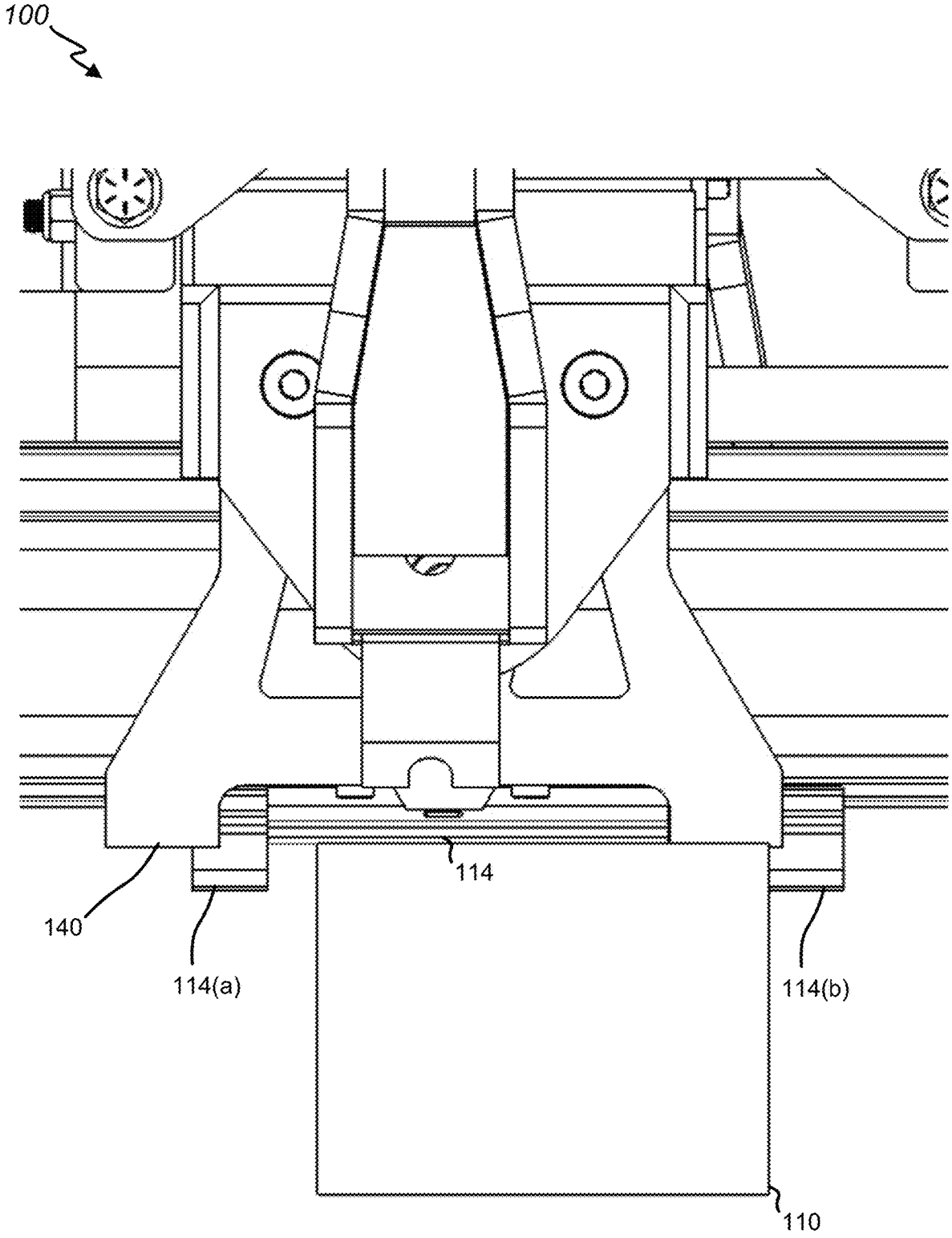
FIG. 12 depicts a partial side view of the tie plate manipulator in a stage of a tie plate manipulation operation, in accordance with disclosed embodiments of the present disclosure.

With such a method, the tie plate 112 may be initially present in its original position between the railway anchors 114(*a*), 114(*b*) because the railway tie 110 has not been disturbed. The example of FIG. 10 depicts the tie plate tool 140 in one example addressing position to engage the tie plate 112 when the tie plate 112 is initially present in its original position. From that addressing position with the tie plate tool 140 engaging the tie plate 112, the tie plate manipulator 102 may push the tie plate 112 and the railway anchor 114(*a*) rearward. This is illustrated with FIG. 12. FIG. 12 depicts a partial side view of the tie plate manipulator 102 in a stage of a tie plate manipulation operation, in accordance with disclosed embodiments of the present disclosure. Prior to the tie plate manipulator 102 pushing the tie plate 112, the rail clamp of the rail clamp assembly 125 may engage and clamp the rail 108 to stabilize the system 100 and facilitate generation of the necessary forces.

Figure 13:
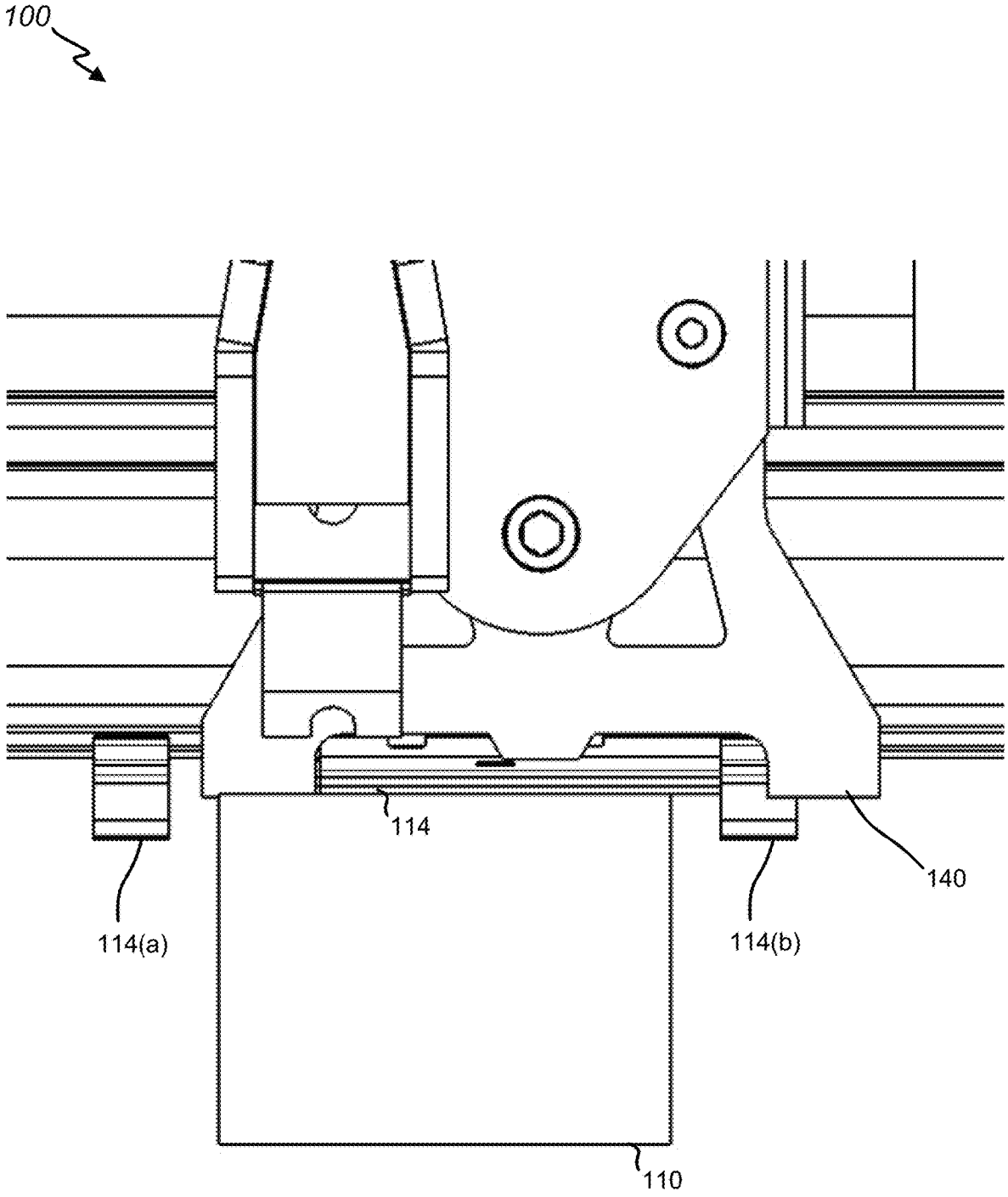
FIG. 13 depicts a partial side view of the tie plate manipulator in another stage of a tie plate manipulation operation, in accordance with disclosed embodiments of the present disclosure.
Figure 14:
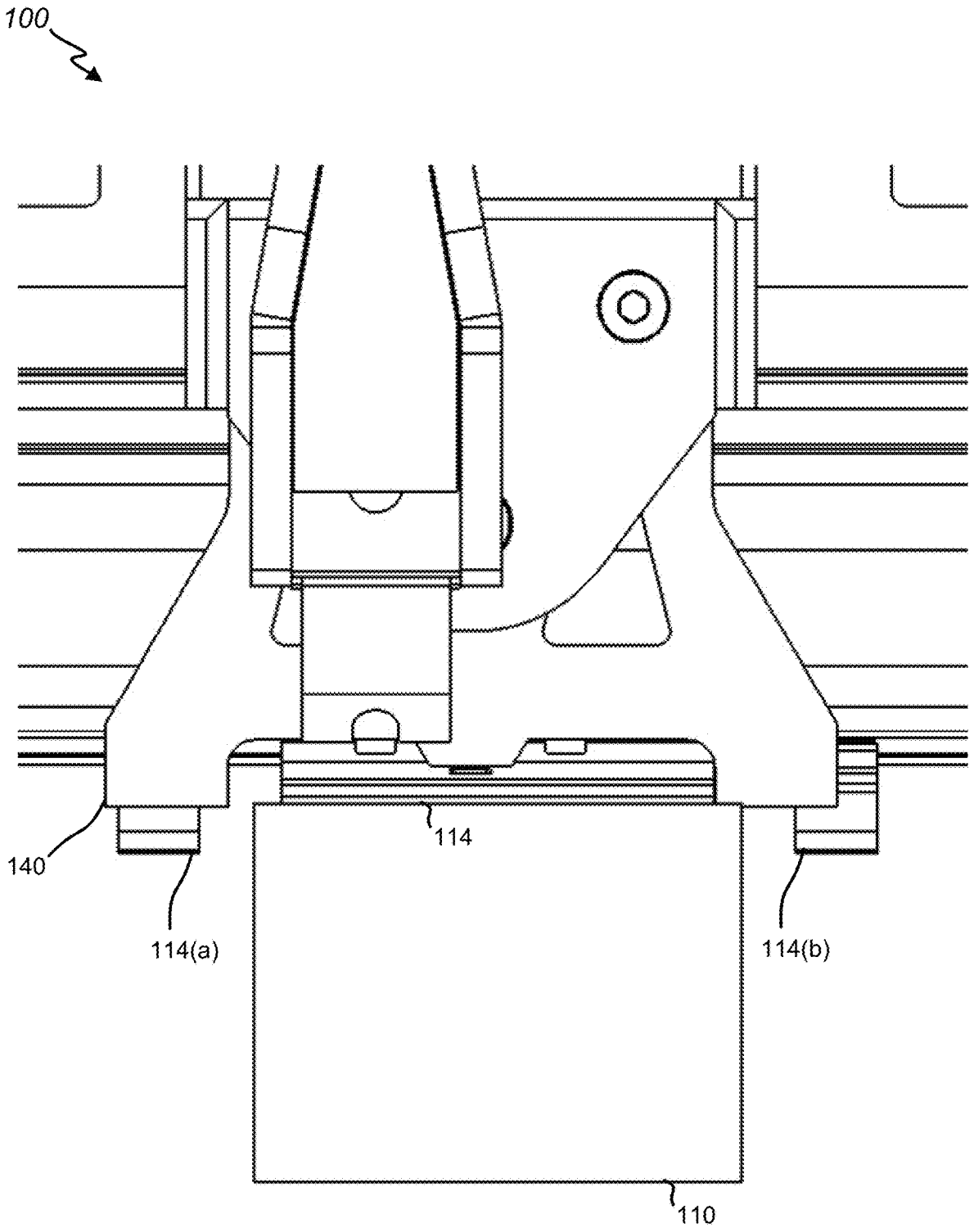
FIG. 14 depicts a partial side view of the tie plate manipulator in yet another stage of a tie plate manipulation operation, in accordance with disclosed embodiments of the present disclosure.

FIG. 13 depicts a partial side view of the tie plate manipulator 102 in another stage of a tie plate manipulation operation, in accordance with disclosed embodiments of the present disclosure. With that stage, the tie plate manipulator 102 may push the tie plate 112 and the railway anchor 114(*b*) forward. FIG. 14 depicts a partial side view of the tie plate manipulator 102 in yet another stage of a tie plate manipulation operation, in accordance with disclosed embodiments of the present disclosure. With that stage, the tie plate manipulator 102 may push the tie plate 112 back to a position where it is centered on the tie 110. That position may correspond to the original position of the tie plate 112.

In some embodiments, each tie plate tool 140 of the pair of tie plate tools 140 engages the tie plate 112 and/or pushes the tie plate 112 simultaneously or substantially simultaneously. The square face of the tie plate 112 may accordingly contact and substantially evenly apply force to the railway anchors 114(*a*), (*b*) without skewing the railway anchors 114(*a*), (*b*) (which skewing may cause the anchor to fly off the rail due to the high tension the anchor is under when in the installed position). Thus, the railway anchors 114(*a*), (*b*) slide along an underside of the rail 108 away from the railway tie 110.

Accordingly, such a tie-present railway anchor adjustment may correspond to a method of adjusting rail anchors (e.g., sliding anchors away from tie faces or completely removing anchors from rails) prior to removal of the railway tie 110. Alternatively or additionally, tie-present railway anchor adjustment may correspond to a method of adjusting rail anchors by sliding anchors toward tie faces (e.g., along with installation of a new and/or replacement railway tie 110, or when seating of the anchors 114 against the tie 110 is otherwise needed).

In some embodiments, the tie plate manipulator 102 may allow for tie-removed railway anchor adjustment. Tie-removed railway anchor adjustment may correspond to a method of adjusting railway anchors (e.g., sliding anchors away from each other or completely removing anchors from rails) after removal of the railway tie 110. In this method, the tie plate 112 is not present in its original position between the anchors because it has been displaced by removal of, for example, an old railway tie 110. Movement of the rail anchors in this method may be accomplished by directly engaging and moving one or both of the railway anchors 114(*a*), 114(*b*) with the tie plate tools 140 and increasing the distance between the railway anchors 114(*a*), 114(*b*) by a prescribed distance (e.g., approximately up to one to two inches, or more). Prior to the tie plate manipulator 102 moving one or more of the railway anchors 114(*a*), 114(*b*), the rail clamp of the rail clamp assembly 125 may engage and clamp the rail 108 to stabilize the system 100 and facilitate generation of the necessary forces.

Additionally, according to some embodiments, the tie plate manipulator 102 may be adapted to provide an additional function of completely removing railway anchors 114. Such removal may be desirable for individual railway anchors that may be deteriorated or otherwise need replacing. One or more of the tie plate tools 140 may be formed for engaging a field side of a railway anchor 114 with downward movement on that field side of railway anchor 114. In some instances, the tie plate manipulator 102 may be configured to move the railway anchor 114 longitudinally away from a railway tie 110 prior to the anchor removal operation.

As illustrated by way of example in FIG. 11, each of the tie plate tools 140 may be formed with adaptable widths to accommodate various sizes of rails 108. For example, in the example, the tie plate tools 140 are depicted as having a step formation such that the bottom portions of the tools 140 have smaller widths than the portions above. In some embodiments, the tools 140 may taper from 1.25-inch widths down to 0.75-inch widths at the bottom portions. In the configuration depicted, the tie plate tools 140 may accommodate wider rails 108—e.g., 6-inch base rails. To accommodate smaller rail bases—e.g., 5.5 inches—the tie plate tools 140 may be rotated 180 degrees so that the bottom portions of the tools 140 are closer together. In some embodiments, the tie plate manipulator 102 may be configured to rotate the tie plate tools 140 about respective pivot points automatically upon initiation from the operator's cab.

Figure 15:
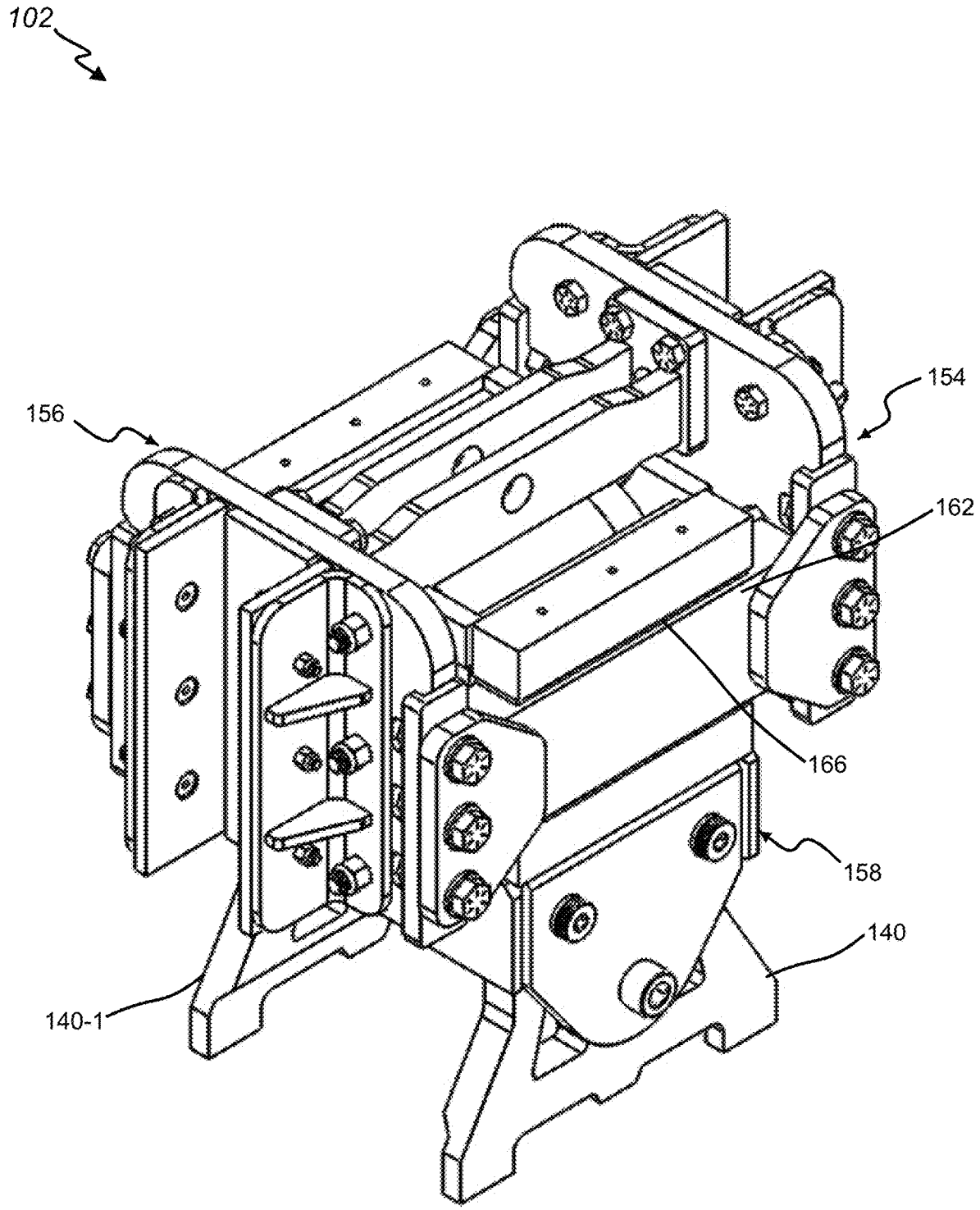
FIG. 15 depicts a partial perspective view of at least part of the tie plate manipulator separated from the single-plane multi-functional railway component handling system, in accordance with disclosed embodiments of the present disclosure.
Figure 16:
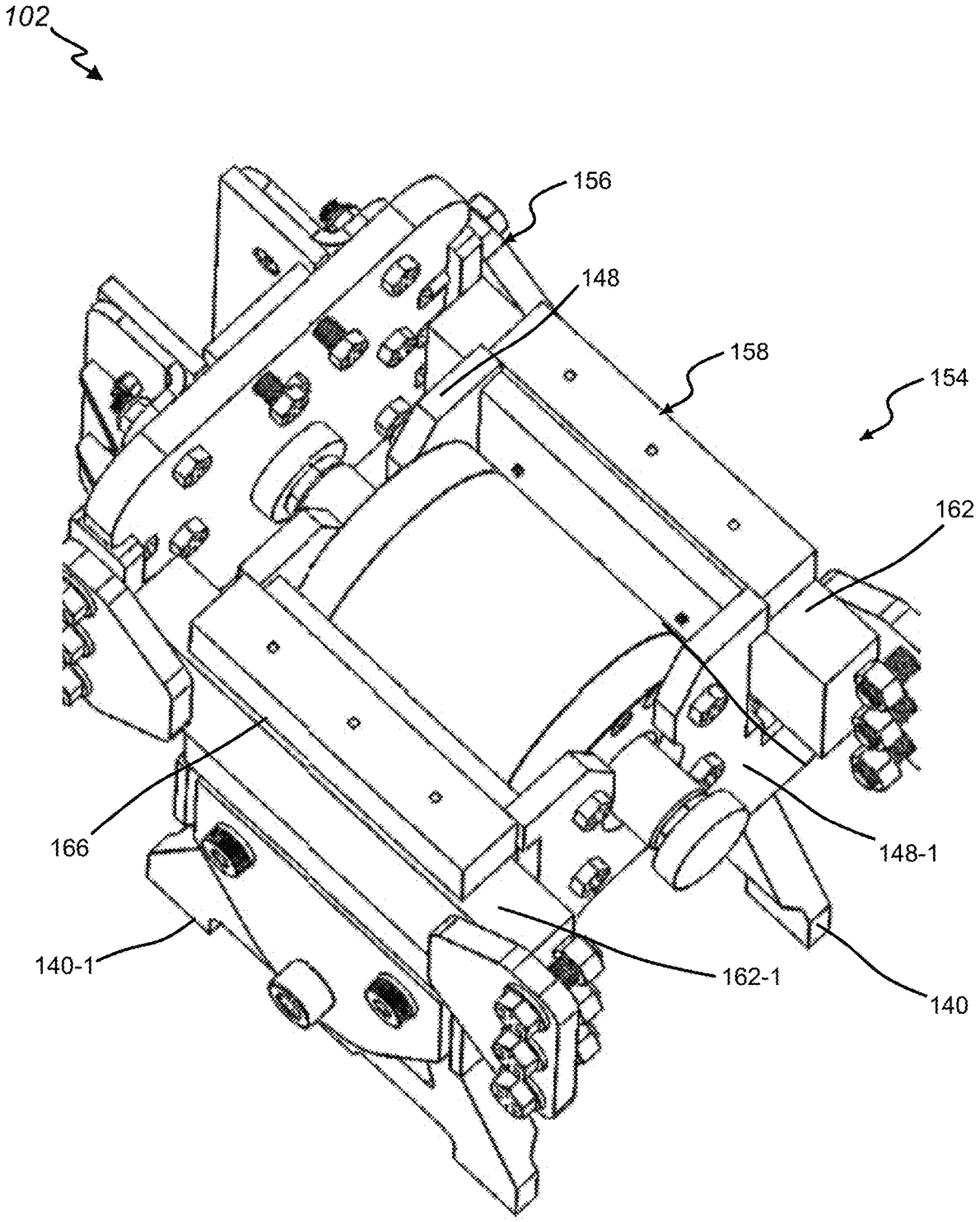
FIG. 16 depicts another partial perspective view of at least part of the tie plate manipulator separated from the single-plane multi-functional railway component handling system, in accordance with disclosed embodiments of the present disclosure.
Figure 17:
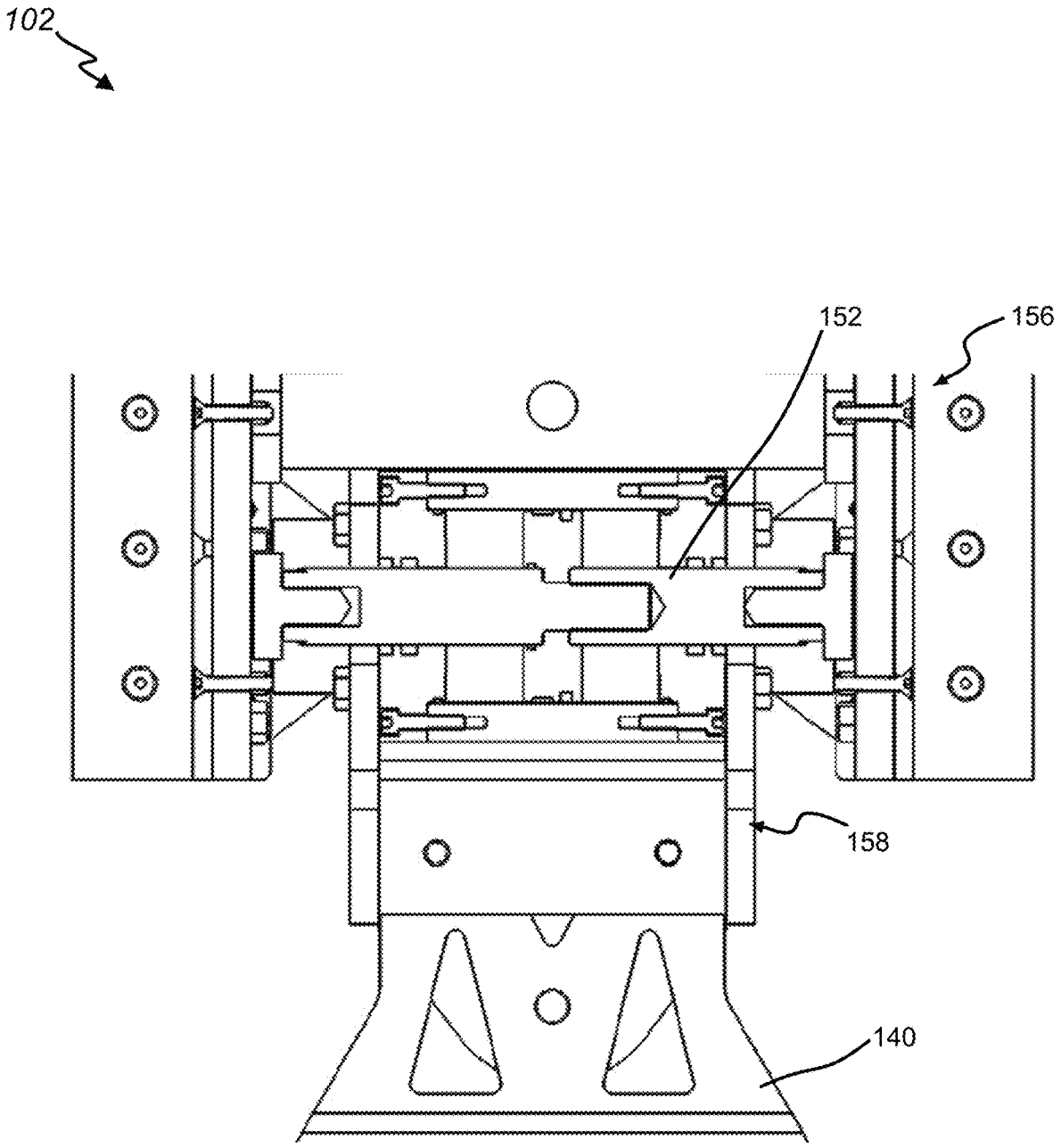
FIG. 17 depicts a partial side view of a partial cross-section of at least part of the tie plate manipulator, in accordance with disclosed embodiments of the present disclosure.

FIG. 15 depicts a partial perspective view of the tie plate manipulator 102 separated from the single-plane multi-functional railway component handling system 100, in accordance with disclosed embodiments of the present disclosure. FIG. 16 depicts another partial perspective view of the tie plate manipulator 102 separated from the single-plane multi-functional railway component handling system 100, in accordance with disclosed embodiments of the present disclosure. FIG. 17 depicts a side of a partial cross-section of at least part of the tie plate manipulator 102, in accordance with disclosed embodiments of the present disclosure.

The tie plate manipulator 102 may include a slide assembly 154 that includes a support framework 156 arranged to provide guidance and support to a slide subassembly 158 while allowing travel of the slide subassembly 158 with respect to the support framework 156. The support framework 156 may include one or more beams 162. The depicted embodiment includes a pair of opposing beams 162. The beams 162 may trap the slide subassembly 158 while allowing travel of the slide subassembly 158 along the beams 162. The slide subassembly 158 may include slide pads 166 to contact the beams 162 and allow for sliding movement with respect to the beams 162. In some embodiments, the slide assembly 154 may be supported so that the slide pads 166 make light contact with the beams 162 under no-load conditions. The slide pads 166 may be formed to provide significant wear areas due to an elongated form in order to have extensive usable life spans. Further, the beams 162 may be connected to an exterior of the framework with fastener to allow ease of assembly, access, and serviceability, e.g., in order to eventually replace the slide pads 166. In some embodiments, the slide subassembly 158 may include one or more slidable brackets 148 that directly or indirectly couple the slide pads 166. The embodiment depicted includes two slidable brackets 148 in opposing arrangement.

The tie plate manipulator 102 may include one or more double-rod cylinders 152 connected to the slide subassembly 158. In the embodiment depicted, a single double-rod cylinder 152 is connected to the slide subassembly 158. The double-rod cylinder 152 may be adapted to extend and retract in order to selectively push or pull the slide subassembly 158 along the beams 162. In some embodiments, the double-rod cylinder 152 may be connected to the slide subassembly 158 by way of the slidable brackets 148.

The slide subassembly 158 may include one or more tie plate tools 140 that extend from the slide subassembly 158. The embodiment depicted includes a pair of tie plate tools 140 configured in opposing and parallel arrangement. The tie plate tools 140 may be specially adapted to engage railway tie plates 114 in a number of different ways in order to facilitate a number of different railway component adjustments in accordance with various embodiments disclosed herein. In some embodiments, as depicted, the slide subassembly 158 may fixedly couple the tie plate tools 140 together such that both tools 140 move together. Other embodiments (not shown) may adapt the slide subassembly 158 so that the tie plate tools 140 may move independently, each being moved by an independent double-rod cylinders 152.

Figure 18A:
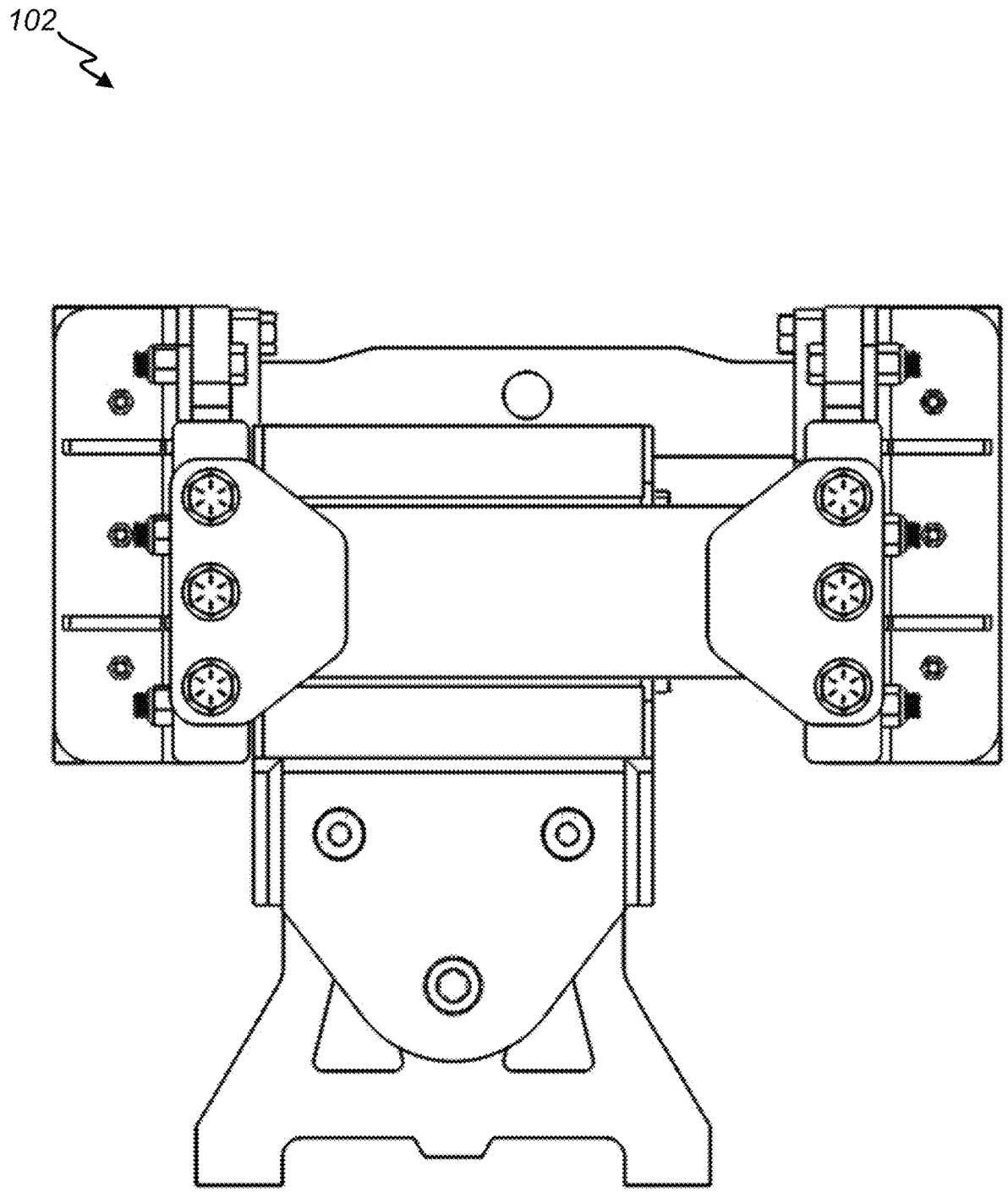
FIG. 18A depicts a partial side view of at least the part of the tie plate manipulator in one operational state, in accordance with disclosed embodiments of the present disclosure.
Figure 18B:
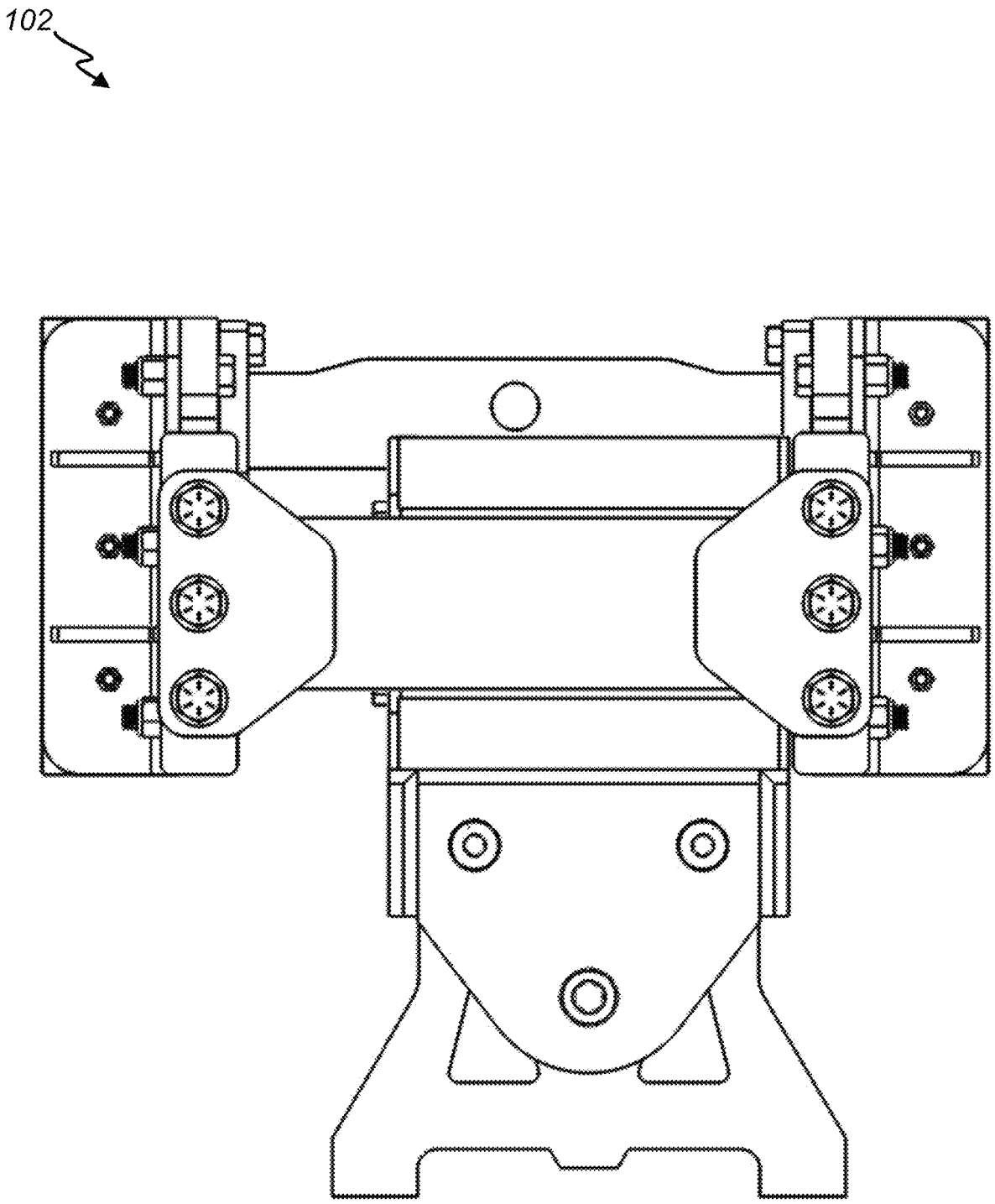
FIG. 18B depicts a partial side view of at least the part of the tie plate manipulator in another operational state, in accordance with disclosed embodiments of the present disclosure.
Figure 18C:
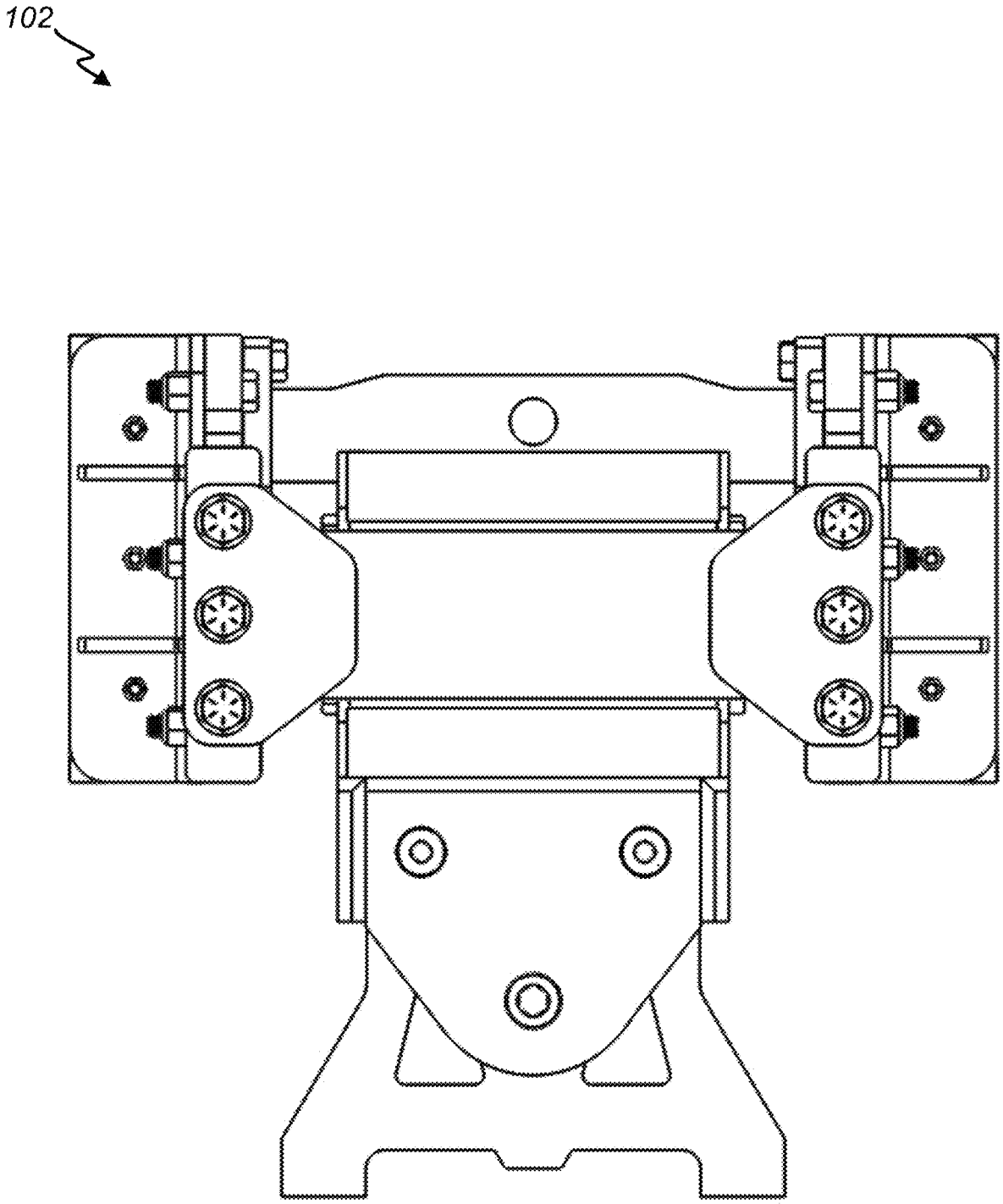
FIG. 18C depicts a partial side view of at least the part of the tie plate manipulator in yet another operational state, in accordance with disclosed embodiments of the present disclosure.

FIG. 18A depicts a side view of at least the part of the tie plate manipulator 102 in one operational state, in accordance with disclosed embodiments of the present disclosure. For example, this operational state may correspond to the instance depicted in FIG. 12. FIG. 18B depicts a side view of at least the part of the tie plate manipulator 102 in another operational state, in accordance with disclosed embodiments of the present disclosure. For example, this operational state may correspond to the instance depicted in FIG. 13. FIG. 18C depicts a side view of at least the part of the tie plate manipulator 102 in yet another operational state, in accordance with disclosed embodiments of the present disclosure. For example, this operational state may correspond to the instance depicted in FIG. 14.

Figure 19:
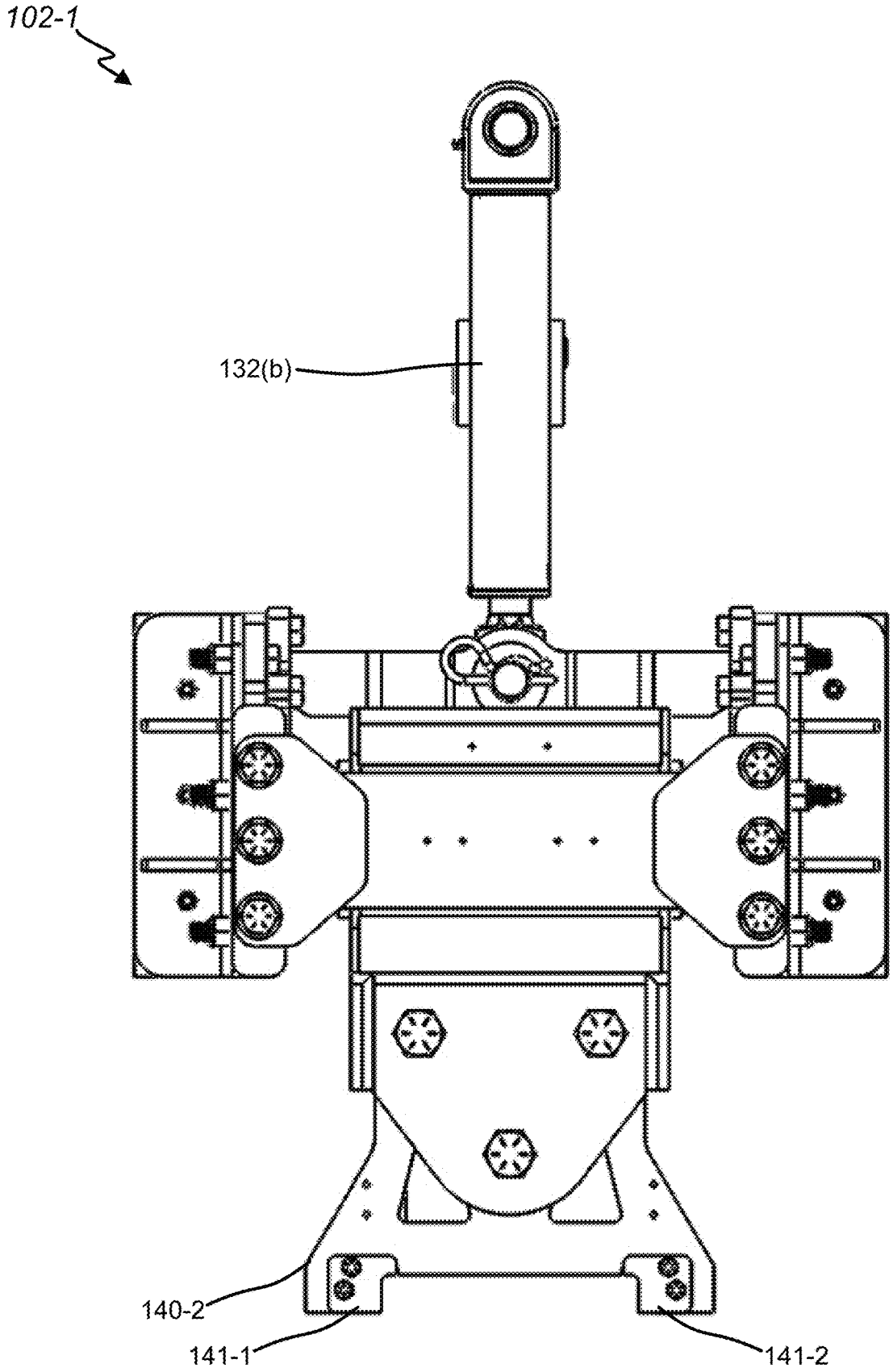
FIG. 19 depicts a partial side view of the tie plate manipulator with tie plate tool including tool inserts, in accordance with certain embodiments of the present disclosure.
Figure 20:
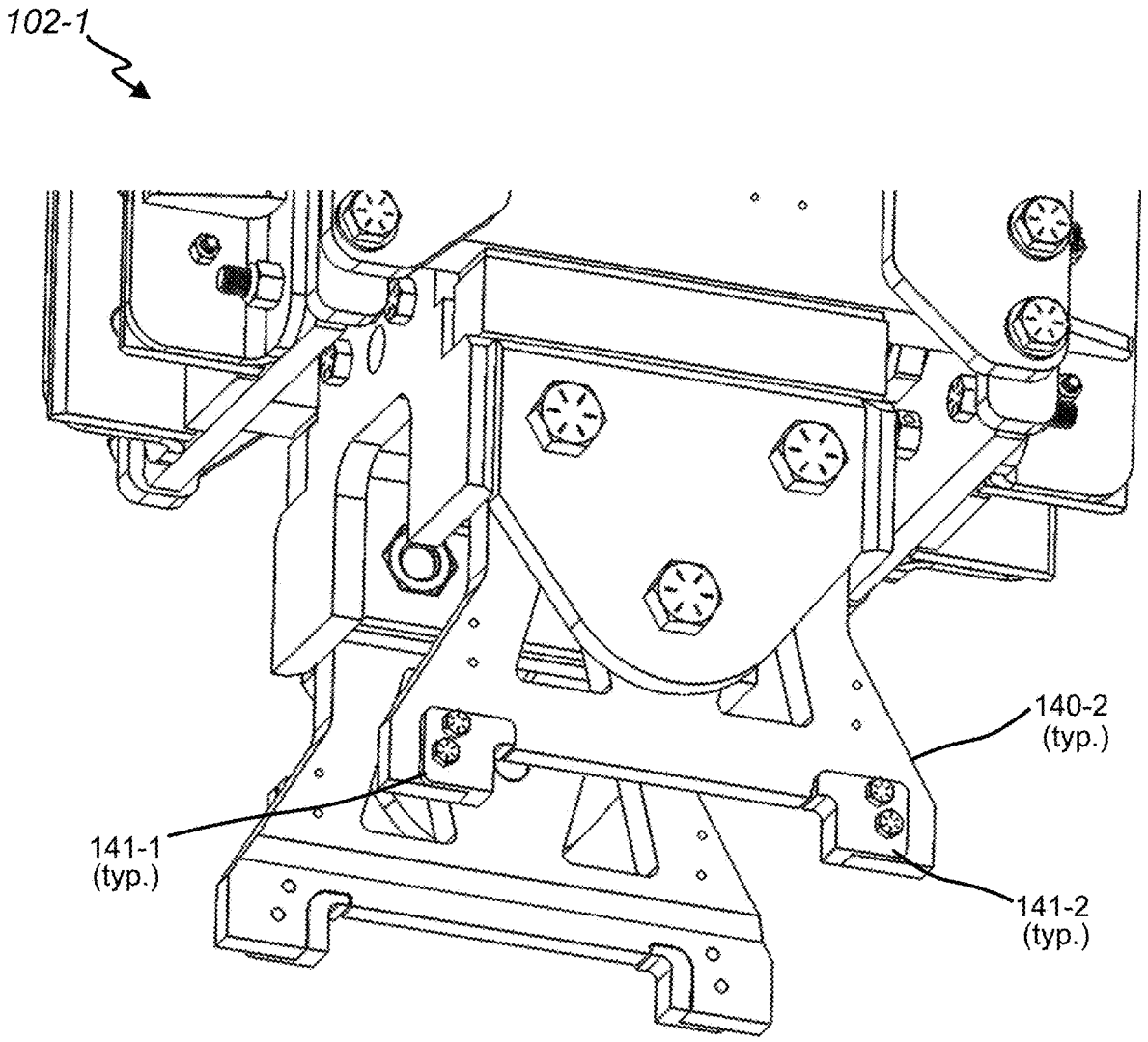
FIG. 20 depicts a partial perspective view of the tie plate manipulator with tie plate tools including the tool inserts, in accordance with certain embodiments of the present disclosure.

FIG. 19 depicts a partial side view of the tie plate manipulator 102 with tie plate tool 140-2 including tool inserts 141, in accordance with certain embodiments of the present disclosure. FIG. 20 depicts a partial perspective view of the tie plate manipulator 102 with tie plate tools 140-2 including the tool inserts 141, in accordance with certain embodiments of the present disclosure. The tool inserts 141 may be formed for attachment with fasteners to lower, interior portions of the tie plate tools 140-2 at positions to make contact with tie plates 114 during adjustment operations disclosed herein. Thus, the tool inserts 141 may be formed to provide wear areas at points of high, direct contact with tie plates 114 in order to allow in order to allow for ease of serviceability when the tool inserts 141 eventually need to be replaced when physical wear of the tool inserts 141 reaches a certain limit. In this manner, the tool inserts 141 may allow for the minimization of actual physical wear on the tie plate tools 140-2 so that the usable life span of the tie plate tools 140-2 may be extended.

Figure 21A:
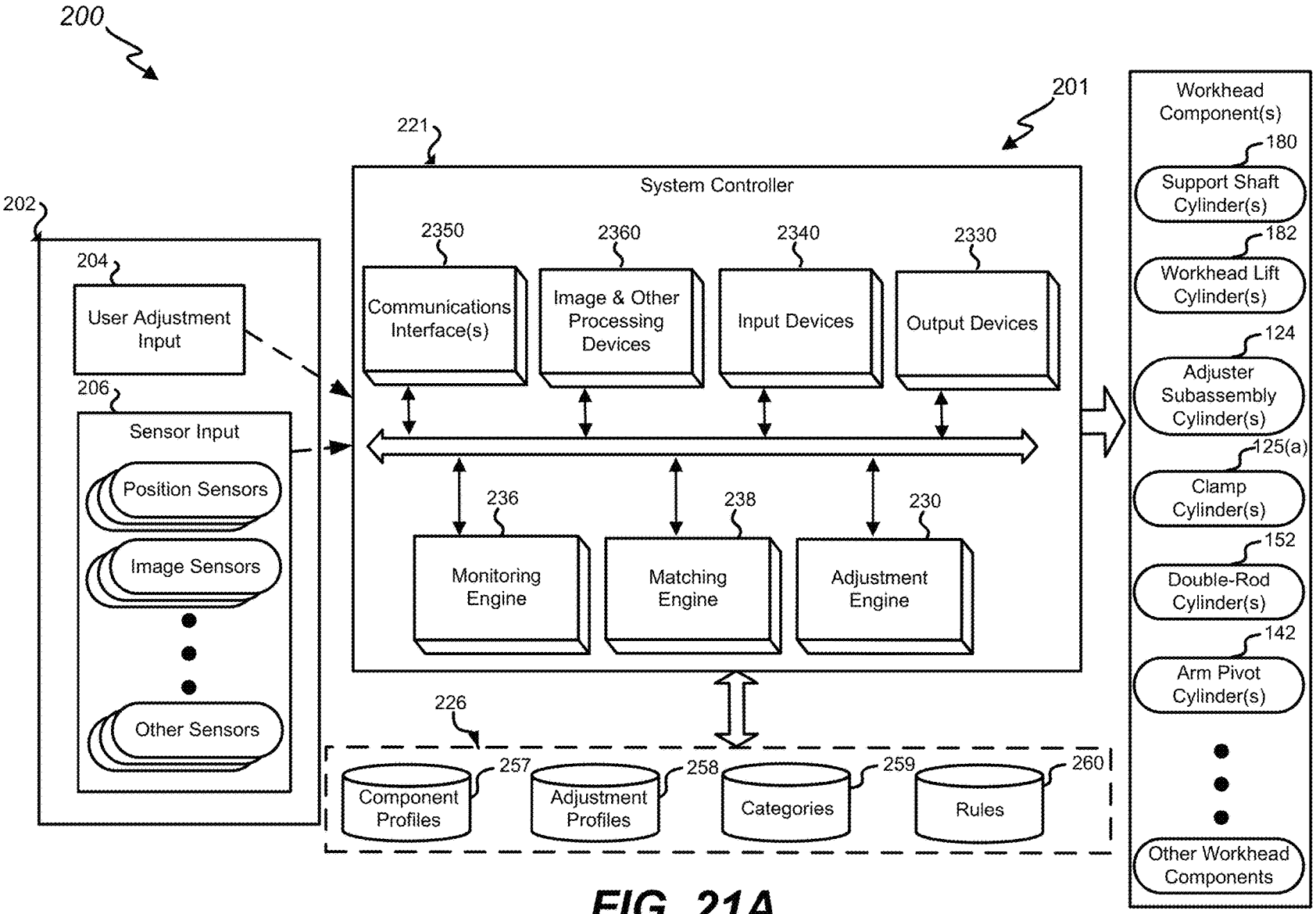
FIG. 21A illustrates a subsystem to facilitate railway component adjustment automation control, in accordance with disclosed embodiments of the present disclosure.
Figure 21B:
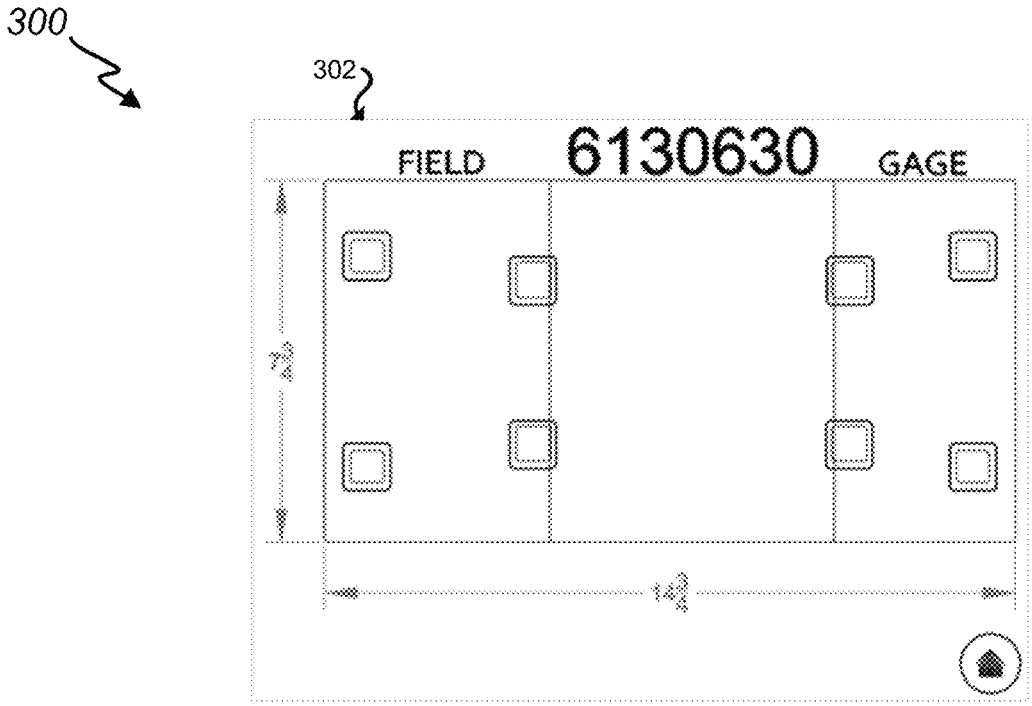
FIGS. 21B, 21C, 21D, and 21E illustrate some graphical aspects of an exemplary portion of an operator interface, in accordance with disclosed embodiments of the present disclosure.
Figure 21C:
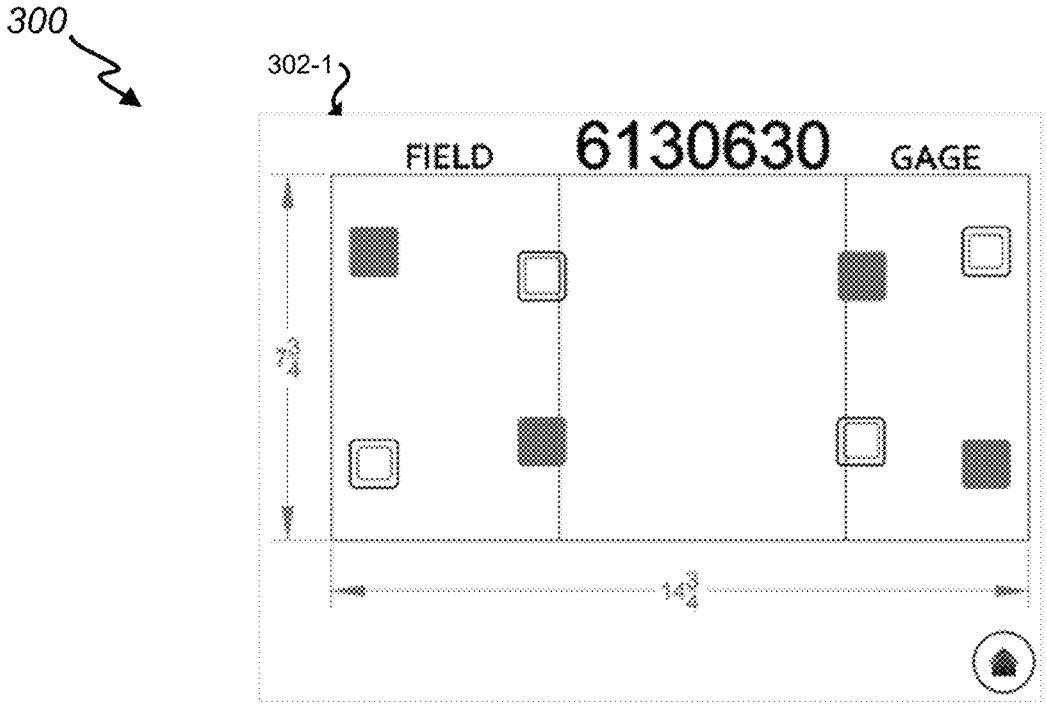

FIG. 21A illustrates a subsystem 200 corresponding to the control system 201 to facilitate component handling system 100 automation control, in accordance with disclosed embodiments of the present disclosure. The subsystem 200 may be included in or otherwise control aspects of the railway component handling system 100. While the subsystem 200 is illustrated as being composed of multiple components, it should be understood that the subsystem 200 may be broken into a greater number of components or collapsed into fewer components. Each component may include any one or combination of computerized hardware, software, and/or firmware. In various embodiments, the subsystem 200 may include a system controller and/or control engine 221, executed by one or more processors and may be implemented with any suitable device, such as a computing device, a standalone system controller device, a system controller device integrated with another device, such as operator station control device, etc. The system controller 221 may be located in or about the operator's cab. In some embodiments, the system controller 221 may be located at the workhead, being attached to the upper structure of the workhead.

The system controller 221 may include communications interfaces 2250, image processing and other processing devices 2260, input devices 2240, output devices 2230, and other components disclosed herein. Some of such components are discussed further in reference to FIG. 22. The system controller 221 may be communicatively coupled with interface components and communication channels (which may take various forms in various embodiments as disclosed herein) configured to receive adjustment input 202 via the communications interfaces 2250 and/or input devices 2240. As depicted, the adjustment input 202 may include user adjustment input 204. Referring again to FIG. 21A, the user input 204 may include real-time user control via a user interface—e.g., one or more interfaces provided via the operator station. User input may be provided by way of one or more user input devices, such as a touchscreen, a mouse, a track ball, a keyboard, buttons, switches, control handles, and/or the like.

The adjustment input 202 may further include the sensor input 206 disclosed herein. As described above, disclosed embodiments of the system 100 may include a plurality of sensors (e.g., position sensors, measurement sensors, distance sensors, proximity sensors, cameras for optical recognition, image analysis, metrics, and recognition, and/or the like) attached to any suitable structural element of the component handling system 100. For example, one or more sensors may be attached to one or more of the cylinders and/or the frame assembly 126 and disposed to capture sensor data that facilitates automatic alignment, extraction, and adjustment operations by detecting various features such as positions, appearance, surfaces, edges, contours, relative distances, and/or any other suitable indicia of the elements of the component handling 100 (e.g., the tie plate manipulator 102 and/or the fastener extractor 106) and/or railway components (e.g., fasteners, anchors, tie plates, railway ties, the rail, and/or the like) in accordance with disclosed embodiments.

For example, in disclosed embodiments, signals from a plurality of sensors may be utilized by the control system 201 to detect movement and positioning of the workhead components, such as the components of the tie plate manipulator 102 and the fastener extractor 106. Additionally, signals from the plurality of sensors may be utilized by the control system 201 to detect and recognize fasteners, anchors, tie plates, railway ties, the rail, and/or the like railway components. Further, signals from the plurality of sensors may be utilized by the control system 201 to detect obstructions, such as electrical boxes, stones, and other foreign objects. Hence, the sensors may be disposed to capture and sense data that facilitates one or a combination of the automatic detection, recognition, learning, positioning, extraction, adjustment, and patterning features disclosed herein.

Sensors and control units may be coupled and connected in a serial, parallel, star, hierarchical, and/or the like topologies and may communicate to the control system 201 via one or more serial, bus, or wireless protocols and technologies which may include, for example, WiFi, CAN bus, Bluetooth, I2C bus, ZigBee, Z-Wave and/or the like. For instance, one or more sensors and control units may use a ZigBee® communication protocol while one or more other devices communicate with the receiver using a Z-Wave® communication protocol. Other forms of wireless communication may be used by sensors, control units, and the control system 201. For instance, sensors, control units, and the control system 201 may be configured to communicate using a wireless local area network, which may use a communication protocol such as 802.11.

In some embodiments, a separate device may be connected with the control system 201 and/or the operator's station to enable communication with railway component adjustment devices. The separate device may be configured to allow for Zigbee®, Z-Wave®, and/or other forms of wireless communication. In some embodiments, the control system 201 and/or the operator's station may be enabled to communicate with a local wireless network and may use a separate communication device in order to communicate with sensors and control units that use a ZigBee® communication protocol, Z-Wave® communication protocol, and/or some other wireless communication protocols.

Utilizing the processing devices 2260, the subsystem 200 may process sensor input 206 and analyze the sensor input 206 to provide for the railway component adjustment automation control of one or more aspects of the component handling system 100. The sensor input 206 may be captured by any or combination of the sensors/detectors disclosed herein to facilitate detection, recognition, and differentiation of one or combination of types of features, railway components, positions, objects, appearances, movements, directions of movements, speeds of movements, device use, and/or the like. For example, the sensor input 206 may include location data, such as any information to facilitate detection, recognition, and differentiation of one or combination of locations of one or more components of the component handling system 100, such as components of the fastener extractors 106 and the tie plate manipulator 102, and/or railway components (e.g., fasteners, anchors, tie plates, railway ties, the rail, and/or the like) in and/or about the component handling system 100.

In some embodiments, the controller 221 may include an adjustment engine 230 that is configured to perform any one or combination of control features directed to railway component adjustment automation control of workhead components. The railway component adjustment automation control may direct the fastener extraction processes disclosed herein, as well as the tie plate and anchor adjustment processes disclosed herein. For example, as disclosed herein, the tie plate and anchor adjustment processes may include moving the railway anchors 114(*a*), 114(*b*) along the underside of the rail 108 (after the anchors have been attached to the rails by conventional means) away from the vertical faces of the railway tie 110 by way of moving the tie plate 114. To effect such processes, the controller 221, which may include the adjustment engine 230, may transmit control signals and/or commands or otherwise control the workhead components, such as the support shaft cylinder 180, the workhead lift cylinder 182, the adjuster subassembly cylinders 124, the clamp cylinders 125(*a*), the double-rod cylinder 152, the arm pivot cylinders 142, sensors (e.g., to adjust a camera), and/or other workhead components. While the following description may focus more to a certain extent on the use case of automation control of aspects of fastener extraction, such features and description are likewise applicable to the tie plate and anchor adjustment processes.

In some embodiments, a monitoring engine 236 may gather and process adjustment input 202 to facilitate creation, development, and/or use of railway adjustment profiles 226. The railway adjustment profiles 226 may include railway component profiles 257, such as the tie plate profiles and anchor profiles disclosed herein. The railway adjustment profiles 226 may include adjustment action profiles 258, such as the fastener, tie plate, and anchor extraction/adjustment patterns and processes disclosed herein. The railway adjustment profiles 226 may include categories 259, such as reference image and characteristic data compiled, utilized, and refined via machine learning to facilitate the recognition, characterization, and categorization of railway components disclosed herein. The railway adjustment profiles 226 may include rules 260 for handling the thresholds, operator selections, exceptions, inconsistencies, nonconformities, errors, operational modes, and/or the like disclosed herein.

The railway adjustment profiles 226 may include any suitable data that may be captured to indicate, infer, and/or determine component and adjustment identification, actions, locations, temporal factors, contexts, and patterns for components and/or adjustments. In various embodiments, the railway adjustment profiles 226 may be implemented in various ways. For example, one or more data processing systems may store the profile data. One or more relational or object-oriented databases, or flat files on one or more computers or networked storage devices, may store the profile data. In some embodiments, a centralized system stores the profile data; alternatively, a distributed/cloud system, network-based system, such as being implemented with a peer-to-peer network, or Internet, may store the profile data. The various aspects of the profiles data repositories 226 may be stored separately or consolidated into one repository.

In some embodiments, the controller 221 may include a matching engine 238 that may be an analysis engine. The matching engine 238 may be configured to perform any one or combination of features directed to matching or otherwise correlating information—and, in some embodiments, implementing machine learning—about components, action data, location data, temporal data, and/or the like. The captured data may be aggregated, consolidated, and transformed into refined profiles 226. In some embodiments, the monitoring engine 236 and/or the matching engine 238 may facilitate one or more learning/training modes. Some embodiments may perform image analysis of image data captured with cameras on one or more components of the component handling system 100 and/or other associated devices to determine one or more image baselines for railway components. Captured railway image data may be correlated to reference images using any suitable railway component traits for correlation.

For example, in some embodiments, the matching engine 238 may determine component characteristics based at least in part on adjustment input 202 received and processed by the monitoring engine 236. The matching engine 238 may define attributes of a railway component sensed based at least in part on the particular characteristics. The matching engine 238 may link railway image data to railway component profiles with image data associated with railway components, to determine identities of railway components. The reference image data may be refined over time as image baselines for particular railway components are developed with additional data captures. Such reference images may be used by the system to identify inconsistencies/nonconformities with respect to particularized patterns. When the system captures new images of a detected tie plate 114, a detected set of one or more fasteners 116, a detected anchor(s) and/or other objects detected proximate thereto, the system may analyze the image and perform comparative analyses of the detected tie plate 114, detected set of one or more fasteners 116, detected anchor(s), and/or other detected objects with respect to reference image data and/or other tie plate, fastener, anchor, and/or other object profile 257 information to determine consistencies and identify any inconsistencies. With such comparative analyses, the system 201 may provide error checking and correction for instances where an operator makes a selection that does not match the detected railway components and/or other objects. For example, the system may determine one or more inconsistencies between a selected template for a tie plate configuration/pattern and detected fasteners, holes, and/or dimensions of a detected tie plate 114, where the template-specified holes do not match the detected fasteners, holes, and/or dimensions of the detected tie plate 114. As another example, system 201 may determine one or more inconsistencies between a selected pattern of fasteners or other selections of fastener location(s) as targets for fastener extraction and detected fasteners, holes, and/or dimensions of a detected tie plate 114, where the selections do not match the detected fasteners, holes, and/or dimensions of the detected tie plate 114. Thus, the system 201 may provide error checking and correction for instances where an operator misidentifies a fastener (e.g., identifying a fastener via the user interface in a position where there is no fastener detected, overlooks a fastener by not selecting the fastener via the user interface for extraction), and/or where the operator misidentifies as a template a fastener and tie plate configuration/pattern where the fasteners and/or fastener holes do not match the detected fasteners and/or fastener holes of the detected tie plate (e.g., when a previously selected pattern of fastener extraction does not match a detected set of one or more fasteners). As yet another example, system may determine one or more inconsistencies between a selected pattern of anchors or other selections of anchor location(s) as targets for anchor adjustment and detected anchors and/or other objects detected, where the selections do not match the detected anchors and/or other objects.

When such inconsistencies/nonconformities satisfy one or more thresholds, certain adjustment actions may be caused and/or recommended via the user interface. For example, when a detected fastener placement in a detected tie plate 114 deviates from a designated tie plate template, designated fastener pattern, and/or other designated fastener location by more than a first threshold (e.g., a sixteenth of inch or more), the system 201 may generate a user notification regarding the deviation and may adjust the fastener extractor 106 by the deviated distance to accurately engage and extract a fastener 116 from the deviated hole location. However, when a detected fastener placement in a detected tie plate 114 deviates by more than a second threshold (e.g., an inch or more), the system 201 may generate a user notification regarding the deviation and may or may not require operator confirmation before adjusting the fastener extractor 106 by the deviated distance to accurately extract a fastener 116 from the deviated hole location. In such cases, a different tie plate, fastener, and/or fastener pattern profile 257 may be generated and/or selected before proceeding. As another example, when a detected railway component is obstructed (e.g., by a stone), the system 201 may generate a user notification regarding the obstruction and may pause extraction and/or adjustment operations until operator intervention is received. As yet another example, when a detected tie plate placement on a railway tie 110 deviates from a centered position or a different designated position (with respect to edges of the tie) by more than a threshold (e.g., half an inch or more), the system 201 may generate a user notification regarding the deviation and may require operator confirmation before continuing extraction and/or adjustment operations. Thus, disclosed embodiments not only ensure consistent and accurate extraction of fasteners 116, but also consistent and accurate adjustment of tie plates 114 and anchors 114(*a*), 114(*b*). As with all notifications, such notifications may include surfacing an image(s) of the detected aspects to the user interface. Moreover, such notifications and the corresponding thresholds that trigger the notifications may be operator-configurable to account for case-specific variances and tolerances.

According to disclosed embodiments, one or more adjustment sequences may be initiated with a push of a button. Disclosed embodiments may eliminate the need for one or more operators with productivity increases. Advantageously, the machine-directed operational features of the system 100 may correspond to technical improvements resulting in increased efficiencies, decreased costs, and less risk for operator error.

In operation, after the workhead is positioned generally over a given railway tie 110 needing fastener extraction and/or anchor adjustment, further refinement of positioning of the tie plate manipulator 102 and/or the fastener extractor 106 to facilitate fastener extraction and/or anchor adjustment operations may be directed by control system 201 based at least in part on the captured sensor data to perfectly align the working assembly before it begins each separate task and subtask, as appropriate. The automatic positioning refinement may or may not be initiated by an operator via one or more user-selectable options presented with the operator interface. Such captured sensor data may include previously recorded patterning data but may also include real-time sensor data. The real-time sensor data may be used by the control system 201 to identify inconsistencies and nonconformities, such as obstructions, variances in railway components with respect to one another and stored characteristics, and/or the like. The real-time sensor data, which may include image data of the railway components and installations, may be surfaced to an operator via the user interface. Further, the real-time image data may include real-time video that may be presented so that an operator may monitor extraction and adjustment operations.

An adjustment sequence may include automatic guidance to make positioning determinations of positions of the tie plate manipulator 102 and/or the fastener extractor 106, and to automatically guide the tie plate manipulator 102 and/or the fastener extractor 106 into target positions. For example, such automatic guidance may include moving the fastener extractor 106 from a stowed position (or another position) to a deployed position and positioning the fastener extractor 106 in a particular fastener addressing position to address a railway fastener 116 to engage and extract the railway fastener 116 from a railway tie 110. Additionally or alternatively, such automatic guidance may include moving the tie plate manipulator 102 from a stowed position (or another position) to a deployed position, and positioning the tie plate manipulator 102 in a particular tie plate addressing position to address a tie plate 114 to move the tie plate 114 with one or more operations disclosed herein. Additionally or alternatively, such automatic guidance may include lowering the tie plate manipulator 102 from a stowed position (or another position) to a deployed position, and positioning the tie plate manipulator 102 in a particular anchor addressing position to address one or more railway anchors 114(*a*), (*b*) to move the one or more railway anchors 114(*a*), (*b*) with one or more operations disclosed herein. In some embodiments, each step or a subset of the steps of the one or more adjustment sequences may be separately initiated by an operator via operator control of input devices.

FIGS. 22B, 22C, 22D, and 22E illustrate some graphical aspects of an exemplary portion of an operator interface 300, in accordance with disclosed embodiments of the present disclosure. As disclosed herein, the system controller 221 may generate a user interface 300 for an operator to view and control various aspects of the system 100 via user-selectable options of the user interface. The control system 201, having identified a particular tie plate 114 configuration corresponding to the detected tie plate 114 with the one or more sensors, may generate the operator interface 300 to illustrate the corresponding tie plate design. For example, the operator interface 300 may illustrate a geometrically accurate tie plate design 302 that may correspond to the detected tie plate 114. Similarly, the control system 201, having identified a railway fastener 116 configuration corresponding to the detected set of one or more fasteners 116 with the one or more sensors, may generate the operator interface 300 to illustrate the corresponding fastener images and positions. For example, the operator interface 300 may illustrate detected fasteners 116 on the geometrically accurate tie plate design 302 corresponding to the detected tie plate 114, as illustrated in FIGS. 22D and 22E.

The control system 201 may be loaded with common fastener, anchor, tie plate, and rail design specifications, which may be stored in the profiles 257. In some cases, design drawings may be loaded into the control system 201 to be used by the control system 201 to develop fastener, anchor, tie plate, and rail profiles 257 and graphical depictions, such as that illustrated with the fastener and tie plate design 302, which may be to scale in some embodiments. Additionally or alternatively, the control system 201 may detect fastener, anchor, tie plate, and rail tie plate characteristics with one or more sensors. For example, captured sensor data for a particular tie plate 114 may be used to create a tie plate profile. Likewise, captured sensor data for other railway components, such as a particular railway fastener 116, may be used to create another railway component profile, such as a fastener profile.

Captured images of the particular railway components may be used for the various railway component profiles 257. For example, captured images of the particular fastener 116 and tie plate 114 may be used for the fastener 257 and tie plate profile 257. The fastener and tie plate profiles 257 may include information that may be used as templates for fastener extraction operation. The fastener and tie plate profiles 257 may include fastener and tie plate characteristics, such as a fastener and tie plate identifiers (e.g., model numbers), physical dimension information, fastener hole position information, fastener hole size information, field side and gage side identifiers, shape, contour, and other geometrical modelling information, images, and/or the like. Disclosed embodiments may likewise include features for capturing images of other railway components, such as anchors 114(*a*), 114(*b*) and the rail 108 itself, and for using the images to develop profiles for those components.

In some embodiments, as the workhead is positioned over each tie plate 114, the control system 201 may analyze sensor data to identify characteristics of the particular tie plate 114, such as dimensions and hole placement. Having identified the tie plate characteristics, the control system 201 may search retained tie plate profiles 257 to compare the identified tie plate characteristics with defined attributes (e.g., dimension and hole configuration attributes in attribute fields) stored in the tie plate profiles to determine whether or not a matching tie plate profile 257 already exists in the system 201. In similar manner, some embodiments may provide for analysis of sensor data to identify characteristics of the particular anchors 114(*a*), 114(*b*), and may provide for similar anchor profile 257 matching operations. With the matching, extraction, and adjustment processes disclosed herein, the control system 201 may additionally account for the variances concomitant with direction of travel and on which rail 108 of the pair of rails 108 the workhead is used. With these variances, the orientations of tie plates 114 and anchors 114(*a*), 114(*b*) change, and positions of associated fastener holes change from the perspective of the workhead.

When there is a matching tie plate profile 257 stored by the control system 201, the control system 201 may utilize the matching tie plate profile 257 to perform machine-directed fastener extraction for the given tie plate 114, as well as subsequent matching tie plates 114. Upon identification of the matching tie plate profile 257, the control system 201 may cause a notification to be presented via the user interface 300. The notification may prompt operator confirmation of the match to proceed with the fastener operations without further operation interaction. In a similar manner, some embodiments may provide for similar anchor profile 257 matching operations for the tie plate and anchor adjustment operations, and likewise may provide for notifications for proceeding with machine-directed tie plate and anchor adjustment operations without further operation interaction. The automatic control of such operations may be based at least in part on specifications of prescribed engagement and adjustment distances specified in the profile information 257. For example, the fastener extractor 106 and/or the tie plate manipulator 102 may be lowered to engage fasteners 116 and/or a tie plate 114 based at least in part on a specified distance that takes into account the dimensions the workhead, the rail 108, the tie plate 114, and/or the fasteners 116. Likewise, the tie plate and anchor adjustments may be controlled based at least in part on a specified distances to move the tie plate 114 and/or the railway anchors 114(*a*), 114(*b*). Each of these operations may be guided based at least in part on the sensor input 206, which may be used to guide the movements of the railway and workhead components.

The notification of the match may include a graphical depiction of the matching tie plate, the matching dimensions, and/or the matching hole configuration. For example, the tie plate design 302 that may correspond to detected tie plate 114 and matching tie plate profile 257 may be presented. The notification may further include surfacing an image(s) of the detected tie plate 114 alongside or overlaid on the graphical depiction 302 of the matching tie plate. In the case of an overlay, one or both of the image(s) of the detected tie plate 114 and the graphical depiction 302 of the matching tie plate may be rescaled so that each have the same scale. The overlay of the image(s) of the detected tie plate 114 may be a composite of multiple detected images, as well as one or more supplemental images. For example, to represent both the gage side and the field side of a tie plate 114, multiple images may be assembled. Since the portion of the tie plate 114 that is covered by the rail 108 is not visible, the system 201 may omit that portion from the overlay or supplement that portion with a system-generated graphic. In a similar manner, some embodiments may provide for similar matching and graphical features for anchors 114(*a*), 114(*b*).

Further, the notification may prompt operator selection or confirmation of the fasteners 116 to be extracted from select holes of the tie plate 114. For example, FIG. 22B illustrates the tie plate design 302-1 with a subset of selected holes for fastener extraction. User-selectable options (e.g., via a touchscreen interface or another suitable means) may be provided to correspond to each hole of the depicted tie plate design 302-1. With the user-selectable options, the operator may designate from which holes have fasteners 116 that should be extracted. In some cases, the depicted tie plate design 302-1 may be pre-populated with the last received fastener selections for the particular tie plate design 302-1 when detected fasteners 116 installed in the tie plate 114 match the last received fastener selections. However, when there is a mismatch, a notification identifying the mismatch and prompting user selection may be generated and presented via the user interface. In a similar manner, some embodiments may provide for the aforesaid features for anchors 114(*a*), 114(*b*).

In some embodiments, in addition or in alternative to identifying characteristics of the particular tie plate 114, the control system 201 may analyze sensor data to identify characteristics of other detected railway components, such as detected railway fasteners 116 and/or detected railway anchors 114(*a*), 114(*b*). Take the following description with respect to a detected set of one or more railway fasteners 116 as example that is to be understood to likewise apply to detected railway anchors 114(*a*), 114(*b*). Having identified the fastener characteristics, the control system 201 may search retained fastener profiles 257 to compare the identified tie plate characteristics with defined attributes (e.g., dimension attributes in attribute fields) stored in the tie plate profiles to determine whether or not a matching fastener profile 257 already exists in the system 201. When there is a matching fastener profile 257 stored by the control system 201, the control system 201 may utilize the matching fastener profile 257 to perform machine-directed fastener extraction for the set of one or more fasteners 116, as well as subsequent matching fasteners 116. Upon identification of the matching fastener profile 257, the control system 201 may cause a notification to be presented via the user interface 300.

Figure 21D:
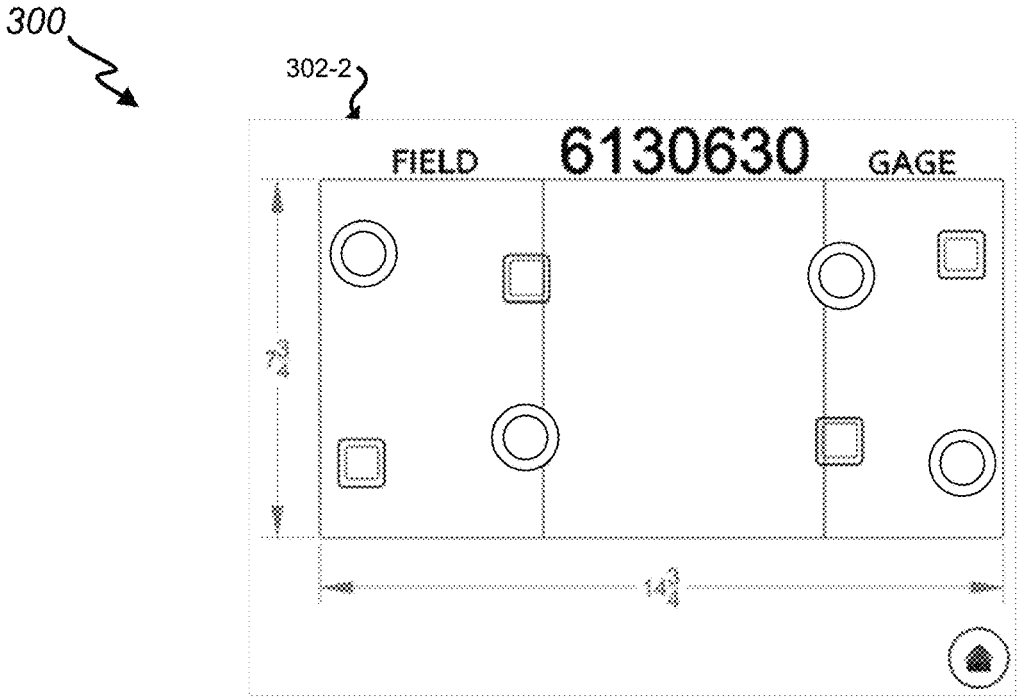

The notification of the match may include a graphical depiction of the matching fastener(s), which may include the matching dimensions. The notification may further include surfacing an image(s) of the detected set of one or more fasteners 116, which may be overlaid on the graphical depiction 302 of the matching tie plate, as illustrated by FIG. 21D. In alternatives, image(s) of the detected set of one or more fasteners 116 may be presented without images of the tie plate. In the case of an overlay, one or both of the image(s) of the detected set of one or more fasteners 116 and the graphical depiction 302 of the matching tie plate may be rescaled so that each have the same scale.

Figure 21E:
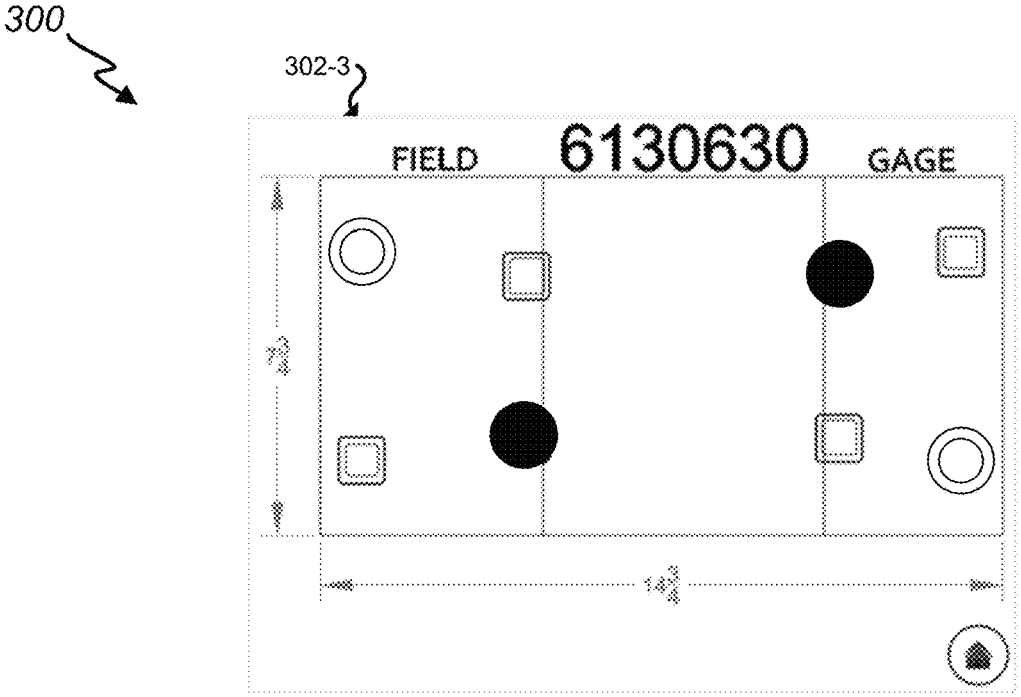

Further, the notification may prompt operator selection or confirmation of the fasteners 116 to be extracted from select holes of the tie plate 114. For example, FIG. 21E illustrates the tie plate design 302-1 with a subset of selected fasteners for fastener extraction. User-selectable options (e.g., via a touchscreen interface or another suitable means) may be provided to correspond to each fastener of the depicted set of one or more fasteners 116. With the user-selectable options, the operator may designate from which fasteners 116 should be extracted.

In some embodiments, upon detection of the set of one or more fasteners 116, a notification may prompt operator confirmation of the detected set of one or more fasteners 116 to proceed with the fastener extraction operations without further operation interaction. In one mode, the operator may indicate the sequence of fastener extraction, i.e., which fastener 116 should be extracted first, second, third, etc. In another mode, the operator need only indicate or confirm which fasteners 116 should be extracted. With that input, the control system 201 may determine the optimal sequence based at least in part on efficiency of movement of the fastener extractors 106. With the former mode, when the operator indicates the sequence, the control system 201 may determine the optimal sequence as in the latter mode and then compare the operator-indicated sequence to the optimal sequence. If the two sequences are not equivalent, the control system 201 may cause a notification to be presented to the operator, recommending the optimal sequence and prompting the operator to accept or reject the optimal sequence with selection of one or more user-selectable options presented with the operator interface 300.

In some embodiments, the control system 201 may cause a notification to be presented via the operator interface 300 upon detection of each tie plate 114 and/or set of one or more fasteners 116. Further, the control system 201 may prompt operator confirmation of the match to proceed with the fastener operations without further operation interaction with each tie plate 114 and/or set of one or more fasteners 116, so that the operator must provide a separate confirmation to proceed each time a tie plate 114 and/or set of one or more fasteners 116 is encountered. However, other embodiments may not require such confirmation, but may proceed with the fastener extraction operations with respect to a series of tie plates 114 and sets of one or more fasteners 116 without further operation interaction. Such operations may proceed until the control system 201 identifies one or more inconsistencies/nonconformities with respect to the particularized pattern, which may include a detected change to a different fastener configuration, tie plate configuration, an obstruction, a missing tie plate, a non-centered or otherwise ill-placed tie plate with respect to the tie, and/or the like. At that time, the control system 201 may cause a notification to be presented via the operator interface 300 and may or may not require operator interaction in order to proceed further, depending on the extent of the detected inconsistencies/nonconformities.

When there is no matching tie plate, fastener, and/or anchor profile 257 stored by the control system 201, the control system 201 may transition to a learning mode. The control system 201 may facilitate one or more learning modes. In one operational mode of the system 100, an operator may train the control system 201 to record a fastener extraction procedure for a given tie plate 114 and set of one or more fasteners 116. For example, the control system 201 provide a user-selectable option to record a sequence of fastener extraction operations in order to learn a new template for fastener extraction. An operator may select the record option to initiate system recording, then proceed to direct fastener extraction to completely extract the set of one or more fasteners 116 in a first tie plate 114, which may or may not correspond to extracting every fastener 116 in the tie plate 114. In some embodiments, this training may include the operator directly controlling each instance of fastener extraction for the given tie plate 114 and set of one or more fasteners 116. With the sensor feedback, the control system 201 may learn the pattern of fastener extraction for the particular tie plate 114 and set of one or more fasteners 116. Some embodiments may learn and infer positions of fasteners 116 in tie plates 114 using the detected positions of the cylinders, as detected by the associated position sensors. Additional disclosed embodiments may utilize other types of sensors, which may or may not in conjunction with position sensors, to learn and detect positions of fasteners 116. The control system 201 may store the learned pattern of fasteners 116, as well as the positioning and extraction operations of the railway fastener extractors 106, as part of a tie plate and/or fastener profile 257 for subsequent fastener extraction operations. The pattern may be stored by the control system 201 along with various other learned patterns for subsequent use. Such options for various patterns may be provided for operator selection via the graphical operator interface 300. In a similar manner, the control system 201 may facilitate such learning modes with respect to tie plate and anchor adjustment operations.

With the initial learning instance and subsequent learning instances with sensor data for corresponding tie plates 114 and/or set of one or more fasteners 116, the control system 201 may progressively learn and develop tie plate and/or fastener profiles 257. In such cases, the control system 201 may generate graphical depictions such as that illustrated with the tie plate and/or fastener configuration 302 based at least in part on the learned and developed tie plate and/or fastener profiles 257. Having learned a configuration, the system 100 may perform machine-directed fastener extraction for subsequent tie plates 114 having configurations that match the fastener configuration of the learned configuration. By way of example, with subsequent tie plates 114 and sets of one or more fasteners 116 in a series, the pattern may be repeated such that the control system 201 may direct extraction operations according to the learned pattern. In a similar manner, the system 100 may perform machine-directed tie plate and anchor adjustments for subsequent tie plates 114 and railway anchors 114(*a*), 114(*b*) having configurations that match the tie plate and anchor configuration of the learned configuration.

In some operational modes, one fastener 116 of the fastener pattern may be designated by the operator as the index fastener such that rest of the pattern is keyed off that index fastener. By default, the index fastener may be the first fastener position identified by the operator. In other instances, the operator may separately designate one fastener as an index hole. Having trained the control system 201 to proceed with the recorded extraction pattern based at least in part on the index fastener, the operator may select and confirm each index fastener each time a tie plate 114 and set of one or more fasteners 116 are encountered in order to initiate system-directed completion of the extraction pattern, keying off that index fastener selected by the operator. In some embodiments, the operator may extract a fastener 116 to designate it as the index fastener; in other embodiments, the operator may merely identify or position the claws of an extractor 106 over the index fastener. In either case, using the previously learned pattern for the particular fastener configuration, the control system 201 may then automatically complete fastener extraction for each tie plate 114 and set of one or more fasteners 116 without further operator input or interaction after initial direction to the index fastener. This and other system-controlled may free up the operator to perform other tasks. In a similar manner, one anchor 114 (*a*) or (*b*) of the similar anchor pattern may be designated by the operator as the index anchor such that rest of the pattern is keyed off that index anchor.

At the end of the fastener extraction process for the particular tie plate 114, the fastener-extracting arms 120 may be automatically controlled by the control system 201 without operator interaction to pivot away from the rail 108, thereby providing more space for the subsequent tie plate manipulation operations effected by the tie plate manipulator 102. The tie plate manipulator 102 may be lowered straight down to engage the tie plate 114 without any additional adjustment to the alignment. Such a mode of operation may be selectable in disclosed embodiments. The control system 201 may direct and control the lowering operation without further interaction of the operator. As part of the lowering operation, the control system 201 may position the tie plate manipulator 102 in a tie plate addressing position to perform a sequence of operations to move the tie plate 114 and thereby move the railway anchors 114(*a*), 114(*b*) attached to the rail 108, as disclosed above.

Disclosed embodiments may provide for automatic raising of the tie manipulator 102 from a deployed position to another position, such as a stowed position or a ready position. The control system 221 may direct and control the raising operation after completion of the anchor adjustment process with respect to a set of railway anchors 114(*a*), 114(*b*), without interaction of the operator. However, an operator may override the process, as well as any process disclosed herein, with a user-selectable option provided via the operator 300, and, further, may configure the operational settings such that any step or substep of the operations require operator initiation/confirmation.

Figure 22:
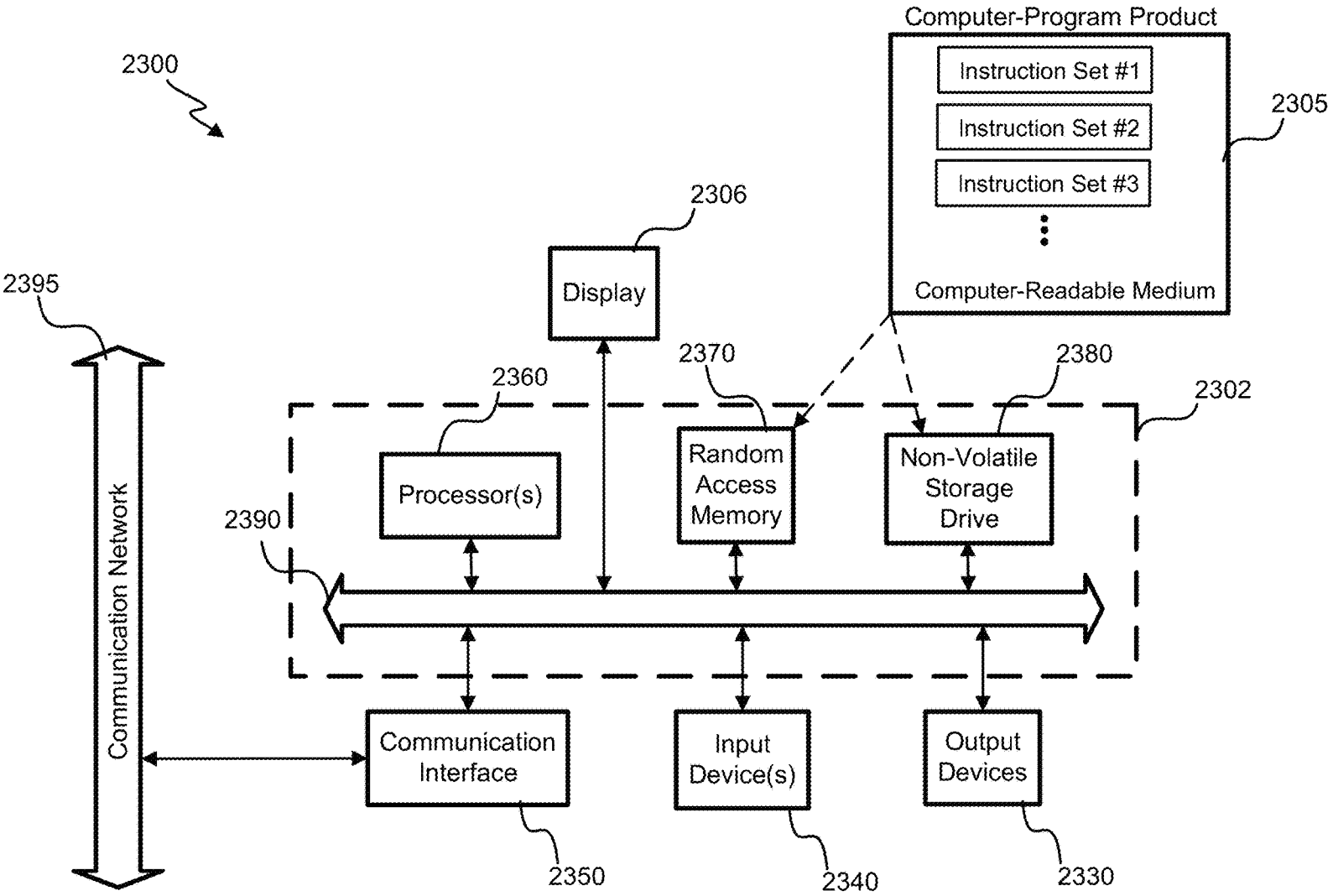
FIG. 22 is a diagram of an embodiment of a special-purpose computer system, in accordance with disclosed embodiments of the present disclosure.

With reference to FIG. 22, an embodiment of a special-purpose computer system 2200 is shown. The above methods may be implemented by computer-program products that direct a computer system to perform the actions of the above-described methods and components. In some embodiments, the special-purpose computer system 2200 may implement the subsystem 200. In some embodiments, the special-purpose computer system 2200 may be included in a control system that could, for example, be included in an operator station. Each such computer-program product may comprise sets of instructions (codes) embodied on a computer-readable medium that directs the processor of a computer system to perform corresponding actions. The instructions may be configured to run in sequential order, or in parallel (such as under different processing threads), or in a combination thereof. Merely by way of example, one or more procedures described with respect to the method(s) discussed herein might be implemented as code and/or instructions executable by a computer (and/or a processor within a computer); in an aspect, then, such code and/or instructions can be used to configure and/or adapt a general purpose computer (or other device) to perform one or more operations in accordance with the described methods, transforming the computer into the special-purpose computer system 2200.

As discussed further herein, according to a set of embodiments, some or all of the procedures of such methods are performed by the computer system 2200 in response to processor-execution of one or more sequences of one or more instructions (which might be incorporated into the operating system and/or other code, such as an application program) contained in the working memory. Such instructions may be read into the working memory from another computer-readable medium, such as one or more of the non-transitory storage device(s). Merely by way of example, execution of the sequences of instructions contained in the working memory might cause the processor(s) to perform one or more procedures of the methods described herein.

Special-purpose computer system 2200 may include a computer 2202, a display 2206 coupled to computer 2202, one or more additional user output devices 2230 (optional) coupled to computer 2202, one or more user input devices 2240 (e.g., joystick, keyboard, mouse, track ball, touch screen, buttons, switches, control handles, and/or the like) coupled to computer 2202, a communications interface 2250 coupled to computer 2202, a computer-program product 2205 stored in a tangible computer-readable memory in computer 2202. Computer-program product 2205 directs system 2200 to perform the above-described methods. Computer 2202 may include one or more processors 2260 that communicate with a number of peripheral devices via a bus subsystem 2290. These peripheral devices may include user output device(s) 2230, user input device(s) 2240, communications interface 2250, and a storage subsystem, such as random access memory (RAM) 2270 and non-volatile storage drive 2280 (e.g., disk drive, optical drive, solid state drive), which are forms of tangible computer-readable memory.

Computer-program product 2205 may be stored in non-volatile storage drive 2280 or another computer-readable medium accessible to computer 2202 and loaded into memory 2270. Each processor 2260 may comprise a microprocessor, such as a microprocessor from *Intel*® or Advanced Micro Devices, Inc.®, or the like. To support computer-program product 2205, the computer 2202 runs an operating system that handles the communications of product 2205 with the above-noted components, as well as the communications between the above-noted components in support of the computer-program product 2205. Exemplary operating systems include Windows® or the like from Microsoft® Corporation, Solaris® from Oracle®, LINUX, UNIX, and the like. The processors 2260 may include one or more special-purpose processors such as digital signal processing chips, graphics acceleration processors, video decoders, image processors, and/or the like.

User input devices 2240 include all possible types of devices and mechanisms to input information to computer system 2202. These may include a keyboard, a keypad, a mouse, a scanner, buttons, control handles, switches, a digital drawing pad, a touch screen incorporated into the display, audio input devices such as voice recognition systems, microphones, and other types of input devices. In various embodiments, user input devices 2240 may be embodied as a computer mouse, a trackball, a track pad, a joystick, buttons, control handles, switches, wireless remote, a drawing tablet, a voice command system. User input devices 2240 typically allow a user to select objects, icons, text and the like that appear on the display 2206 via a command such as a click of a button or the like. User output devices 2230 include all possible types of devices and mechanisms to output information from computer 2202. These may include a display 2206 (e.g., a monitor, a touchscreen, etc.), printers, non-visual displays such as audio output devices, etc. Some embodiments may not have a separate display 2206, but may have displays integrated with input devices and/or output devices, such as mobile devices, touchscreen devices, etc.

Communications interface 2250 provides an interface to other communication networks 2295 and devices and may serve as an interface to receive data from and transmit data to other systems, WANs and/or the Internet 2218. Embodiments of communications interface 2250 typically include an Ethernet card, a modem (telephone, satellite, cable, ISDN), a (asynchronous) digital subscriber line (DSL) unit, a FireWire® interface, a USB® interface, a wireless network adapter, and the like. For example, communications interface 2250 may be coupled to a computer network, to a FireWire® bus, or the like. In other embodiments, communications interface 2250 may be physically integrated on the motherboard of computer 2202, and/or may be a software program, or the like. In further examples, the communications interface 2250 may be part of a communications subsystem, which can include without limitation a modem, a network card (wireless or wired), an infrared communication device, a wireless communication device, and/or a chipset (such as a Bluetooth™ device, BLE, an 802.11 device, an 802.15.4 device, a WiFi device, a WiMax device, cellular communication device, etc.), and/or the like. The communications subsystem may permit data to be exchanged with a network (such as the network described below, to name one example), other computer systems, and/or any other devices described herein.

RAM 2270 and non-volatile storage drive 2280 are examples of tangible computer-readable media configured to store data such as computer-program product embodiments of the present invention, including executable computer code, human-readable code, or the like. Other types of tangible computer-readable media include floppy disks, removable hard disks, optical storage media such as CD-ROMs, DVDs, bar codes, semiconductor memories such as flash memories, read-only-memories (ROMs), battery-backed volatile memories, networked storage devices, and the like. RAM 2270 and non-volatile storage drive 2280 may be configured to store the basic programming and data constructs that provide the functionality of various embodiments of the present invention, as described above. The above are examples of one or more non-transitory storage devices that may be utilized by the system 2200. Such storage devices may be configured to implement any appropriate data stores, including without limitation, various file systems, database structures, and/or the like.

Software instruction sets that provide the functionality of the present invention may be stored in RAM 2270 and non-volatile storage drive 2280. These instruction sets or code may be executed by the processor(s) 2260. RAM 2270 and non-volatile storage drive 2280 may also provide a repository to store data and data structures used in accordance with the present invention. RAM 2270 and non-volatile storage drive 2280 may include a number of memories including a main random access memory (RAM) to store of instructions and data during program execution and a read-only memory (ROM) in which fixed instructions are stored. RAM 2270 and non-volatile storage drive 2280 may include a file storage subsystem providing persistent (non-volatile) storage of program and/or data files. RAM 2270 and non-volatile storage drive 2280 may also include removable storage systems, such as removable flash memory.

Bus subsystem 2290 provides a mechanism to allow the various components and subsystems of computer 2202 communicate with each other as intended. Although bus subsystem 2290 is shown schematically as a single bus, alternative embodiments of the bus subsystem may utilize multiple busses or communication paths within the computer 2202.

The above methods may be implemented by computer-program products that direct a computer system to control the actions of the above-described methods and components. Each such computer-program product may comprise sets of instructions (codes) embodied on a computer-readable medium that directs the processor of a computer system to cause corresponding actions. The instructions may be configured to run in sequential order, or in parallel (such as under different processing threads), or in a combination thereof. Special-purpose computer systems disclosed herein include a computer-program product(s) stored in tangible computer-readable memory that directs the systems to perform the above-described methods. The systems include one or more processors that communicate with a number of peripheral devices via a bus subsystem. These peripheral devices may include user output device(s), user input device(s), communications interface(s), and a storage subsystem, such as random access memory (RAM) and nonvolatile storage drive (e.g., disk drive, optical drive, solid state drive), which are forms of tangible computer-readable memory.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, hydraulic, pneumatic, and/or electric control connections, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs) or programmable logic controllers (PLCs), field programmable gate arrays (FPGAs), image processors, controllers, micro-controllers, microprocessors, other electronic units designed to perform the functions described above, and/or a combination thereof.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the terms "storage medium," "storage media," "computer-readable medium," "computer-readable media," "processor-readable medium," "processor-readable media," and variations of the term may represent one or more devices for storing data, including read only memory (ROM), random access memory (RAM), magnetic RAM, core memory, magnetic disk storage mediums, optical storage mediums, flash memory devices and/or other machine readable mediums for storing information. The terms, computer-readable media, processor-readable media, and variations of the term, include, but are not limited to portable or fixed storage devices, optical storage devices, wireless channels and various other mediums capable of storing, containing or carrying instruction(s) and/or data.

Certain elements of the system 100 may be in direct contact with each other and experience relative motion between their contacting (immediately adjacent) faces. In these instances, it may be sufficient to allow steel-on-steel contact and not experience overly destructive wear characteristics over time with normal use, depending on the quality of the base material of each component. Alternatively, in certain instances where relative motion occurs between faces of two or more components, it may be necessary to incorporate additional media between the components in order to absorb any wear from normal use into the replaceable wear component rather than the steel components. For example, a wear pad mounted between the faces of two sliding components to aid in reducing the friction between the two components as they move past one another and to minimize the amount of actual physical wear on the primary components. The wear pad would be the replaceable component meant to be discarded when physical wear reaches a certain limit.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

While the principles of the disclosure have been described above in connection with specific apparatuses and methods, it is to be clearly understood that this description is made only by way of example and not as limitation on the scope of the disclosure. Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered. Furthermore, while the figures depicting mechanical parts of the embodiments are drawn to scale, it is to be clearly understood as only by way of example and not as limiting the scope of the disclosure.

Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning. Furthermore, the use of ordinal number terms, such as "first," "second," etc., to clarify different elements in the claims is not intended to impart a particular position in a series, or any other sequential character or order, to the elements to which the ordinal number terms have been applied.

While the principles of the disclosure have been described above in connection with specific apparatuses and methods, it is to be clearly understood that this description is made only by way of example and not as limitation on the scope of the disclosure.

What is claimed is:

1. A railway component handling system comprising:

a railway workhead under control of a control system that is operable to move along a railway to a position over a railway tie, the railway workhead comprising:

a tie plate manipulator comprising at least one tool actuator coupled with one or more tools, the at least one tool actuator adapted to cause movement of the one or more tools;

a fastener extractor comprising a pair of fastener-extracting arms, each fastener-extracting arm of the pair of fastener-extracting arms:

comprising an extracting head disposed at a distal end of the fastener-extracting arm; and operable to extract, with the extracting head, a railway fastener from the railway tie; and the tie plate manipulator operable to:

adjust one or more railway anchors when the one or more railway anchors are attached to a rail;

wherein the fastener extractor is coupled with the tie plate manipulator so that the fastener extractor and the tie plate manipulator are aligned in an over-under arrangement.

2. The railway component handling system as recited in claim 1, where the control system is located at the railway workhead.

3. The railway component handling system as recited in claim 1, where the control system is located remotely from the railway workhead.

4. The railway component handling system as recited in claim 1, where the control system is configured to control positioning of the railway workhead over the railway tie.

5. The railway component handling system as recited in claim 1, where the control system is configured to:

control positioning of the fastener extractor over the railway fastener; and control the fastener extractor to extract the railway fastener from the railway tie.

6. The railway component handling system as recited in claim 1, where the control system is configured to:

control positioning of the tie plate manipulator over a tie plate; and control the tie plate manipulator to adjust the one or more railway anchors.

7. The railway component handling system as recited in claim 6, where the controlling the tie plate manipulator to adjust the one or more railway anchors comprises controlling the tie plate manipulator to engage a tie plate on the railway tie with the one or more tools.

8. The railway component handling system as recited in claim 1, where the control system is configured to detect the railway tie based at least in part on sensor data from one or more sensors.

9. A method for railway component adjustment comprising:

controlling, by a control system, positioning of a railway workhead over a railway tie, the railway workhead operable to move along a railway to a position over the railway tie;

controlling, by the control system, a fastener extractor of the railway workhead to extract a railway fastener from the railway tie, where:

the fastener extractor comprises a pair of fastener-extracting arms; and each fastener-extracting arm of the pair of fastener-extracting arm comprises an extracting head disposed at a distal end of the fastener-extracting arm; and controlling, by the control system, a tie plate manipulator of the railway workhead to adjust one or more railway anchors when the one or more railway anchors are attached to a rail, where tie plate manipulator comprises at least one tool actuator coupled with one or more tools, the at least one tool actuator adapted to cause movement of the one or more tools;

wherein the fastener extractor is coupled with the tie plate manipulator so that the fastener extractor and the tie plate manipulator are aligned in an over-under arrangement.

10. The method for railway component adjustment as recited in claim 9, where the control system is located at the railway workhead.

11. The method for railway component adjustment as recited in claim 9, where the control system is located remotely from the railway workhead.

12. The method for railway component adjustment as recited in claim 9, further comprising:

controlling, by the control system, positioning of the fastener extractor over the railway fastener.

13. The method for railway component adjustment as recited in claim 9, further comprising:

controlling, by the control system, positioning of the tie plate manipulator over a tie plate.

14. The method for railway component adjustment as recited in claim 9, where the controlling the tie plate manipulator to adjust the one or more railway anchors comprises controlling the tie plate manipulator to engage a tie plate on the railway tie with the one or more tools.

15. The method for railway component adjustment as recited in claim 9, further comprising:

detecting, by the control system, the railway tie based at least in part on sensor data from one or more sensors.

16. One or more non-transitory, machine-readable media having machine-readable instructions thereon which, when executed by one or more processing devices, cause the one or more processing devices to perform operations comprising:

controlling positioning of a railway workhead over a railway tie, the railway workhead operable to move along a railway to a position over the railway tie;

controlling a fastener extractor of the railway workhead to extract a railway fastener from the railway tie, where:

the fastener extractor comprises a pair of fastener-extracting arms; and each fastener-extracting arm of the pair of fastener-extracting arm comprises an extracting head disposed at a distal end of the fastener-extracting arm; and controlling a tie plate manipulator of the railway workhead to adjust one or more railway anchors when the one or more railway anchors are attached to a rail, where tie plate manipulator comprises at least one tool actuator coupled with one or more tools, the at least one tool actuator adapted to cause movement of the one or more tools;

wherein the fastener extractor is coupled with the tie plate manipulator so that the fastener extractor and the tie plate manipulator are aligned in an over-under arrangement.

17. The one or more non-transitory, machine-readable media as recited in claim 16, the operations further comprising:

controlling positioning of the fastener extractor over the railway fastener.

18. The one or more non-transitory, machine-readable media as recited in claim 16, the operations further comprising:

controlling positioning of the tie plate manipulator over a tie plate.

19. The one or more non-transitory, machine-readable media as recited in claim 16, where the controlling the tie plate manipulator to adjust the one or more railway anchors comprises controlling the tie plate manipulator to engage a tie plate on the railway tie with the one or more tools.

20. The one or more non-transitory, machine-readable media as recited in claim 16, the operations further comprising:

detecting the railway tie based at least in part on sensor data from one or more sensors.

* * * * *